US008552946B2

(12) United States Patent
Kurokawa et al.

(10) Patent No.: US 8,552,946 B2
(45) Date of Patent: Oct. 8, 2013

(54) DISPLAY DEVICE, DISPLAY DRIVER AND IMAGE DISPLAY METHOD

(75) Inventors: Yoshiki Kurokawa, Tokyo (JP); Yukari Katayama, Chigasaki (JP); Hiroki Awakura, Hitachinaka (JP); Naoki Takada, Yokohama (JP); Yasuyuki Kudo, Fujisawa (JP); Akihito Akai, Yokohama (JP); Goki Toshima, Yokohama (JP); Akihisa Aoyama, Kokubunji (JP); Goro Sakamaki, Fuchu (JP)

(73) Assignee: Renesas Electronics Corporation, Kanagawa (JP)

( * ) Notice: Subject to any disclaimer, the term of this patent is extended or adjusted under 35 U.S.C. 154(b) by 1088 days.

(21) Appl. No.: 12/108,583

(22) Filed: Apr. 24, 2008

(65) Prior Publication Data

US 2008/0272999 A1 Nov. 6, 2008

(30) Foreign Application Priority Data

Apr. 24, 2007 (JP) ..... 2007-114161
Jun. 21, 2007 (JP) ..... 2007-164248
Jun. 22, 2007 (JP) ..... 2007-164782
Sep. 26, 2007 (JP) ..... 2007-248314

(51) Int. Cl.
*G09G 3/36* (2006.01)

(52) U.S. Cl.
USPC ..... 345/89; 345/87; 345/102; 345/690; 382/169

(58) Field of Classification Search
USPC ..... 345/87–102; 382/169
See application file for complete search history.

(56) References Cited

U.S. PATENT DOCUMENTS

| | | | | |
|---|---|---|---|---|
| 6,498,596 | B1 | 12/2002 | Nakamura et al. | |
| 6,778,183 | B1 * | 8/2004 | Nair et al. | 345/589 |
| 7,034,843 | B2 * | 4/2006 | Nair et al. | 345/589 |
| 7,424,148 | B2 * | 9/2008 | Goh | 382/169 |
| 7,760,961 | B2 * | 7/2010 | Moldvai | 382/274 |
| 2002/0024491 | A1 | 2/2002 | Hosoyamada | |
| 2004/0239698 | A1 | 12/2004 | Kamada et al. | |
| 2004/0258324 | A1 * | 12/2004 | Liang et al. | 382/274 |
| 2005/0104842 | A1 | 5/2005 | Baik | |
| 2005/0212726 | A1 * | 9/2005 | Namba et al. | 345/63 |
| 2006/0139270 | A1 * | 6/2006 | Hong et al. | 345/87 |
| 2006/0269129 | A1 * | 11/2006 | Tanigawa | 382/169 |
| 2007/0092139 | A1 * | 4/2007 | Daly | 382/169 |
| 2007/0146236 | A1 * | 6/2007 | Kerofsky et al. | 345/7 |
| 2008/0018800 | A1 * | 1/2008 | Kodavalla | 348/672 |

(Continued)

FOREIGN PATENT DOCUMENTS

| | | |
|---|---|---|
| JP | 11-65531 | 3/1999 |
| JP | 2004-163518 A | 6/2004 |

(Continued)

*Primary Examiner* — Lun-Yi Lao
*Assistant Examiner* — Kelly B Hegarty
(74) *Attorney, Agent, or Firm* — Mattingly & Malur, PC

(57) ABSTRACT

In a display device and a display driver, when a grayscale of a display image is equal to or lower than a specific grayscale value obtained from a histogram of the display image, a display grayscale is extended with a linear function. On the other hand, when a grayscale of a display image is equal to or higher than the specific grayscale value, histogram equalization of a part higher than the specific grayscale value is performed, and the display grayscale is extended with a non-linear function obtained from the histogram equalization.

28 Claims, 45 Drawing Sheets

(56) References Cited

U.S. PATENT DOCUMENTS

| | | | | |
|---|---|---|---|---|
| 2009/0002285 | A1* | 1/2009 | Baba et al. | 345/77 |
| 2010/0090938 | A1 | 4/2010 | Kamada et al. | |
| 2010/0103206 | A1 | 4/2010 | Kamada et al. | |

FOREIGN PATENT DOCUMENTS

| | | | |
|---|---|---|---|
| JP | 2005-077950 | A | 3/2005 |
| JP | 2005-107019 | A | 4/2005 |
| JP | 2005-346032 | A | 12/2005 |
| JP | 2006-120030 | A | 5/2006 |
| KR | 10-2005-0047354 | A | 5/2005 |
| TW | 550415 | B | 9/2003 |
| TW | I228615 | B | 3/2005 |
| TW | I251199 | B | 3/2006 |

* cited by examiner

*FIG. 28*

| COUNTER | HISTOGRAM BOUNDARY REGISTER SETTING VALUE | COUNT UP RANGE |
|---|---|---|
| 2505 | 254 | 254−255 |
| 2506 | 252 | 252−253 |
| 2507 | 250 | 250−251 |
| 2508 | 248 | 248−249 |
| 2509 | 244 | 244−247 |
| 2510 | 240 | 240−243 |
| 2511 | 236 | 236−239 |
| 2512 | 232 | 232−235 |
| 2513 | 228 | 228−231 |
| 2514 | 224 | 224−227 |
| 2515 | 220 | 220−223 |
| 2516 | 216 | 216−219 |
| 2517 | 212 | 212−215 |
| 2518 | 208 | 208−211 |
| 2519 | 204 | 204−207 |
| 2520 | 200 | 200−203 |

2601

DISPLAY DEVICE, DISPLAY DRIVER AND IMAGE DISPLAY METHOD

CROSS-REFERENCE TO RELATED APPLICATION

The present application claims priority from Japanese Patent Application No. 2007-114161 filed on Apr. 24, 2007, Japanese Patent Application No. 2007-164248 filed on Jun. 21, 2007, Japanese Patent Application No. 2007-164782 filed on Jun. 22, 2007, Japanese Patent Application No. 2007-248314 filed on Sep. 26, 2007, the contents of which are hereby incorporated by reference into this application.

TECHNICAL FIELD OF THE INVENTION

The present invention relates to a display device and a drive circuit thereof having a light source whose light amount is controllable and performing the display by controlling a transmissivity control element for controlling the transmissivity of light arranged on a front surface of the light source. More particularly, it relates to a display device using a liquid crystal element and a drive circuit thereof (for example, LSI).

BACKGROUND OF THE INVENTION

It is important to suppress the power consumption in a small liquid crystal display used in a cellular phone or the like. In a liquid crystal display, a liquid crystal screen whose light transmissivity is controllable is illuminated with a backlight from the back and an image is displayed with a transmitted light. Since most of the power in the liquid crystal display is consumed by the backlight, it is very effective to suppress the power consumption of the backlight for reducing the power consumption of the liquid crystal display.

For its achievement, Japanese Patent Application Laid-Open Publication No. 11-65531 has proposed a method, in which the maximum value of the grayscale of a display image: x is acquired, the data of the entire image is extended so that the maximum value of the grayscale of the display image: x becomes the maximum grayscale of the liquid crystal display screen (255 grayscale in 8-bit RGB), and the light amount of the backlight is lowered so that a luminance value in the maximum grayscale (255 grayscale) becomes the luminance value of the maximum value of the grayscale of the display image, thereby reducing the power consumption.

Further, in order to reduce the power consumption, Japanese Patent Application Laid-Open Publication No. 11-65531 provides a method, in which a histogram of the grayscale of a display image is acquired, image data is extended with using a grayscale value P1, at which a cumulative value of the histogram from the maximum grayscale of the display image is equivalent to the predetermined number of pixels, as the maximum grayscale, and the light amount of the backlight is lowered so that the luminance value in the maximum grayscale (255 grayscale) display becomes the luminance value of the grayscale value P1, thereby reducing the power consumption.

SUMMARY OF THE INVENTION

In the technique of Japanese Patent Application Laid-Open Publication No. 11-65531, however, in the method of performing the data extension and the backlight control using the maximum value of the grayscale of the display image: x, if even one pixel of the maximum grayscale (255 grayscale) of the liquid crystal display device is contained in the display data of one frame or if the grayscale value very close to the maximum grayscale is contained, the light amount of the backlight cannot be lowered. Since the maximum grayscale of the liquid display screen or a value very close thereto is contained in most display images, the effects to be obtained are limited.

Further, in the method of performing the data extension and the backlight control using the grayscale value P1 at which a cumulative value of the histogram from the maximum grayscale of the display image is equivalent to the predetermined number of pixels, all the grayscale values equal to or larger than P1 of the display image are aligned to the maximum grayscale (255 grayscale) of the liquid crystal display device, and thus fine patterns represented by the grayscales equal to or higher than P1 disappear (hereinafter, referred to as whiteout).

An object of the present invention is to reduce the power consumption and eliminate the whiteout in a display device and a display driver having a power-saving function by the backlight control.

For the solution of the above problems, in the present invention, when the grayscale of the display image data is smaller than a specific grayscale, the contrast is increased by converting the display image to be extended in accordance with a linear function, and when the grayscale of the display image data is equal to or higher than the specific grayscale, the cumulative value of the number of pixels of each grayscale equal to or higher than the specific grayscale of the display image is calculated to make a conversion to the grayscale in accordance with the cumulative value, thereby ensuring the contrast even in the grayscale of the display image data equal to or higher than the specific grayscale.

Further, in the present invention, a calculation circuit for measuring the number of pixels of each grayscale of the display image and calculating the threshold grayscale at which the cumulative value from the maximum grayscale reaches a predetermined proportion of the total number of pixels is provided, and a register for setting a ratio of the difference between the specific grayscale and the threshold grayscale and the difference between the specific grayscale and the maximum grayscale of the display device is disposed, so that the specific grayscale is automatically defined in accordance with the display image, and extension rate suitable for the display image can be obtained.

Further, in the present invention, in a display device having a light source whose light amount is controllable and performing the display by controlling a transmissivity control element for controlling the transmissivity of light arranged on a front surface of the light source, a light amount control circuit for controlling the light amount of the light source is provided, and the light amount control circuit controls the light amount in accordance with the threshold grayscale, so that the power consumption by the backlight can be reduced without degrading the image quality and without changing the display luminance of the entire screen.

Further, in the present invention, a calculation circuit for measuring the number of pixels of each grayscale of the display image and calculating the threshold grayscale at which the cumulative value from the maximum grayscale reaches a predetermined proportion of the total number of pixels is provided, conversion (extension) is performed with a linear function when the grayscale equal to or lower than the threshold grayscale is input, the linear function is a linear function outputting a second specific grayscale when the threshold grayscale is input, and a register for setting a ratio of the difference between the threshold grayscale and the second specific grayscale and the difference between the threshold grayscale and the maximum grayscale of the display device is disposed, so that the second specific grayscale is automatically defined in accordance with the display image, and the extension rate suitable for the display image can be obtained.

Further, in the present invention, a function to switch the conversion method for a grayscale of pixel of the display image equal to or higher than the specific grayscale between the conversion in accordance with the cumulative value of the number of pixels of each grayscale equal to or higher than the specific grayscale and the conversion by a linear function is provided, whereby a stable and appropriate display can be performed even if the number of pixels of each grayscale equal to or higher than the specific grayscale is unstable depending on frames.

Further, in the present invention, the display image is divided into a plurality of regions, a histogram of each region is generated to calculate the threshold grayscale for each region, and the grayscale value at which the image grayscale extension method is switched is calculated from the maximum value of the threshold grayscale for each region, so that the grayscale extension method more suited for the display image can be obtained.

Further, in the present invention, the number of pixels of each grayscale of the display image in which difference from the adjacent pixel is equal to or larger than a predetermined value is measured, a second threshold grayscale is calculated with using the number of pixels as a second histogram, and the grayscale value at which the image grayscale extension method is switched is calculated from the second threshold grayscale, so that the extension method more suited for the display image can be obtained.

Further, in the present invention, the display image is divided into a plurality of regions, the number of pixels of each grayscale of the display image in which difference from the adjacent pixel is equal to or larger than a predetermined value is measured for each region, the threshold grayscale for each second region is calculated with using the number of pixels as a second histogram, and the grayscale value at which the image grayscale extension method is switched is calculated from the maximum one of the grayscale values for each second region, so that the extension method more suited for the display image can be obtained.

Further, in the present invention, in the extension method in which the image grayscale extension method is switched by the threshold grayscale, a grayscale of a pixel of the display image of equal to or lower than the threshold grayscale is converted (extended) by using a linear function, the output grayscale when the threshold grayscale is input to the linear function is a specific grayscale, and the light amount of the backlight is controlled in accordance with the ratio of the difference between the maximum grayscale and the threshold grayscale value and the difference between the specific grayscale and the threshold grayscale, so that the power consumption by the backlight can be reduced without degrading the image quality and without changing the display luminance of the entire screen.

Further, in the present invention, the number of pixels of each grayscale of the display image in which difference from the adjacent pixel is equal to or larger than a predetermined value is measured, a second threshold grayscale is calculated with using the number of pixels as a second histogram, the grayscale value at which the image grayscale extension method is switched is calculated from the second threshold grayscale, and the conversion (extension) is performed with a linear function even for a grayscale of a pixel of the display image of equal to or larger than the grayscale value at which the image grayscale extension method is switched, so that the extension method more suited for the display image can be obtained with a simpler circuit.

Further, in the present invention, the display image is divided into a plurality of regions, the number of pixels of each grayscale of the display image in which difference from the adjacent pixel is equal to or larger than a predetermined value is measured for each region, the threshold grayscale for each second region is calculated with using the number of pixels as a second histogram for each region, the grayscale value at which the image grayscale extension method is switched is calculated from the maximum grayscale value of the threshold grayscale for each second region, and the conversion (extension) is performed with a linear function even for a grayscale of a pixel of the display image of equal to or larger than the grayscale value at which the image grayscale extension method is switched, so that the extension method more suited for the display image can be obtained with a simpler circuit.

Further, in the present invention, the display image is divided into a plurality of regions, a histogram is generated for each region, the grayscale value at which the image grayscale extension method is switched is calculated from a maximum value of the threshold grayscale value for each region where a cumulative value from the maximum grayscale obtained for each region reaches a predetermined value, and the conversion (extension) is performed with a linear function even for a grayscale of a pixel of the display image of equal to or larger than the grayscale value at which the image grayscale extension method is switched, so that the extension method more suited for the display image can be obtained with a simpler circuit.

Further, in the present invention, the display image is divided into a plurality of regions, a histogram is generated for each region, the grayscale value at which the image grayscale extension method is switched is calculated from a maximum value of the threshold grayscale value for each region in which a cumulative value from the maximum grayscale obtained for each region reaches a predetermined value, and the conversion to the maximum grayscale of the display device is performed for a grayscale of a pixel of the display image of equal to or larger than the grayscale value at which the image grayscale extension method is switched, so that the extension method more suited for the display image can be obtained with a simpler circuit.

Further, in the present invention, the grayscale value at which the image grayscale extension method is switched is calculated from the threshold grayscale value obtained from a histogram calculated from the grayscale of the display image in which the difference from the adjacent pixel is equal to or larger than a predetermined value, and the conversion to the maximum grayscale of the display device is performed for a grayscale of a pixel of the display image of equal to or larger than the grayscale value at which the image grayscale extension method is switched, so that the extension method more suited for the display image can be obtained with a simpler circuit.

Further, in the present invention, the display image is divided into a plurality of regions, a histogram calculated from the grayscale of the display image in which difference from the adjacent pixel is equal to or larger than a predetermined value is generated for each region, the grayscale value at which the image grayscale extension method is switched is calculated from a maximum value of the edge threshold grayscale value for each region in which a cumulative value from the maximum grayscale obtained for each region reaches a predetermined value, and the conversion to the maximum grayscale of the display device is performed for a grayscale of a pixel of the display image of equal to or larger than the grayscale value at which the image grayscale extension method is switched, so that the extension method more suited for the display image can be obtained with a simpler circuit.

According to the present invention, in an image grayscale extension circuit for performing the extension of the grayscale provided for the purpose of enhancing the contrast of the display image, the slope of the linear function is set to 1 or more for the grayscale equal to or lower than a specific grayscale. By this means, the contrast of the display image can be enhanced.

Further, according to the present invention, in an image grayscale extension circuit for performing the extension of the grayscale provided for the purpose of enhancing the contrast of the display image, the histogram equalization is performed for the grayscale equal to or higher than the specific grayscale. By this means, the contrast of the display image can be enhanced.

Further, according to the present invention, the luminance value of the backlight of the image in which the contrast is raised as described above is suppressed by the raised amount of the contrast. By this means, the power consumption of the backlight can be reduced.

Further, according to the present invention, the specific grayscale and the backlight luminance corresponding to the display image can be automatically adjusted based on the grayscale value of upper several % of the histogram of the image. Therefore, the suitable display corresponding to the display image can be performed.

Further, according to the present invention, the specific grayscale and the backlight luminance corresponding to the display image can be automatically adjusted by using the histograms of the divided regions and histogram information of the edge. Therefore, more suitable display corresponding to the display image can be performed.

Further, according to the present invention, the conversion method for the grayscale equal to or higher than the specific grayscale can be switched between the histogram equalization and the linear function. Therefore, the stable conversion can be performed by switching the conversion method for the grayscale equal to or higher than the specific grayscale to the linear function even in an image in which the distribution of the histograms of the specific grayscale or higher changes in each frame.

In many television images and others, an outstanding peak is present at the maximum grayscale (255 grayscale) in the histogram of the grayscale and other grayscales are smoothly changed as shown in FIG. 35. Due to the outstanding peak at the maximum grayscale, a predetermined number of pixels from the maximum grayscale of the display image are mostly occupied by a number of pixels indicating the maximum grayscale. As a result, the peak of the distribution of the grayscales takes a value of the maximum grayscale or a value very close to the maximum grayscale, and the light amount of the backlight cannot be lowered. Consequently, there occurs a problem that the power consumption cannot be reduced.

In order to solve the above problems, the present invention provides means which performs the calculation while eliminating the pixels of a plurality of grayscales including a predetermined grayscale (for example, maximum grayscale) from an object to be cumulated and excludes a predetermined proportion to be cumulated at the time of pixel grayscale extension, when calculating the histogram cumulative value from the maximum grayscale.

Specifically, a display driver according to the present invention controls a light source whose light amount is controllable and a transmissivity control element for controlling the transmissivity of light arranged on a front surface of the light source, wherein the display driver measures the number of pixels of each grayscale of a display image, extends a grayscale of a pixel of the display image data with using the threshold grayscale, at which a cumulative value from the maximum grayscale of the cumulating target reaches a predetermined proportion of the total number of pixels, as the maximum grayscale, and controls the light source so as to obtain the same luminance as the display luminance of the threshold grayscale at the time of maximum grayscale display.

The highest grayscale of the display image may be excluded from the cumulating target of the display driver. Also, the highest grayscale of the display image may be included in the cumulating target. As the combination thereof, whether or not the maximum grayscale of the display image is included as the cumulating target may be switched.

The display driver according to the present invention drives a light source and a display device. And said display driver includes: a histogram cumulative value calculating circuit calculating the histogram of the display image of one frame; a coefficient calculating circuit for calculating a histogram extension coefficient; and a pixel extension circuit, wherein the histogram cumulative value calculating circuit sums the number of pixels of each grayscale of display image of one frame from the maximum grayscale and then outputs the same, the coefficient calculating circuit obtains the pixel extension coefficient from the total value of each grayscale and then outputs the obtained pixel extension coefficient, and the pixel extension circuit extends the grayscale of the display image of one frame so that the grayscale equal to or lower than the pixel extension coefficient becomes the entire grayscale.

The histogram cumulative value calculating circuit of the display driver may be that does not output the number of pixels of the highest grayscale of the display image or may be that outputs the number of pixels of the highest grayscale. Further, the histogram cumulative value calculating circuit may include a mode switching register and output the number of pixels of the highest grayscale in accordance with the setting of the mode switching register.

The histogram cumulative value calculating circuit of the display driver may simultaneously output the number of pixels of each grayscale by different signal lines. Further, the histogram cumulative value calculating circuit of the display driver may sequentially output the number of pixels of each grayscale by the same signal line.

The coefficient calculating circuit of the display driver includes a threshold determination value storage register for holding a threshold determination value, and the coefficient calculating circuit sequentially adds the number of pixels of each grayscale from the high grayscale and determines the pixel extension coefficient for each display image of one frame by comparing with the threshold determination value.

Alternatively, the coefficient calculating circuit of the display driver obtains the pixel extension coefficients for each of the display images of plurality of frames and outputs an average value thereof as the pixel extension coefficient.

The pixel extension circuit of the display driver linearly extends the grayscale equal to or lower than the pixel extension coefficient.

The display driver further includes a CPU and an illumination sensor, wherein the CPU rewrites the value of the threshold determination value storage register in accordance with the illumination acquired by the illumination sensor.

The display driver further includes a backlight controller, and the backlight controller may control the backlight in accordance with the obtained pixel extension coefficient.

Application to a display device or electronic equipment characterized by including such display driver is also possible.

Further, according to the present invention, the power consumption can be significantly reduced by eliminating the number of pixels of the maximum grayscale of the light source which is not important in terms of an image in the screen (sun and fluorescent lamp).

According to the present invention, when the number of pixels of the maximum grayscale is equal to or larger than a predetermined value, by performing the calculation by putting the number of pixels of the maximum grayscale into the cumulative value of the histogram, the reduction in luminance at a high-luminance display location in a binary image is prevented and excellent display can be achieved.

According to the present invention, an image does not degrade even if the image is entirely whitish like cloud because the grayscale immediately below the maximum grayscale has a large number of pixels.

A drive circuit of a display device of the present invention has a mode register for determining whether or not the number of pixels of a predetermined grayscale is included in the cumulative value of the histogram in the display driver. As a result, according to the present invention, when displaying images mainly containing natural images such as moving images, the CPU determines the application and excludes the maximum grayscale from the histogram, and when displaying images mainly containing binary images such as document files, since the maximum grayscale can be included in the histogram, the image can be displayed more clearly.

In the drive circuit of the display device of the present invention, the threshold value of the number of pixels of the maximum grayscale for determining whether or not the number of pixels of the maximum grayscale is included in the histogram cumulative value can be set by the CPU. As a result, according to the present invention, the optimum threshold value can be set by the grayscale luminance characteristics of the liquid crystal or the like, and the image display can be made clearer.

Further, according to the present invention, the threshold value of the number of pixels of the maximum grayscale for determining whether or not the number of pixels of the maximum grayscale is included in the histogram cumulative value can be set by the CPU. As a result, even if the reduction in luminance or the like occurs due to aging of the backlight, the image can be displayed clearly by setting an optimum threshold value.

In addition, in the backlight control method using the histogram disclosed in Japanese Patent Application Laid-Open Publication No. 11-65531, the image quality degradation cannot be avoided. However, in order to suppress the image quality degradation to an acceptable range within a predetermined level, the histogram of the display image is analyzed so that the area of the region where luminance resolution is diminished and the image quality degrades due to the extension of the display data is restricted to several % or less of the entire screen, and the control of a reduction rate of the backlight emission amount and the extension rate of the display data is performed, thereby reducing the power consumption.

Here, it is assumed that there is a natural image in which the backlight emission amount can be reduced by 30% by using the backlight control method disclosed in Japanese Patent Application Laid-Open Publication No. 11-65531. In other words, it is assumed that there is a natural image in which the luminance of the pixels at the position of upper several % of the histogram of the display image is 70%. When an icon that is an artificial image symbolically representing a function button and information is overlapped and displayed on the natural image, since high luminance colors such as white, red, green, blue, and the like are often used for icons, the pixels of the icon region occupy upper several % of the histogram, and the luminance of the pixels at the position of upper several % becomes higher than 70%. As a result, the amount capable of reducing the backlight emission amount is decreased to less than 30%, compared with the case where only the natural images are displayed.

On the display screen of the cellular phone, digital camera, and the like, the natural image and the icon including a large number of high-luminance pixels are often displayed simultaneously as described above, and the expected power consumption reduction effect cannot be achieved in some cases by the conventional backlight control method.

Therefore, an object of the present invention is to provide, in an image display device in which image quality degradation for pixels is allowed to a certain extent and the backlight emission amount is correspondingly reduced to achieve the power saving, a drive circuit of an image display device and an image display method capable of enhancing a power consumption reduction effect while maintaining a display quality, by distinguishing a region where the influence on the display quality is high or low in a display screen, for example, a portion such as an icon formed by a painted figure in which a large number of high-luminance pixels are present and the influence on the display quality is low even when the luminance resolution diminishes, from other regions, and appropriately controlling the backlight emission amount while taking into account the influence on the display quality.

For its achievement, the present invention provides a drive circuit of an image display device and an image display method for displaying an image by irradiating a backlight to a display screen, and has following features.

That is, the drive circuit includes a backlight control unit comprising: a histogram counting unit for acquiring a histogram by counting display data in units of one or plural image frames and calculating a value of the display data at a specific upper position of the histogram; a display data extension unit for extending each display data based on the value of the display data at the specific position; and a backlight adjustment unit for adjusting a light emission amount of the backlight based on the value of the display data at the specific position, wherein the histogram counting unit includes a weighting coefficient calculating unit for outputting a weighting coefficient corresponding to a display position on the display screen of each display data, and counts the display data while adding the weighting coefficient to each display data, thereby acquiring the histogram.

Further, according to the present invention, the influence on the display quality by the display position of each pixel can be matched with the influence on the backlight emission amount control, and the influence on the display quality can be accurately managed compared to the conventional technique. Therefore, the backlight emission amount can be further reduced while maintaining the display quality, and further power reduction can be achieved.

BRIEF DESCRIPTIONS OF THE DRAWINGS

FIG. 28 is view showing an example of setting a histogram boundary setting register according to the eleventh embodiment of the present invention;

DESCRIPTIONS OF THE PREFERRED EMBODIMENTS

Hereinafter, embodiments of the present invention will be described in detail with reference to the accompanying drawings. Note that components having the same function are denoted by the same reference numbers throughout the drawings for describing the embodiments, and the repetitive description thereof will be omitted.

First Embodiment

Figure 1A:
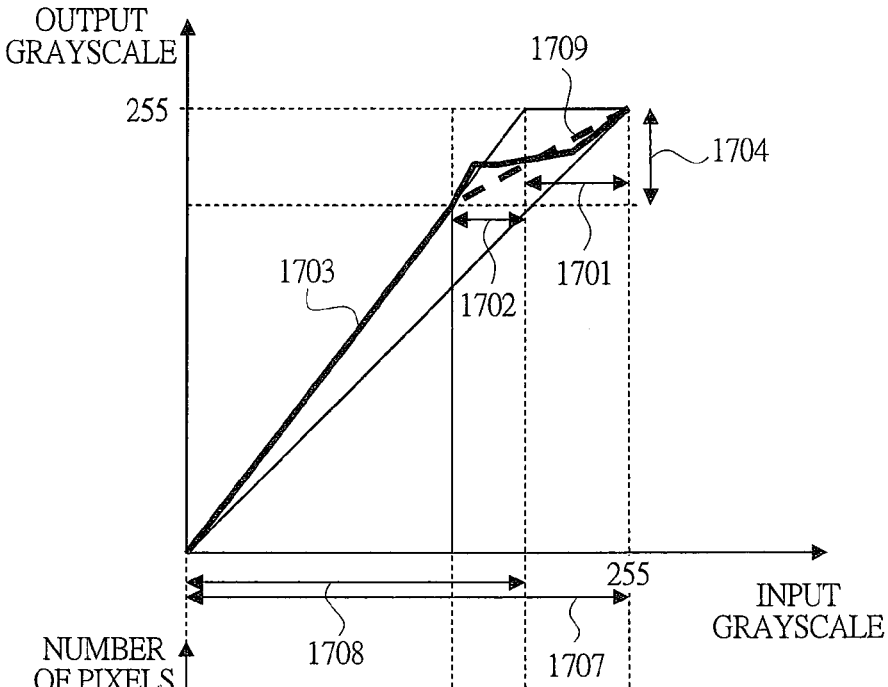
FIG. 1A is a view for describing an outline of an image grayscale extending process of a display device according to a first embodiment of the present invention.
Figure 1B:
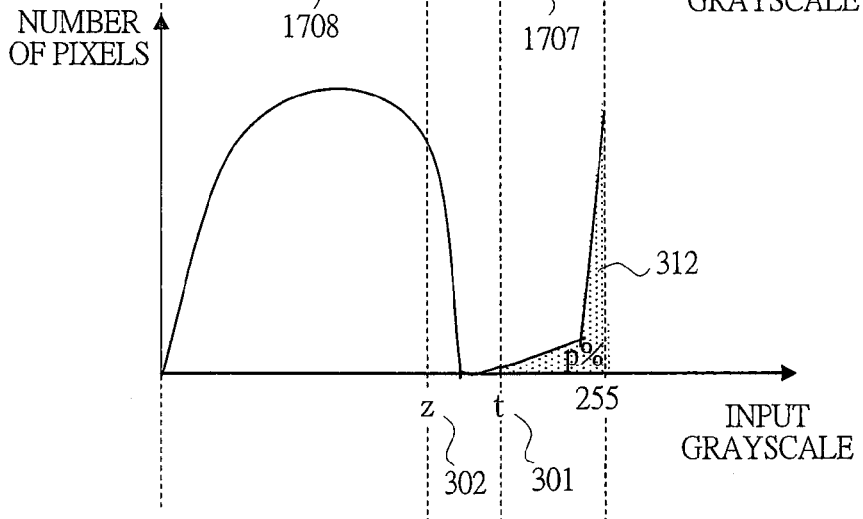
FIG. 1B is a view for describing an outline of the image grayscale extending process of the display device according to the first embodiment of the present invention.
Figure 1C:
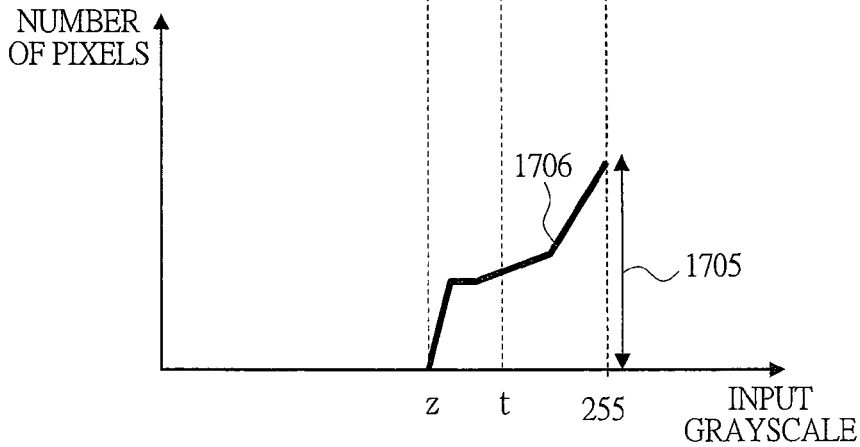
FIG. 1C is a view for describing an outline of the image grayscale extending process of the display device according to the first embodiment of the present invention.

First, the outline of an image grayscale extending process performed in the display driver according to a first embodiment of the present invention will be described briefly with reference to FIG. 1. In the present embodiment, the operation shown in FIG. 1 is performed to lower to the backlight power. FIG. 1A is a view showing a relationship of input grayscale and output grayscale of the display driver of the present embodiment. FIG. 1B is a view showing a histogram of the display image. As shown in FIG. 1B, in the display image, the t grayscale 301 at which the number of pixels of the t grayscale 301 or higher and the maximum grayscale (255 grayscale) or lower is p % 312 of the total number of pixels is referred to as a threshold grayscale t301. In FIG. 1B, a grayscale z302 between the grayscale 0 and the grayscale t will be considered.

In the present embodiment, the difference 1702 between the grayscale t and the grayscale z is controlled to be a constant multiple of the difference 1701 between the grayscale t and the maximum grayscale (255 grayscale). If the difference 1701 between the grayscale t and the maximum grayscale (255 grayscale) is a, the difference 1702 between the grayscale t and the grayscale z is represented as ka by using a constant k. The constant k is desirably 0 or more and 1 or less, but may be 1 or more depending on the system.

Here, a slope of a linear function 1703 connecting coordinates (0, 0) and (t, maximum grayscale (255 grayscale)) of FIG. 1A is defined as α, where α is expressed by equation 1.

$$\alpha = \frac{255}{t} \qquad \text{Equation 1}$$

When the grayscale value of the pixel of the display image is equal to or lower than the grayscale z, the pixel extending circuit of the present embodiment performs the conversion by using the linear function 1703. The linear function is expressed by equation 2.

$$y = \frac{255}{t} \cdot x \qquad \text{Equation 2}$$

When the grayscale value of the pixel of the display image is equal to or larger than z, the conversion is performed by using a method referred to as histogram equalization.

The conversion method for an input value equal to or larger than the grayscale z will be described in detail below. The reference number 1706 of FIG. 1C denotes the cumulative value (total number of pixels) of the histogram from the grayscale z+1 to the grayscale x. It is assumed that the number of pixels of each grayscale shown in FIG. 1B can be represented by the function F(x). The cumulative value (total number of pixels) of the histogram from the grayscale z+1 to the grayscale x is expressed as the equation 3 by using F(x).

$$\sum_{s=z+1}^{x} F(s) \quad \text{Equation 3}$$

The reference number 1705 is a total number of pixels from the grayscale z+1 to the 255 grayscale and is expressed as the equation 4.

$$\sum_{s=z+1}^{255} F(s) \quad \text{Equation 4}$$

The difference 1704 between the output value of the linear function 1703 at the grayscale z and the maximum grayscale (255) is expressed as αka by using the slope α of the linear function 1703, the constant k, and the difference a between the grayscale t and the maximum grayscale (255 grayscale). At this time, the output grayscale for the input value x equal to or larger than the grayscale z+1 is expressed as the equation 5.

$$y = \frac{255}{t} z + \frac{\sum_{s=z+1}^{x} F(s)}{\sum_{s=z+1}^{255} F(s)} \alpha k a \quad \text{Equation 5}$$

When the backlight luminance 1707 when extension process is not performed is defined as B, even if the backlight luminance (equation 6) is reduced to 1708, the similar display as before the conversion can be performed with respect to the input value equal to or lower than the grayscale z, and the grayscale equal to or higher than the grayscale z can be displayed while maintaining a contrast.

$$y = \frac{t}{255} B \quad \text{Equation 6}$$

By the conversion as described above, compared to the conventional conversion method in which the pixels of the display image are converted by the linear function 1703 connecting the coordinates (0, 0) and (t, maximum grayscale (255)) when the grayscale value of the pixel of the display image is equal to or lower than the threshold grayscale t301, and all the grayscales equal to or higher than the threshold grayscale t301 are converted to the maximum grayscale (255), the whiteout can be prevented. Also, preferable display can be obtained without degrading the contrast for the portion equal to or higher than the grayscale z.

A display device according to the first embodiment of the present invention will be described below.

Figure 2:
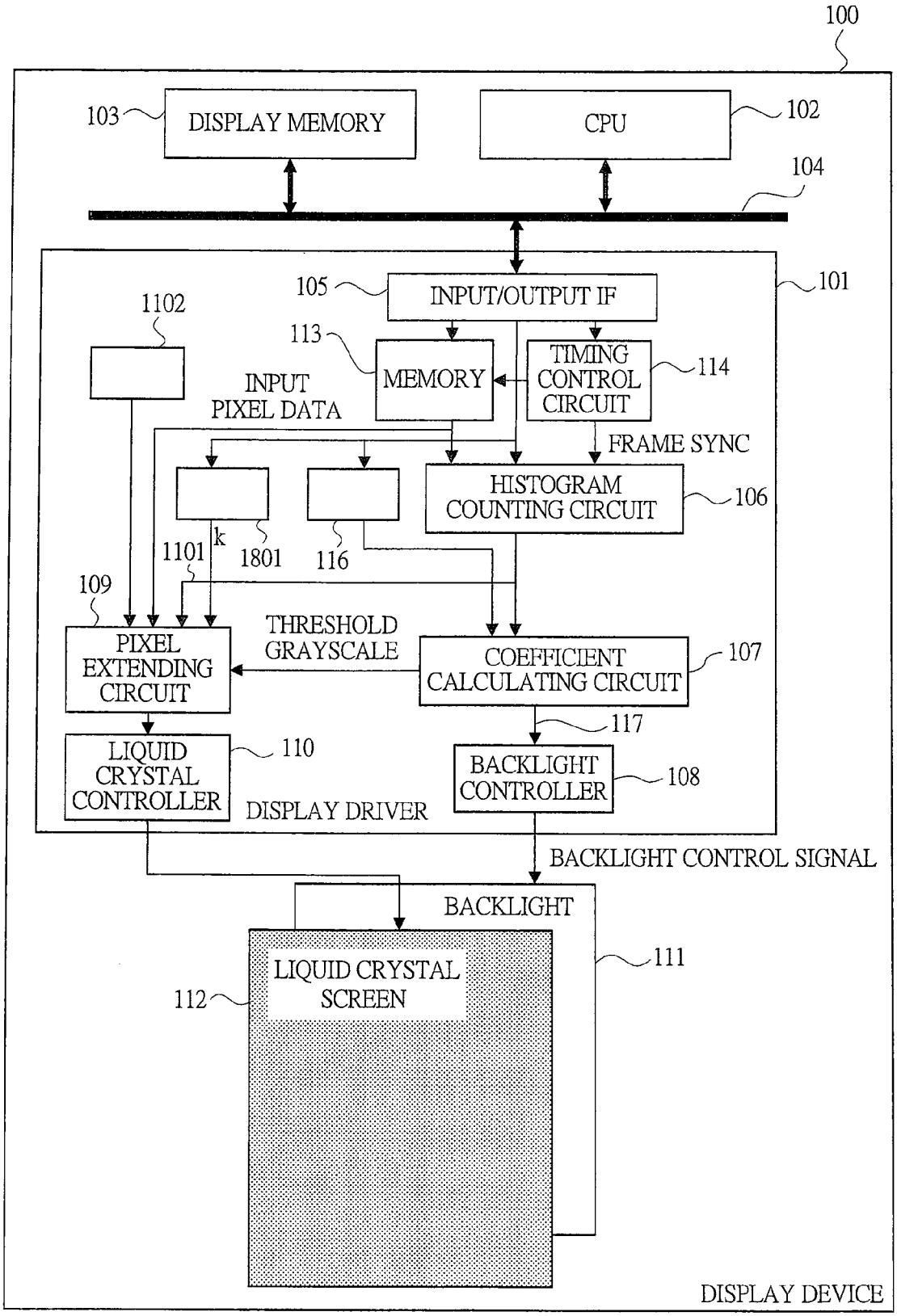
FIG. 2 is a block diagram of a display device according to the first embodiment of the present invention.

FIG. 2 is a block diagram of the display device according to the first embodiment of the present invention.

In FIG. 2, a reference number 100 denotes a display device, and the display device 100 includes a display driver 101, a central processing unit (CPU) 102, a display memory 103, an internal bus 104, a backlight 111, and a liquid crystal screen 112.

The display driver 101 is configured by including an input/output interface circuit 105, a histogram counting circuit 106, a coefficient calculating circuit 107, a backlight controller 108, a pixel extending circuit 109, a liquid crystal controller 110, a whiteout compensation parameter setting register 1801, a threshold grayscale setting parameter setting register 116, a memory 113, a timing control circuit 114, and a pixel extending method switching register 1102. The pixel extending circuit 109 changes the operation in accordance with the value of the pixel extending method switching register 1102.

The operation of the display device of the first embodiment will be described below. When displaying data on the liquid crystal screen, the CPU 102 sets the value of the ratio k of the difference 1702 between z and t and the difference 1701 between maximum grayscale (255) and t shown in FIG. 1A to the whiteout compensation parameter setting register 1801.

Further, the value p312 of p % shown in FIG. 1B is set to the threshold grayscale setting parameter setting register 116. The display start mode is written to the display start register (not shown) in the input/output interface circuit 105, and the display data is transferred from the display memory 103 to the memory 113 through the input/output interface circuit 105. The size of the memory 13 differs depending on the system, but a system having a frame memory equivalent to one frame has become popular recently. The memory size does not affect the present embodiment, and it is obvious that the present embodiment can be implemented even by FIFO with a few bytes.

In the display start mode, the timing control circuit 114 of the display driver 101 outputs a frame SYNC signal indicating the start position of the display data, and the display data is output from the memory 113 to the histogram counting circuit 106 and the pixel extending circuit 109 in synchronization with the SYNC signal.

In the histogram counting circuit 106, the maximum value from the values of R, G, B of one pixel, that is, the RGB maximum value is extracted, and the number of pixels of each grayscale is obtained from the display data for one frame by using the RGB maximum value, thereby obtaining the histogram. As one example, the histogram generated in the histogram counting circuit 106 corresponds to shown in FIG. 1B.

In the coefficient calculating circuit 107, the sum of the number of pixels from the highest grayscale (255 grayscale) to each grayscale is obtained. By using the value p312 of p % shown in FIG. 1B and stored in the threshold grayscale setting parameter setting register 116, the threshold grayscale t301 is determined and is output to the pixel extending circuit 109. Also, the backlight luminance value 117 is output to the backlight controller 108 from the threshold grayscale t301 by using the equation 6.

When the pixel extending method switching register is set to a value "0", the data conversion (extension) shown in FIG. 1 is performed in the pixel extending circuit 109. In the pixel extending circuit 109, by using the value of k set in the whiteout compensation parameter setting register 1801 and the threshold grayscale t301 provided from the coefficient calculating circuit 107, the grayscale is extended in accordance with the equation 2 when the grayscale of the display data transferred from the memory 113 is equal to or lower than the grayscale z, and the grayscale is extended in accordance with the equation 5 when the grayscale of the display data transferred from the memory 113 is equal to or higher than the grayscale z+1, and then, the extended data is transferred to the liquid crystal controller 110.

The liquid crystal controller 110 converts a digital value provided from the pixel extending circuit 109 to an analog value for driving the liquid crystal screen 112, thereby displaying an image on the liquid crystal screen (PANEL).

Further, the backlight controller 108 converts the backlight luminance value 117 that is a digital value to a current for driving the backlight, thereby adjusting the luminance of the backlight 111.

By the operation as described above, the display device of the present embodiment can realize the conversion shown in FIG. 1 and can display an image while maintaining the contrast without degrading the image quality for the display grayscale equal to or lower than the specific grayscale z and without causing the whiteout for the display grayscale equal to or higher than the specific grayscale z. Further, the backlight luminance can be lowered from 1707 to 1708.

In the present embodiment, k is defined as a ratio of the difference 1702 between a certain grayscale value z and the threshold grayscale t and the difference 1701 between the maximum grayscale (255) and t, but it may be defined as a ratio of the grayscale z and the grayscale t or a ratio of the difference between threshold grayscale t and the maximum grayscale (255) and the difference between a certain grayscale value z and the maximum grayscale (255).

Further, it may be defined as a ratio of the difference between threshold grayscale t and the maximum grayscale (255) and 1704. Although various parameters can be used for determining a certain grayscale value z, any parameter can be used as long as it does not deviate from the scope of the present invention.

Next, when the pixel extension method switching register is set to a value "1", in the pixel extending circuit 109, the grayscale is extended in accordance with the equation 2 when the grayscale of the display data transferred from the memory 113 is equal to or lower than the grayscale z, thereby performing the data conversion (extension) as shown in FIG. 1. When the grayscale of the display data transferred form the memory 113 is equal to or higher than the grayscale z+1, the grayscale is extended in accordance with the linear function 1709, thereby performing the data conversion (extension) as shown in FIG. 1. The linear function 1709 is expressed as the equation 7.

$$y = \frac{255 - t}{255 - z}x + \frac{255(t - z)}{255 - z} \qquad \text{Equation 7}$$

Second Embodiment

Figure 3A:
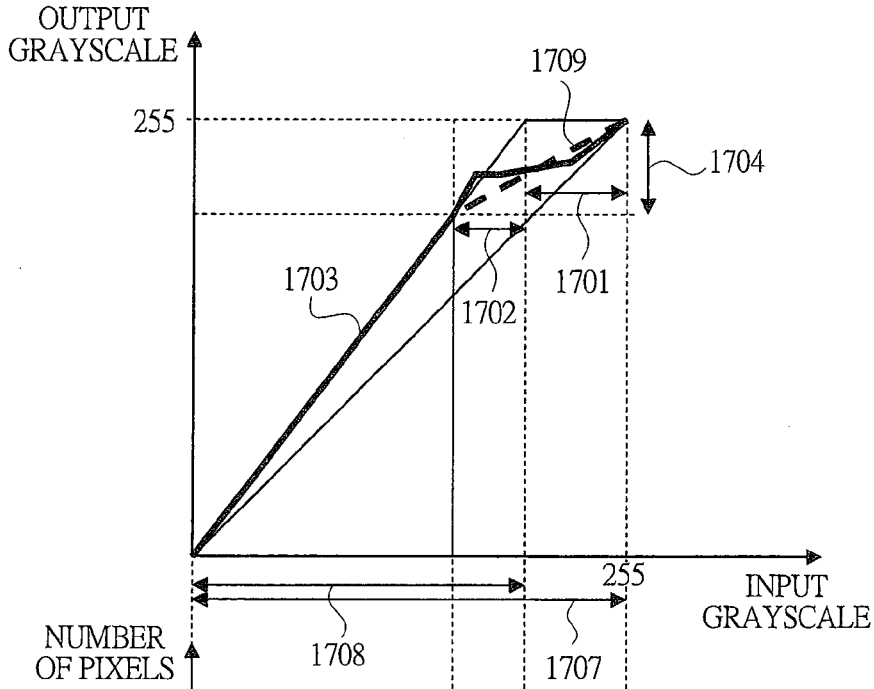
FIG. 3A is a view for describing an outline of an image grayscale extending process of a display device according to a second embodiment of the present invention.
Figure 3B:
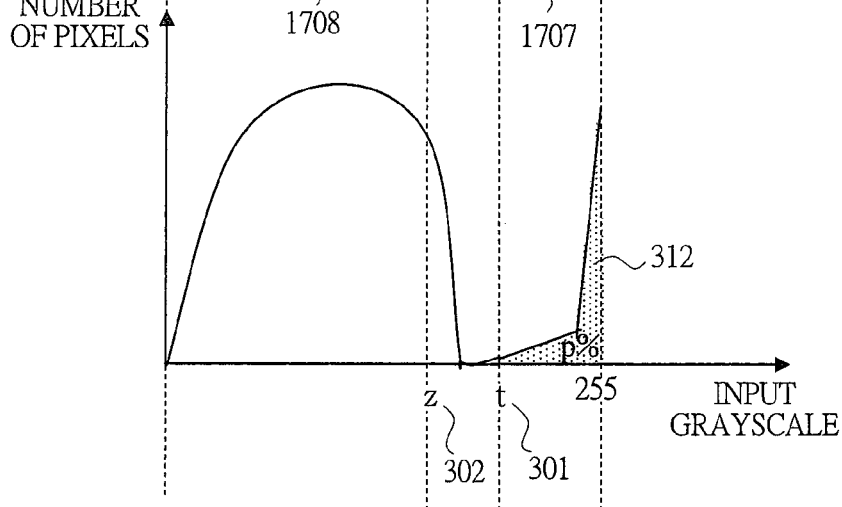
FIG. 3B is a view for describing an outline of the image grayscale extending process of the display device according to the second embodiment of the present invention.
Figure 3C:
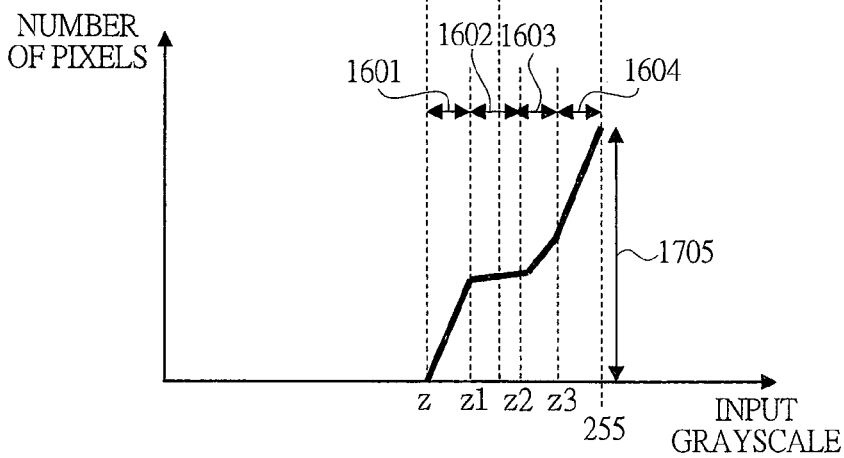
FIG. 3C is a view for describing an outline of the image grayscale extending process of the display device according to the second embodiment of the present invention.

Next, a display device according to a second embodiment of the present invention will be described with reference to FIG. 3. In the first embodiment, a counter for each grayscale equal to or higher than the grayscale z is required and the circuit scale is large. The second embodiment is basically the same as the first embodiment, but a method capable of achieving the reduction in circuit scale will be described. FIG. 3B is the same as FIG. 1B and is a view showing a histogram of a display image.

In the present embodiment, the portion between the grayscale z and the maximum grayscale 255 is divided into four equal intervals 1601, 1602, 1603, and 1604. The boundary of 1601 and 1602 is z1, the boundary of 1602 and 1603 is z2, and the boundary of 1603 and 1604 is z3. The cumulative value N1 of the histogram from the grayscale z+1 to the grayscale z1, the cumulative value N2 of the histogram from the grayscale z+1 to the grayscale z2, the cumulative value N3 of the histogram from the grayscale z+1 to the grayscale z3, and the cumulative value of the histogram from the grayscale z+1 to the grayscale 255 are counted by using four counters. N1, N2, and N3 are expressed as the equation 8.

$$\begin{cases} N1 = \sum_{s=z+1}^{z1} F(s) \\ N2 = \sum_{s=z+1}^{z2} F(s) \\ N3 = \sum_{s=z+1}^{z3} F(s) \end{cases} \qquad \text{Equation 8}$$

In the pixel extending circuit 109, the conversion is performed by using a function (equation 9) complemented with these three points.

$$y = \begin{cases} \dfrac{\sum_{s=z+1}^{z1} F(s)}{\sum_{s=z+1}^{255} F(s)} \cdot \dfrac{\alpha ka}{z1 - z}(x - z) + 255 - \alpha ka & (z + 1 \le x \le z1) \\ \dfrac{\sum_{s=z+1}^{z2} F(s) - \sum_{s=z+1}^{z1} F(s)}{\sum_{s=z+1}^{255} F(s)} \cdot \dfrac{\alpha ka}{z2 - z1}(x - z1) + 255 - \alpha ka + \dfrac{\sum_{s=z+1}^{z1} F(s)}{\sum_{s=z+1}^{255} F(s)} \alpha ka & (z1 + 1 \le x \le z2) \\ \dfrac{\sum_{s=z+1}^{z3} F(s) - \sum_{s=z+1}^{z2} F(s)}{\sum_{s=z+1}^{255} F(s)} \cdot \dfrac{\alpha ka}{z3 - z2}(x - z2) + 255 - \alpha ka + \dfrac{\sum_{s=z+1}^{z2} F(s)}{\sum_{s=z+1}^{255} F(s)} \alpha ka & (z2 + 1 \le x \le z3) \\ \dfrac{\sum_{s=z+1}^{255} F(s) - \sum_{s=z+1}^{z3} F(s)}{\sum_{s=z+1}^{255} F(s)} \cdot \dfrac{\alpha ka}{255 - z3}(x - z3) + 255 - \alpha ka + \dfrac{\sum_{s=z+1}^{z3} F(s)}{\sum_{s=z+1}^{255} F(s)} \alpha ka & (z3 + 1 \le x \le 255) \end{cases} \qquad \text{Equation 9}$$

By the operation as described above, the display can be stably performed even if the distribution of the histogram of than the grayscale z+1 or higher changes significantly in each frame. In the present embodiment, the histogram is generated by using the largest one of the three sub-pixels R, G, B, but the method of generating the histogram does not affect the patentability, and the histogram may be generated by using all the values of R, G and B.

In this manner, the circuit required for generating the histogram of the grayscale z or higher can be configured of only four counters, and the circuit size can be significantly reduced.

Here, the portion between the grayscale z and the maximum grayscale 255 is divided into four portions to be counted, but it is obvious that the same configuration can be achieved even if the number of divisions is changed and the number does not affect the patentability of the present invention. Further, although the portion is divided equally, it is obvious that similar configuration can be obtained even if it is divided unequally.

Third Embodiment

Figure 4:
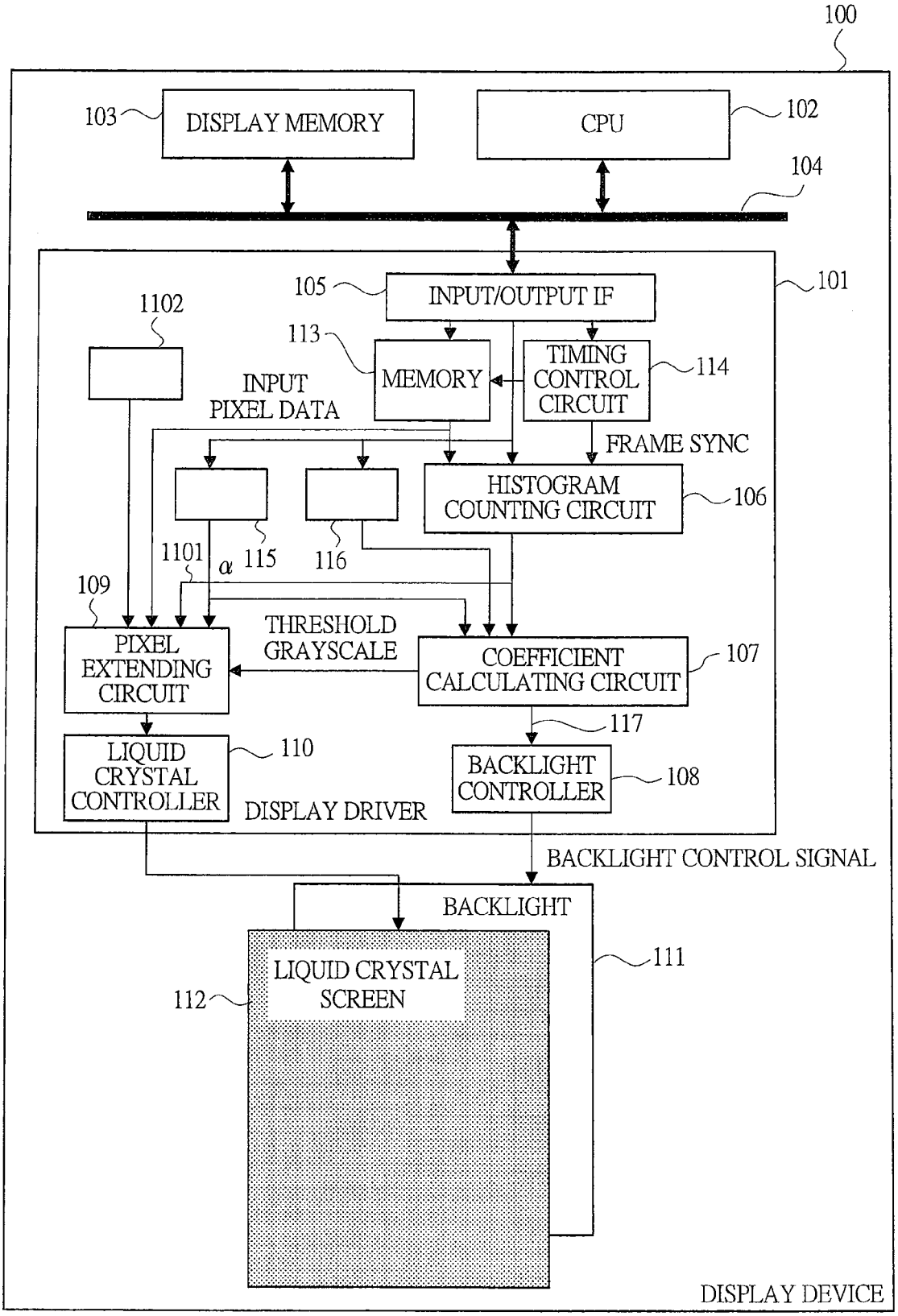
FIG. 4 is a block diagram of a display device according to a third embodiment of the present invention.

Next, a display device according to a third embodiment of the present invention will be described with reference to FIG. 4 to FIG. 7. FIG. 4 is a block diagram of the display device according to the third embodiment of the present invention. The third embodiment is substantially the same as the first embodiment, but differs in the extension arithmetic operation of the grayscale performed in the pixel extending circuit 109.

Figure 5A:
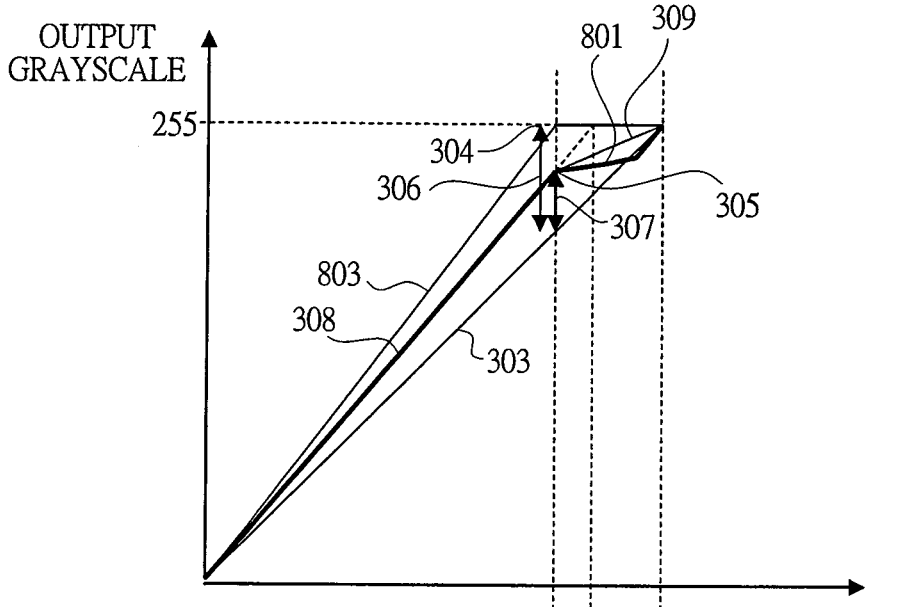
FIG. 5A is a view for describing an a determining method of the display device according to the third embodiment of the present invention.
Figure 5B:
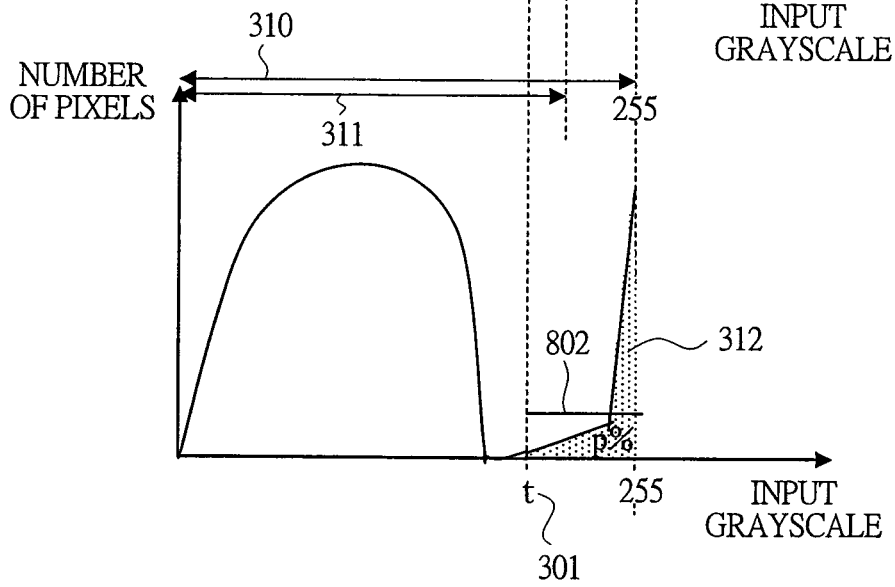
FIG. 5B is a view for describing an a determining method of the display device according to the third embodiment of the present invention.

FIG. 5B is a view showing a histogram of a display image. As shown in FIG. 5B, in the display image, the t grayscale 301 at which the number of pixels having the grayscale values of the t grayscale 301 or higher and the maximum grayscale (255 grayscale) or lower is p % 312 of the total number of pixels is referred to as the threshold grayscale 301, and a point (t, z) 305 between the coordinate (t, maximum grayscale (255)) and the coordinate (t, t) on FIG. 5A will be considered.

In the present embodiment, when the grayscale value of the pixel of the display image is equal to or lower than the threshold grayscale 301, the pixel of the display image is converted by the first linear function 308 connecting the coordinates (0, 0) and (t, z). The first linear function is expressed as the equation 10.

$$y = \frac{z}{t}X \qquad \text{Equation 10}$$

Here, when the ratio of the difference 307 between z and t and the difference 306 between the maximum grayscale (255) and t is defined as α, the equation 10 is replaced with the equation 11.

$$y = \left(1 + \frac{(\text{Maximum grayscale}(255) - t)\alpha}{t}\right)x \qquad \text{Equation 11}$$

When the grayscale value of the pixel of the display image is equal to or higher than the threshold grayscale t301, the nonlinear arithmetic operation corresponding to the number of pixels of the histogram of the threshold grayscale t301 or higher is performed. Hereinafter, the nonlinear arithmetic operation will be described.

As shown in FIG. 5, the average value 802 of the number of pixels with respect to the grayscale of the threshold grayscale t301 or higher is calculated, and when the number of pixels is v times the average value, the conversion in which the v grayscale is assigned to the relevant grayscale is performed. The conversion method described above is generally referred to as histogram equalization.

In the present embodiment, since there is the difference between an input grayscale width and an output grayscale width such as 255-t and 255-z, the grayscale indicated in the equation 12 is assigned to the grayscale where the number of pixels of the histogram is v times the average value.

$$v\frac{255 - z}{255 - t} \qquad \text{Equation 12}$$

Further, the description will be made with reference to FIG. 6. For example, in FIG. 6, the threshold grayscale t301 is assumed to be 241 grayscales. In addition, α402 is assumed to be set to 0.5. At this time, the value of z is 249.

Figure 6A:
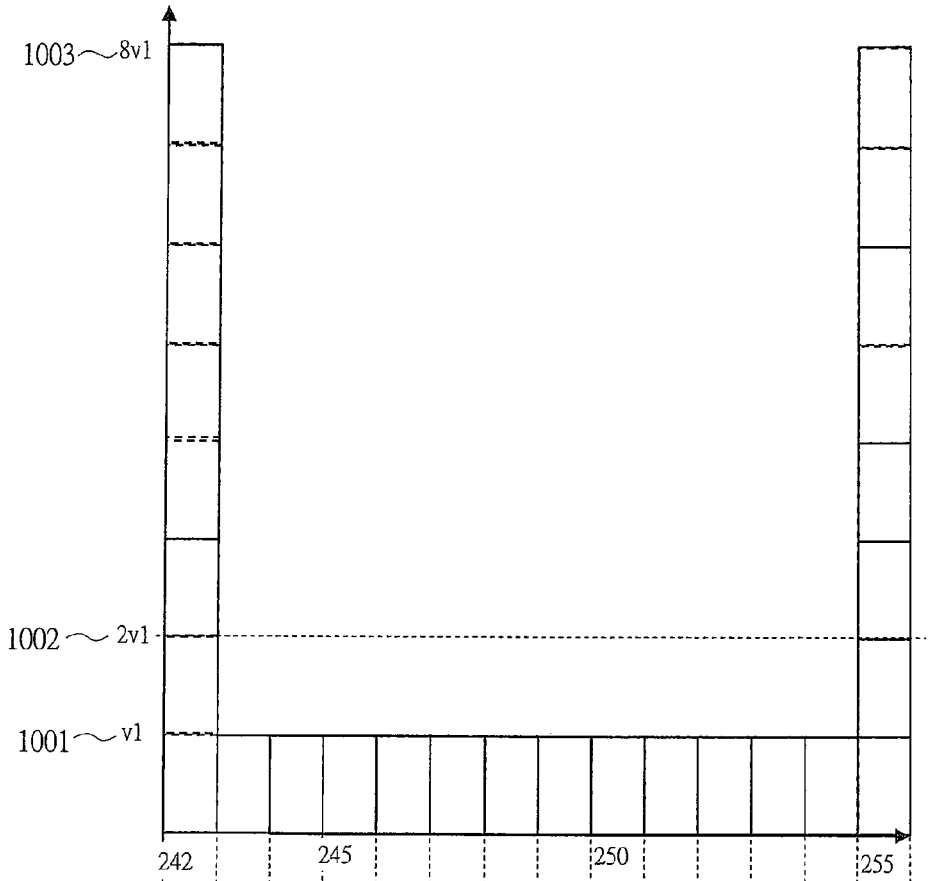
FIG. 6A is a view for describing a conversion method for the threshold grayscale or higher of the display device according to the third embodiment of the present invention.
Figure 6B:
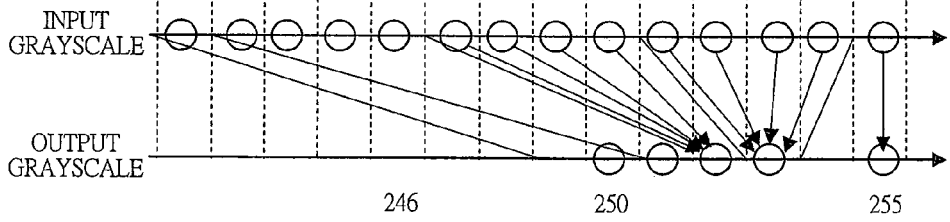
FIG. 6B is a view for describing a conversion method for the threshold grayscale or higher of the display device according to the third embodiment of the present invention.

As shown in FIG. 6, when the number of pixels of the histogram from the grayscale 243 to the grayscale 254 is v1 and the number of pixels of the histogram of the grayscale 242 and the grayscale 255 is eight times as large as v1, that is, 8v1, the average value for each grayscale of the histogram is twice as large as v1, that is, 2v1. Since α is 0.5, the seven grayscales (grayscale 249 to grayscale 255) which is 1−α=0.5 times the 14 grayscales of the input grayscales (grayscale 242 to grayscale 255) are assigned as the output grayscales.

Further, since the number of pixels of the histogram of the grayscale 242 is 8×v1 and the average is 2×v1, the number of pixels of the histogram of the grayscale 242 is four times as large as the average. Therefore, four times×0.5 times=2 grayscales are assigned to the grayscale 242. Since the number of pixels of the histogram from the grayscale 243 to the grayscale 254 is ½ times the average, ½×0.5=¼ grayscale is assigned.

Figure 6C:
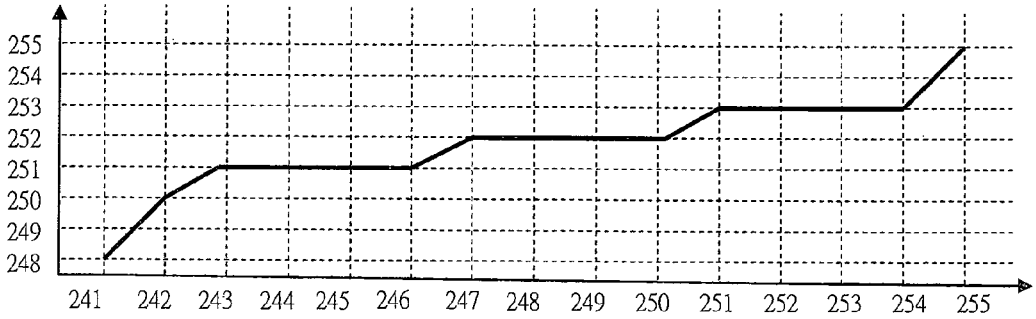
FIG. 6C is a view for describing a conversion method for the threshold grayscale or higher of the display device according to the third embodiment of the present invention.

Therefore, the grayscale 243 to the grayscale 246 are assigned to the grayscale 251 of the output, the grayscale 247 to the grayscale 250 are assigned to the grayscale 252 of the output, and the grayscale 251 to the grayscale 254 are assigned to the grayscale 253 of the output. Since the number of pixels of the histogram of the grayscale 255 is 8×v1, the input/output conversion characteristics as shown in FIG. 6C is obtained.

In FIG. 4, the histogram of the threshold grayscale value or larger is output from the histogram counting circuit 106 to the pixel extending circuit 109 through a signal line 1101, and the correspondence of conversion of equal to or larger than the threshold grayscale value is calculated in a circuit (not shown) in the pixel extending circuit.

By the conversion as described above, at the grayscale equal to or higher than the threshold grayscale t301 where the contrast is lowered, the contrast can be enhanced and the conversion can be preformed with more preferable image quality.

Further, the register 1102 is a register for switching the data conversion (extension) method in the threshold grayscale value or more. When the register 1102 is "0", the pixel extending circuit 109 converts the data with the histogram equalization method described above. When the register 1102 is "1" and if the grayscale value of the pixel of the display image is equal to or lower than the threshold grayscale t301, the pixel of the display image is converted with the first linear function 308 connecting the coordinates (0, 0) and (t, z).

The first linear function is expressed as the equation 10. When the grayscale value of the pixel of the display image is equal to or higher than the threshold grayscale t301, the pixel of the display image is converted with a second linear function 309 connecting the coordinates (t, z) and (maximum grayscale (255), maximum grayscale (255)). The second linear function is expressed as the equation 13.

$$y = \frac{\text{Maximum grayscale}(255) - z}{\text{Maximum grayscale}(255) - t}x + z - \frac{\text{Maximum grayscale}(255) - z}{\text{Maximum grayscale}(255) - t}t \qquad \text{Equation 13}$$

By the conversion as described above, compared to the conventional conversion method in which the pixels of the display image are converted by a third linear function 803 connecting the coordinates (0, 0) and (t, maximum grayscale (255)) when the grayscale value of the pixel of the display image is equal to or lower than the threshold grayscale t301, and all the grayscales equal to or higher than the threshold grayscale t301 are converted to the maximum grayscale (255), the whiteout can be prevented. The third linear function is expressed as the equation 14.

$$y = \frac{\text{Maximum grayscale}(255)}{t}x \qquad \text{Equation 14}$$

Here, if the ratio of the difference 307 between z and t and the difference 306 between the maximum grayscale (255) and t is set as α, the equations 10 and 13 can be replaced with the equations 11 and 15.

$$y=(1-\alpha)x+\text{Maximum grayscale }(255)\alpha \qquad \text{Equation 15}$$

In both cases where the value of the register 1102 is "0" and "1", if the luminance of the backlight when image extension process is not performed is set as luminance 310 that realizes the luminance of the maximum grayscale (255), and it can be lowered to luminance 311 that realizes the luminance of the grayscale in which the linear function 308 reaches the maximum grayscale (255).

Here, if the luminance 310 is defined as B, the luminance 311 is expressed as the equation 16.

$$y = \frac{1}{1 + \frac{(255-t)\alpha}{t}}B \qquad \text{Equation 16}$$

Further, by increasing the contrast using the first linear function, even if the luminance of the backlight is lowered, the image quality equal to the original display image can be maintained in the grayscales equal to or lower than the threshold grayscale. Also, when the value of the register 1102 is "0", the preferable image quality having no whiteout can be displayed even in the grayscales equal to or higher than the threshold grayscale.

Further, when the value of the register 1102 is "1", by the operation as described above, the stable display can be performed even if the distribution of the histogram of the grayscale z+1 or higher significantly changes in each frame.

The method of implementing the histogram equalization shown in the first embodiment and the method of implementing the histogram equalization shown in the third embodiment are equal in terms of results, and either method can be used in either embodiment.

Figure 7A:
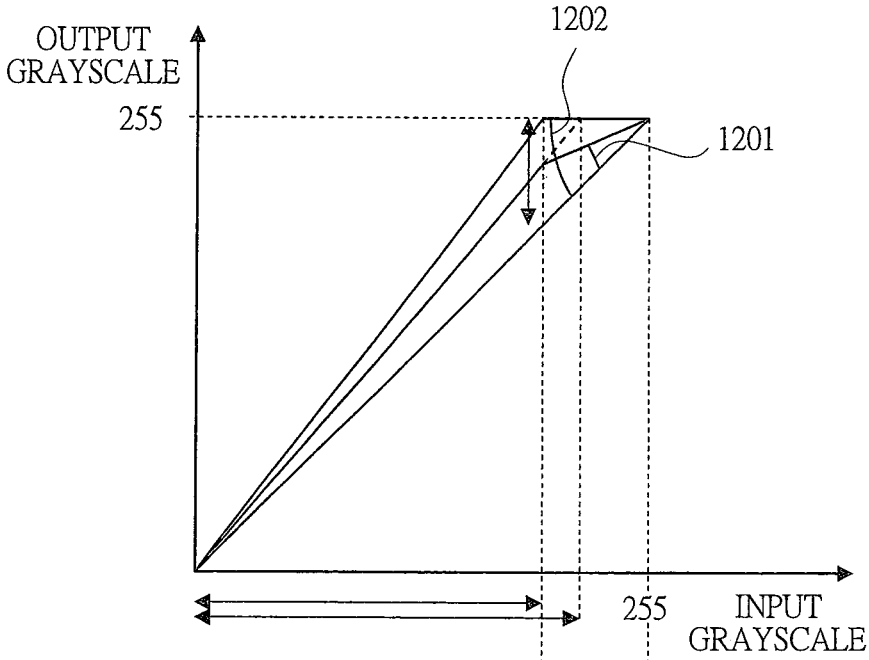
FIG. 7A is a view for describing another α determining method of the display device according to the third embodiment of the present invention.
Figure 7B:
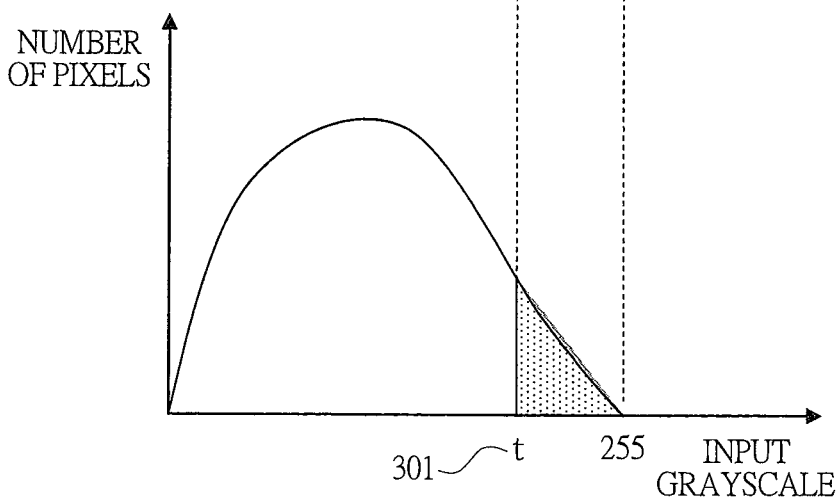
FIG. 7B is a view for describing another 60 determining method of the display device according to the third embodiment of the present invention.

In the present embodiment, α is defined as a ratio of the difference 307 between a certain grayscale value z and the threshold grayscale t and the difference 306 between the maximum grayscale (255) and t, but it may be defined as a ratio of an angle 1201 and an angle 1202 as shown in FIG. 7. Also in this case, similar implementation is possible.

Fourth Embodiment

Figure 8:
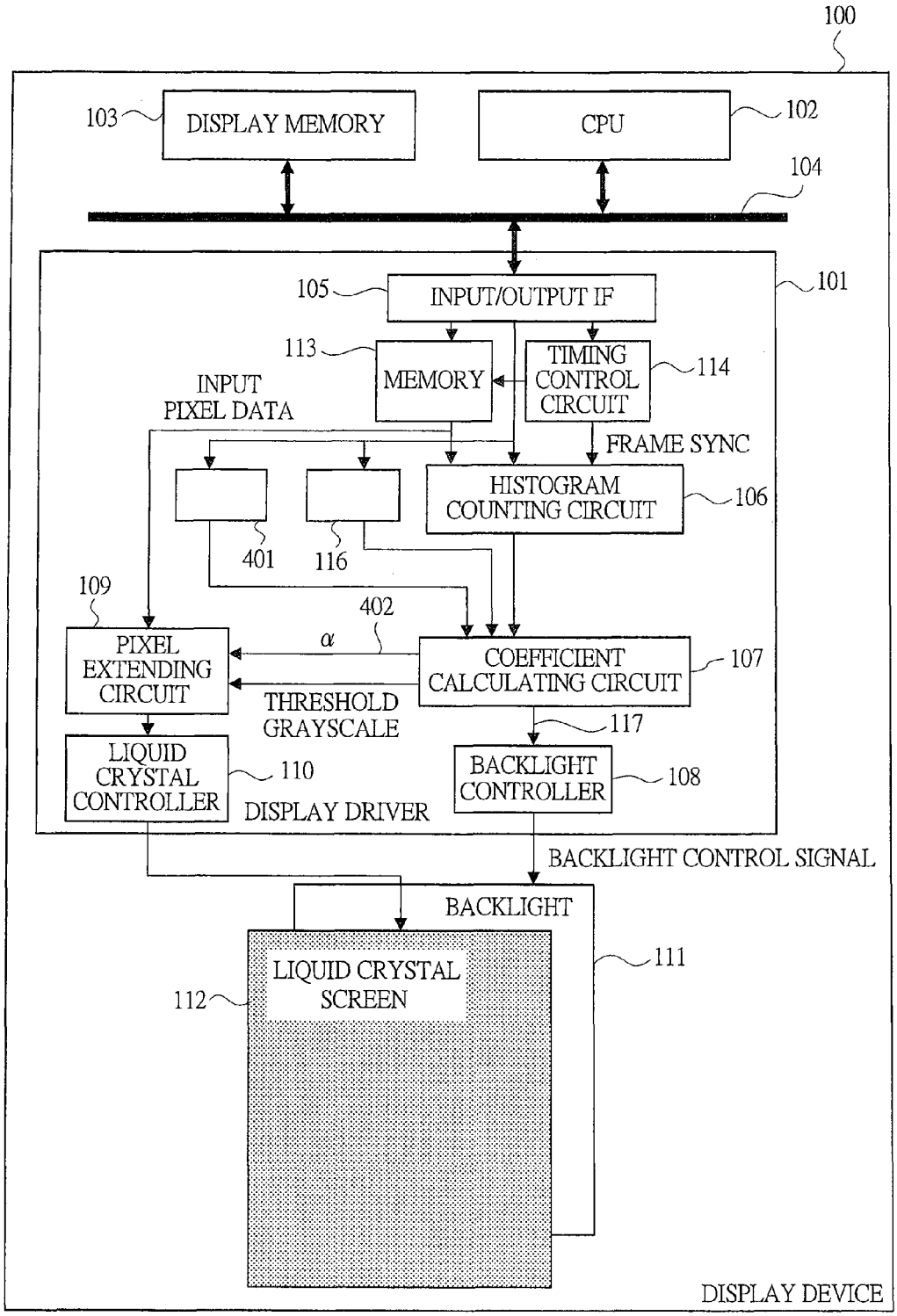
FIG. 8 is a block diagram of a display device according to a fourth embodiment of the present invention.

Next, a display device according to a fourth embodiment of the present invention will be described with reference to FIG. 8 and FIG. 9. FIG. 8 is a block diagram of the display device according to the fourth embodiment of the present invention. Compared to the third embodiment, the fourth embodiment differs from the third embodiment in that a threshold grayscale lower limit value setting register 401 for setting a lower limit value of the threshold grayscale t301 is provided, and the CPU 102 does not directly set α. However, the fourth embodiment is similar to the third embodiment in other aspects.

Even in the display image having a histogram concentrated on dark grayscales, if the extension rate is much increased (slope of the linear function 306 is made steep), the difference of the grayscales becomes obvious, and the image quality degrades. Therefore, in the present embodiment, a lower limit value t1 501 of the threshold grayscale value tr503 is set so that the extension rate becomes equal to or lower than a predetermined value even if the display image has a histogram concentrated on the dark grayscales.

Figure 9A:
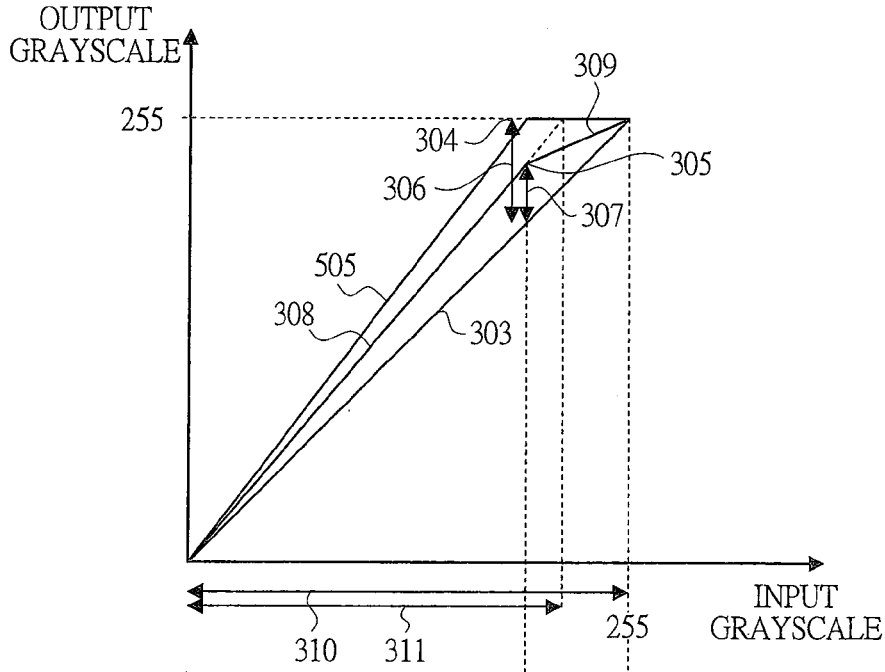
FIG. 9A is a view for describing an α determining method of the display device according to the fourth embodiment of the present invention.
Figure 9B:
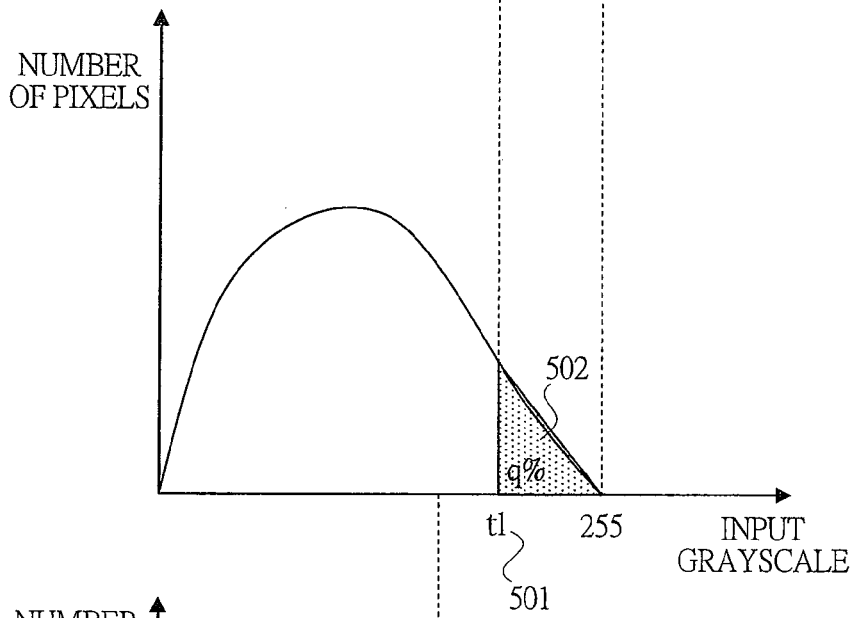
FIG. 9B is a view for describing an α determining method of the display device according to the fourth embodiment of the present invention.
Figure 9C:
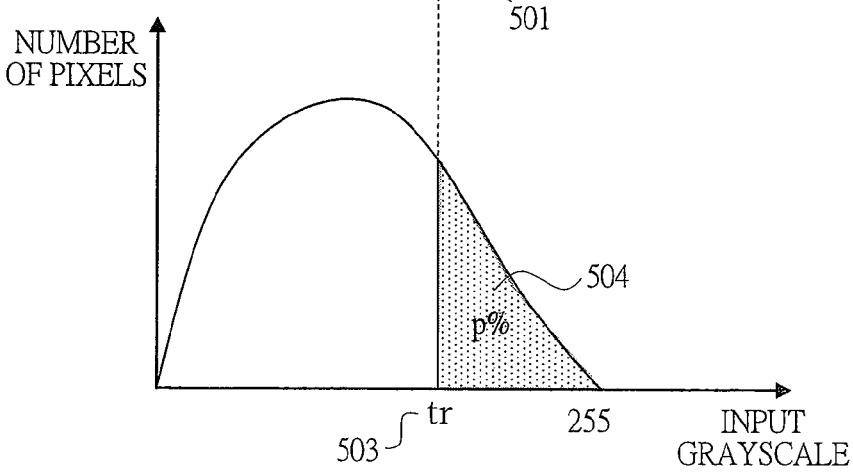
FIG. 9C is a view for describing an α determining method of the display device according to the fourth embodiment of the present invention.

As shown in FIG. 9, when the lower limit value t1 501 of the threshold grayscale t301 is higher than a grayscale value tr503 determined by using the value p302 of p %504 stored in the threshold grayscale setting parameter setting register 116, α402 is determined with the equation 17 in the coefficient calculating circuit 107 by using the actual amount of whiteout q %502.

$$\alpha = 1 - \frac{q}{2p} \qquad \text{Equation 17}$$

In this manner, when q is 0%, since there is no pixel where the whiteout occurs, the conversion is made with a straight line of 505, and the maximum contrast can be obtained. When q is p %, since α=0.5, the contrast can be obtained even at the threshold grayscale tr503. As described above, the optimum α can be automatically generated from the display image in the coefficient calculating circuit 107 with the configuration as shown in the second embodiment.

Fifth Embodiment

Figure 10:
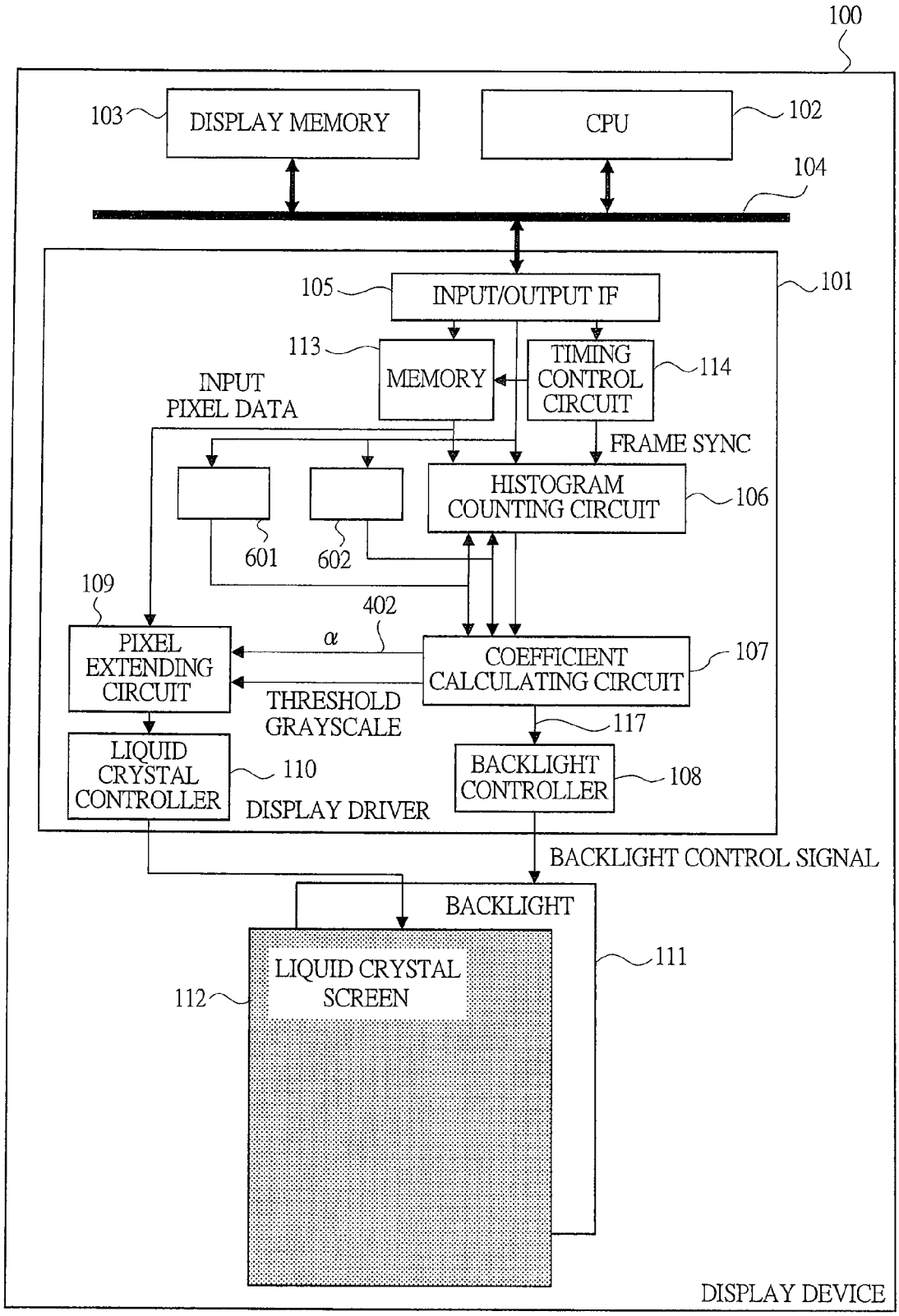
FIG. 10 is a block diagram of a display device according to a fifth embodiment of the present invention.

Next, a display device according to a fifth embodiment of the present invention will be described with reference to FIG. 10 and FIG. 11. FIG. 10 is a block diagram of the fifth embodiment of the present invention. The fifth embodiment is also the same as the third and fourth embodiments in that the conversion (extension) of the display image is performed by determining two linear functions based on α402. However, the fifth embodiment differs in the method of determining α.

Figure 11A:
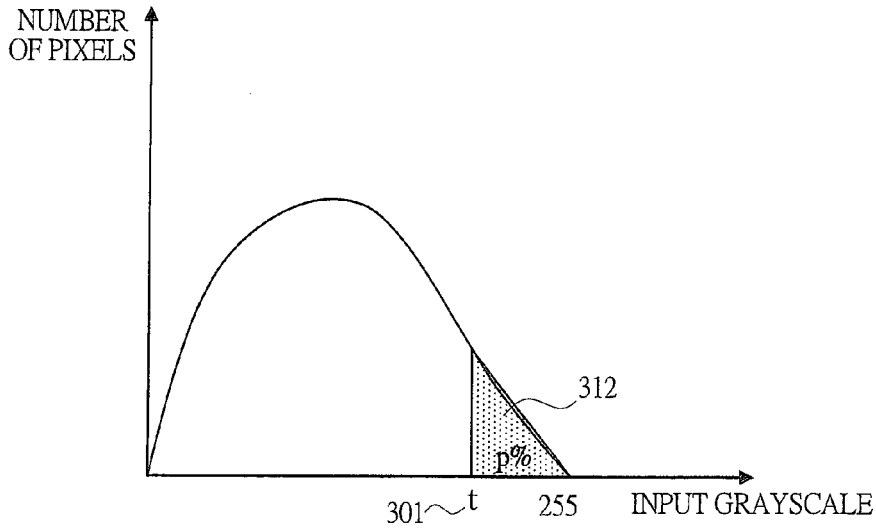
FIG. 11A is a view for describing an α determining method of the display device according to the fifth embodiment of the present invention.
Figure 11B:
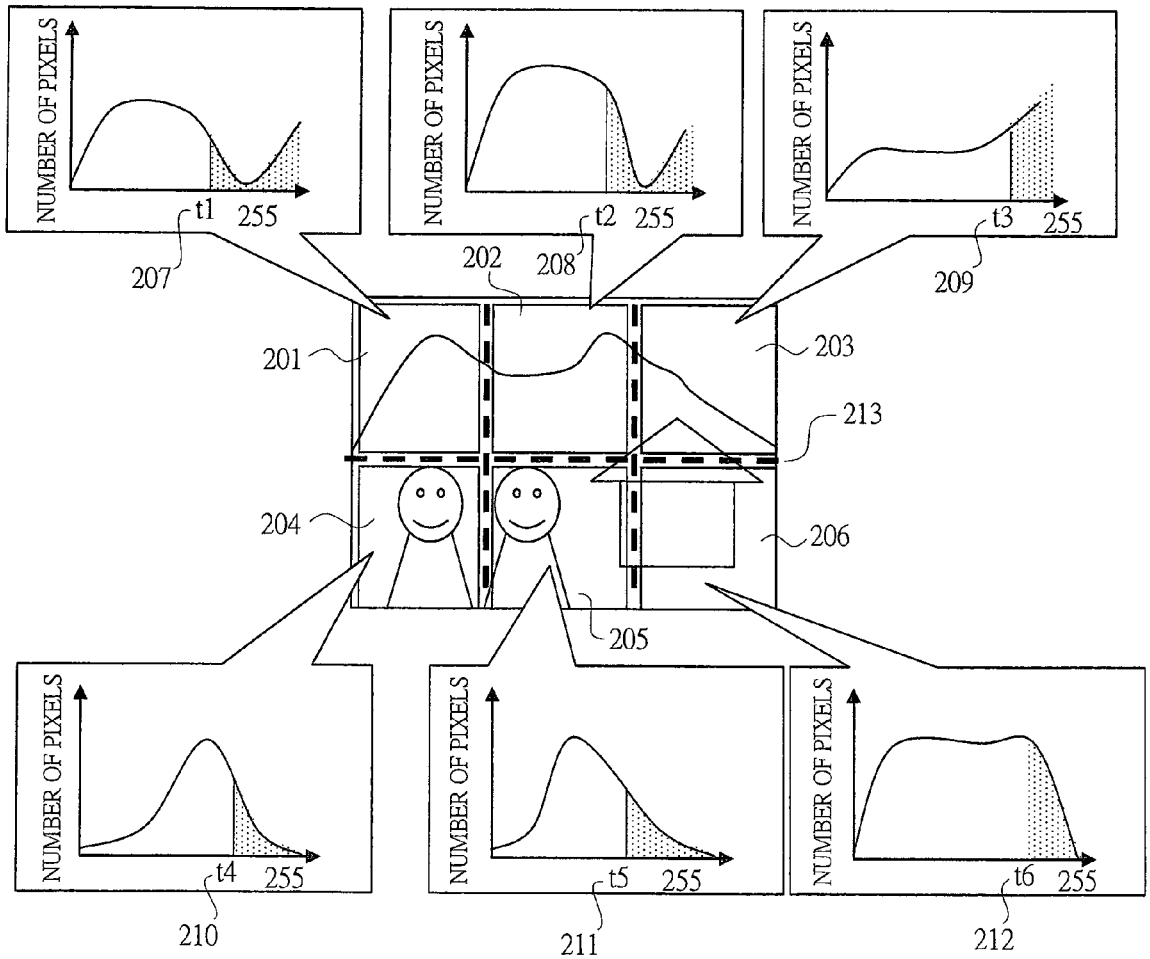
FIG. 11B is a view for describing an α determining method of the display device according to the fifth embodiment of the present invention.

In the fifth embodiment, as shown in FIG. 11, a display image 213 is divided into plural regions, a histogram is generated for each region, and the threshold grayscale at which the cumulative value from the maximum grayscale (255 grayscale) of the histogram becomes p % is calculated for each region.

In FIG. 10, registers 601 and 602 are registers for setting the number of divided regions of the display image. The histogram counting circuit 106 divides the display image in a longitudinal direction and in a lateral direction based on the dividing numbers set in the registers 601 and 602, and the histogram for each region and the histogram generated from the entire display image are created.

For example, in the example of FIG. 11, if 2 and 3 are set to the registers 601 and 602, respectively, the display image is divided into two regions in the vertical direction and three regions in the horizontal direction, and the histograms 207 to 212 of each of the regions are calculated. The coefficient calculating circuit 107 calculates the threshold grayscales t1 to t6 of each of the regions. The maximum grayscale is selected from the threshold grayscales t1 to t6 of each region, and the calculation is performed in accordance with the equation 18 by using the ratio of the threshold grayscale (for example, t3) and the threshold grayscale t301 obtained from the histogram of FIG. 11A of the entire display image without dividing the display image 213.

$$\alpha = 0.5 + \frac{\text{Threshold grayscale value obtained without region division}}{2 \times \text{maximum threshold grayscale value of each region}} \quad \text{Equation 18}$$

In this manner, when the maximum value of the threshold grayscale values of each region is sufficiently large compared to the threshold grayscale t301 obtained from the histogram of FIG. 11A of the entire display image, high grayscale portion is concentrated at a certain region, and a becomes small by the equation 18. Therefore, contrast can be obtained even in the concentrated high grayscale region and the whiteout is eliminated.

When the maximum value of the threshold grayscale values of each region is equal to the threshold grayscale t301 obtained from the histogram (FIG. 11A)) of the entire display image, α is 0.75 from the equation 18. Therefore, the contrast can be sufficiently obtained in the threshold grayscale t301 or lower.

As described above, the optimum a can be automatically generated in the coefficient calculating circuit 107 from the display image by the configuration of the present embodiment.

Sixth Embodiment

Figure 12:
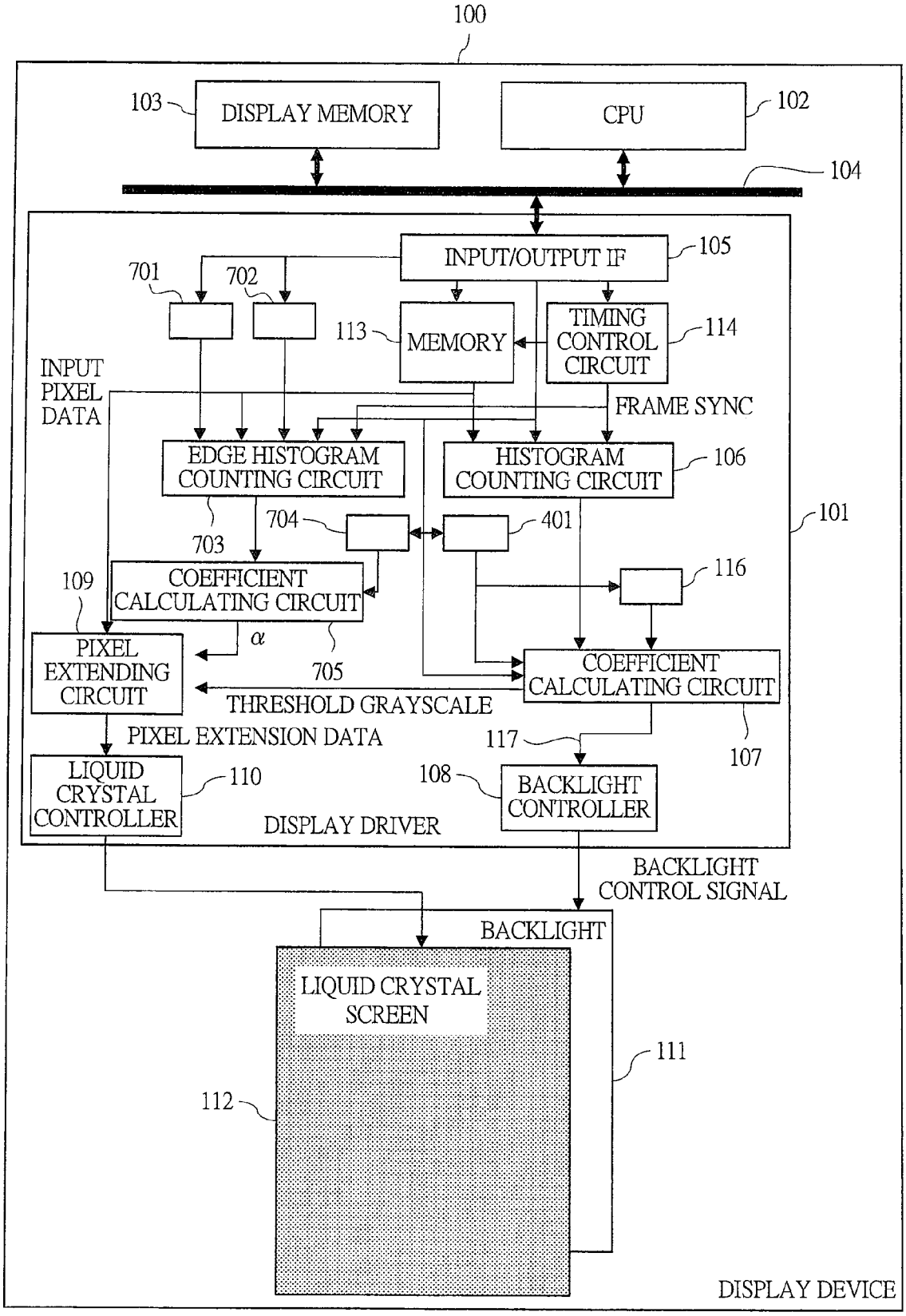
FIG. 12 is a block diagram of a display device according to a sixth embodiment of the present invention.

Next, a display device according to a sixth embodiment of the present invention will be described with reference to FIG. 12 and FIG. 13. FIG. 12 is a block diagram of the display device according to the sixth embodiment of the present invention. The sixth embodiment is also the same as the third to fifth embodiments in that the conversion (extension) of the display image is performed by determining two linear functions based on α402. However, the sixth embodiment differs in the method of determining α.

Figure 13:
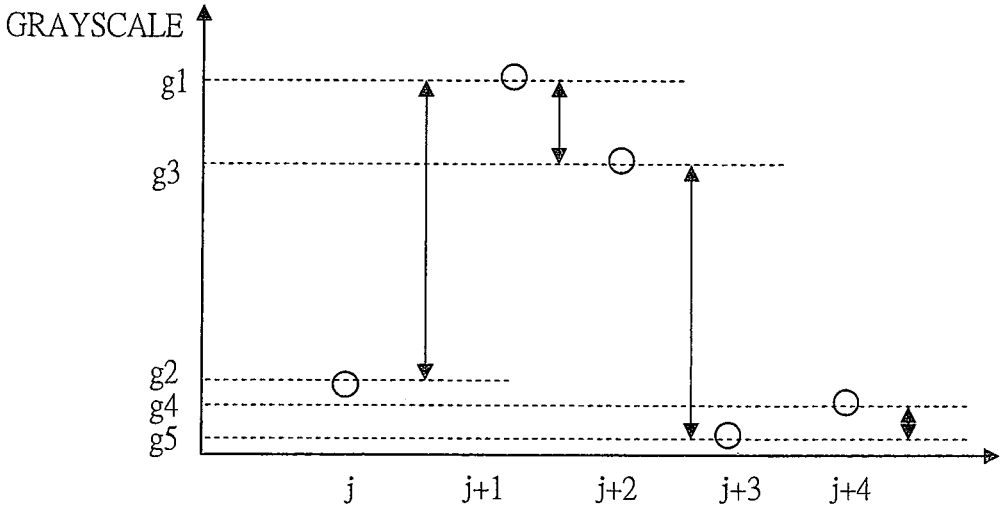
FIG. 13 is a view for describing a width of an edge for performing count of the display device according to the sixth embodiment of the present invention.

In FIG. 13, the horizontal axis represents the position of the pixel in the horizontal direction of a certain row of the display image. The vertical axis represents the grayscale value of each pixel.

Also in the present embodiment, similar to the fourth embodiment, the threshold grayscale setting parameter setting register 116 for setting the value p302 of p % determining the threshold grayscale t301 from the histogram and the threshold grayscale value lower limit value setting register 401 for setting the lower limit value of the threshold grayscale t301 are provided.

The register 701 is an edge minimum value setting register which defines a minimum value of the difference in grayscales to be counted when counting the edge histogram, and the register 702 is an edge maximum value setting register which defines a maximum value of the difference in grayscales to be counted when counting the edge histogram.

For example, when the total number of grayscales is 255, 8 is set in the edge minimum value setting register 701 in order to realize the difference of 8 or more grayscales where the human eyes can recognize the difference. The setting value of the edge minimum value setting register is Emin. A value such as 2×(255-t) where the whiteout cannot be observed even if the maximum whiteout occurs is set in the edge maximum value setting register 702.

The setting value of the edge maximum value setting register is Emax. Here, if the grayscales of the positions j and j+1 are g1 and g2, when g1-g2>Emax, the edge histogram counting circuit is not counted up. In the positions j+1 and j+2, when Emax≥g1-g3≥Emin, a histogram counter (not shown) corresponding to the higher grayscale g1 in the edge histogram counting circuit 703 is counted up by one.

When g3-g5>Emax, the edge histogram counting circuit 703 is not counted up. When g4-g5≤Emin, the edge histogram counting circuit 703 is not counted up. In this manner, the edge histogram counting circuit 703 counts the second histogram based on the edge information.

The register 704 is an edge histogram threshold grayscale setting parameter setting register which sets the value of pe % for determining the edge histogram threshold grayscale te from the edge histogram counted in the edge histogram counting circuit 703. Pe is referred to the edge histogram threshold grayscale setting parameter. When the cumulative value of the histogram from the maximum grayscale to a certain grayscale of the edge histogram counting circuit 703 is calculated in the coefficient calculating circuit 705 and the accumulate value is the pe % of the total number of pixels, the grayscale value thereof is referred to as edge threshold grayscale, and α402 is calculated by using the equation 19.

$$\alpha = 1 - \frac{\text{Edge threshold grayscale value} - \text{Threshold grayscale value}}{\text{Maximum grayscale(255)} - \text{Threshold grayscale value}} \quad \text{Equation 19}$$

Alternatively, the region may be divided in the same manner as the fifth embodiment and the edge histogram for each region may be calculated. Also in this case, the calculation is performed by selecting the maximum threshold value of each of the divided regions is selected and set as the edge threshold grayscale value, whereby the similar calculation can be implemented. In this case, by dividing the region thinly, the edge detection sensitivity is enhanced, and more preferable image quality can be achieved.

The method of automatically setting α of the third embodiment according to the fourth to sixth embodiments can be used to the case where k is determined by setting k=1-α in the first and second embodiments.

Seventh Embodiment

Figure 14:
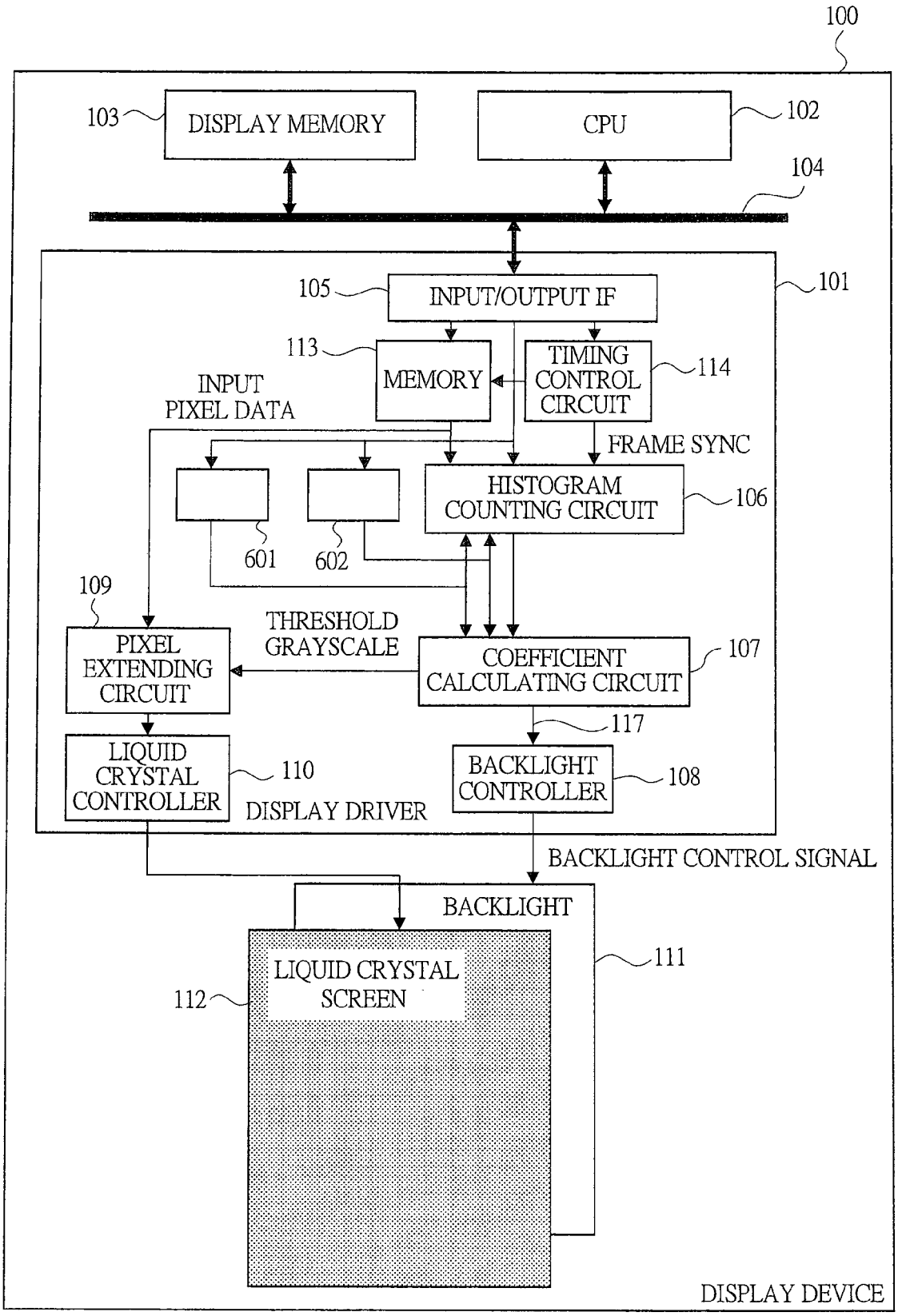
FIG. 14 is a block diagram of a display device according to a seventh embodiment of the present invention.

Next, a display device according to a seventh embodiment of the present invention will be described with reference to FIG. 14 and FIG. 15. FIG. 14 is a block diagram of the display device according to the seventh embodiment of the present invention. In the seventh embodiment, similar to the fifth embodiment, in addition to the histogram of the display image of the entire screen, the display image is divided and the histogram for each divided region is generated, and the threshold grayscale of each region and the threshold grayscale obtained from the histogram of the display image of the entire screen are calculated.

Figure 15A:
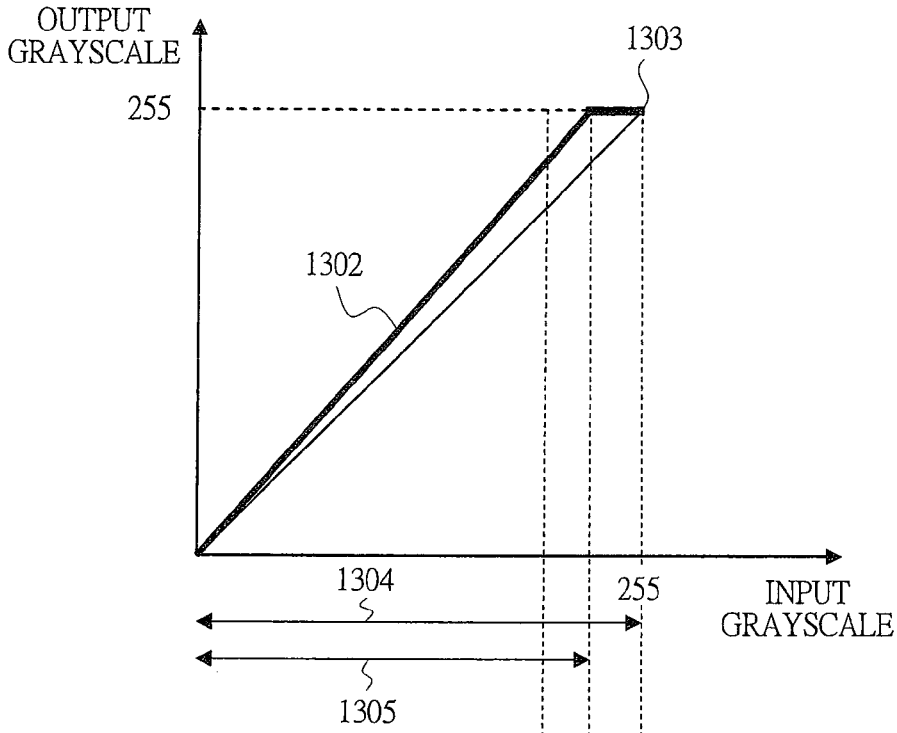
FIG. 15A is a view for describing a grayscale conversion (extending) method of the display device according to the seventh and eighth embodiments of the present invention.
Figure 15B:
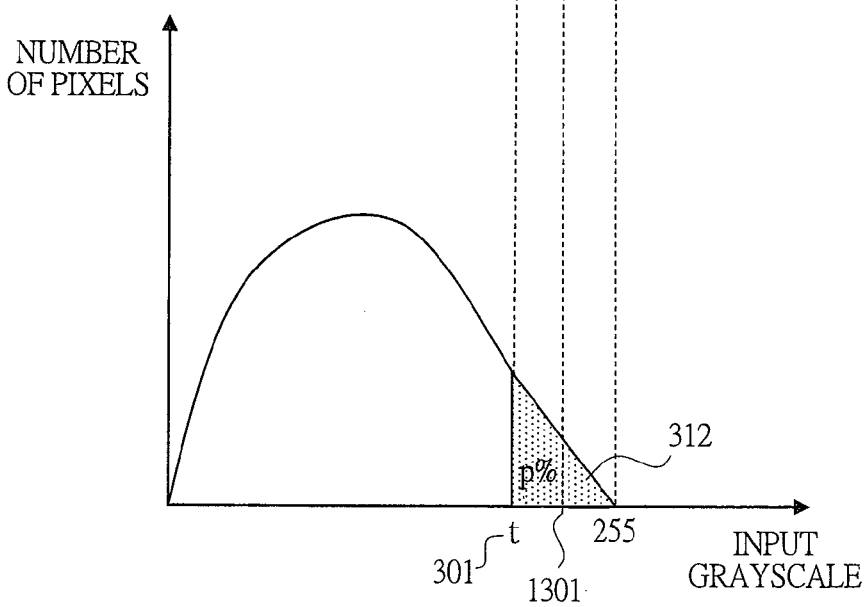
FIG. 15B is a view for describing a grayscale conversion (extending) method of the display device according to the seventh and eighth embodiments of the present invention.

However, the seventh embodiment differs from the fifth embodiment in that, as shown in FIG. 15, the threshold grayscale value Tmax, which is larger one of the largest threshold grayscale 1301 of the threshold grayscales of each region and the threshold grayscale 301 obtained from the histogram of the display image of the entire screen, is used as the threshold grayscale, and the input grayscale Tmax or lower is converted by using the linear function represented by a line connecting the coordinates (0, 0) and (Tmax, 255) and the input grayscale Tmax or higher is converted to the 255 grayscale.

Similar to the fifth embodiment, in the coefficient calculating circuit 107, in addition to the histogram of the display image of the entire screen, the display image is divided and the histogram is generated for each divided region. Then, the threshold grayscale value Tmax, which is larger one of the largest threshold grayscale 1301 of the threshold grayscales of each region and the threshold grayscale 301 obtained from the histogram of the display image of the entire screen, is used as the threshold grayscale and is output to the pixel extending circuit 109.

In the pixel extending circuit 109, conversion indicated by lines 1302 and 1303 of FIG. 15 is performed with respect to the input grayscale.

Further, the coefficient calculating circuit 107 outputs a signal 117 to the backlight controller 108 so that the luminance of the backlight becomes 1305 relative to the backlight luminance 1304 at the time of no extension. By the operation described above, the reduction rate of the backlight power is lowered, but a brighter and more preferable display can be obtained.

Eighth Embodiment

Figure 16:
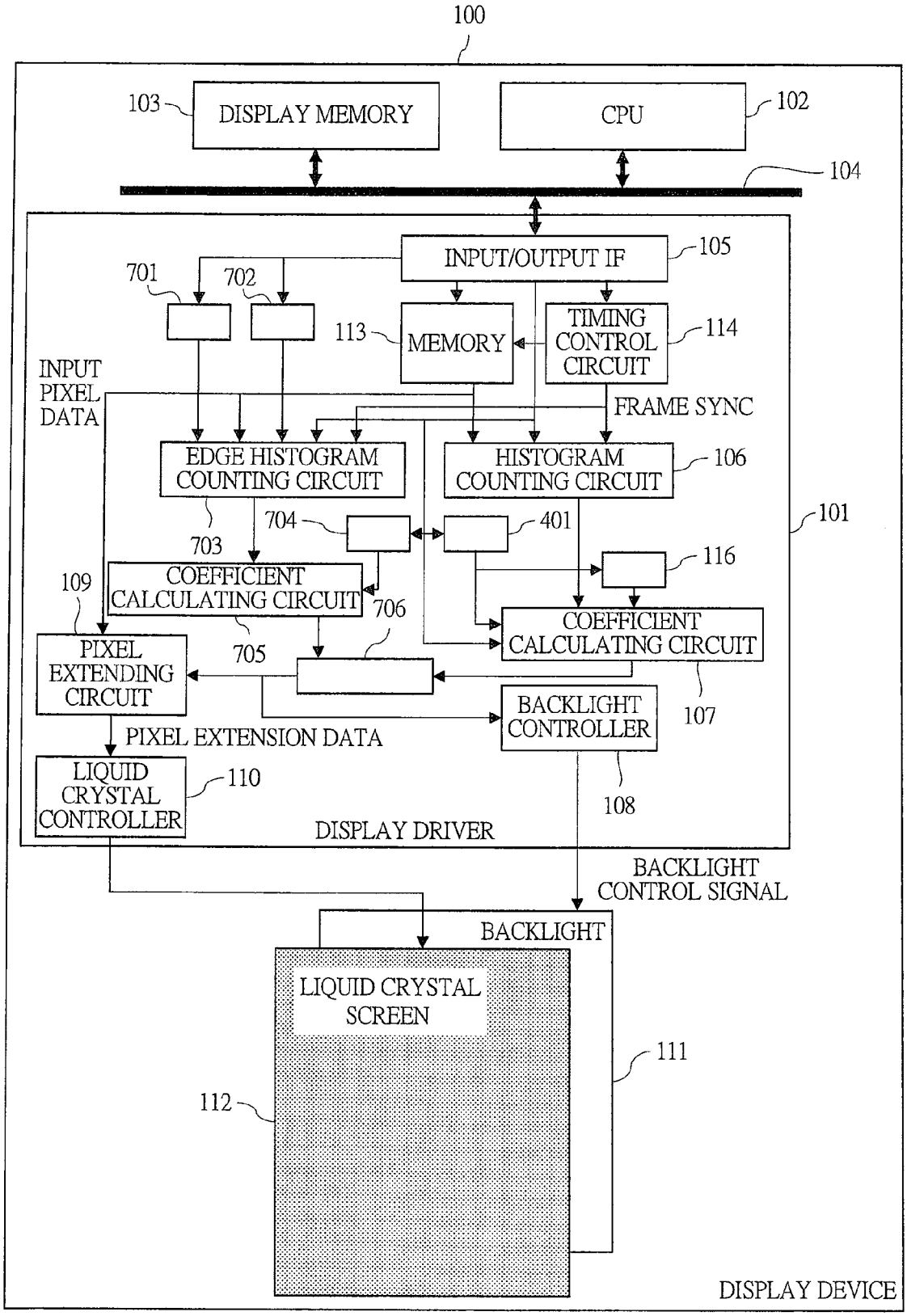
FIG. 16 is a block diagram of a display device according to an eighth embodiment of the present invention.

Next, a display device according to an eighth embodiment of the present invention will be described with reference to FIG. 15 and FIG. 16. FIG. 16 is a block diagram of the display device according to the eighth embodiment of the present invention. As shown in FIG. 15, in the eighth embodiment, assuming the threshold grayscale value is t, the input grayscale t or lower is converted by the linear function represented by a straight line connecting the coordinates (0, 0) and (t, 255), and the input grayscale t or higher is converted to the 255 grayscale.

However, the eighth embodiment differs from the seventh embodiment in that the edge histogram shown in the sixth embodiment is used instead of using the threshold grayscale of a plurality of divided regions.

As shown in FIG. 16, the coefficient calculating circuit 705 outputs the edge histogram threshold grayscale te calculated from the edge histogram and the coefficient calculating circuit 107 outputs the threshold grayscale t calculated from the histogram of the normal display screen. Then, the larger one of the edge histogram threshold grayscale te and the threshold grayscale t is selected in the comparison circuit 706 and output to the pixel extending circuit 109. In the pixel extending circuit 109, the conversion shown in FIG. 15A is performed in the same manner as the sixth embodiment.

Further, the backlight controller is controlled by the output of the comparison circuit 706.

By the operation as described above, the reduction rate of the backlight power is lowered, but a brighter and more preferable display can be obtained also in the eighth embodiment.

Ninth Embodiment

Figure 17:
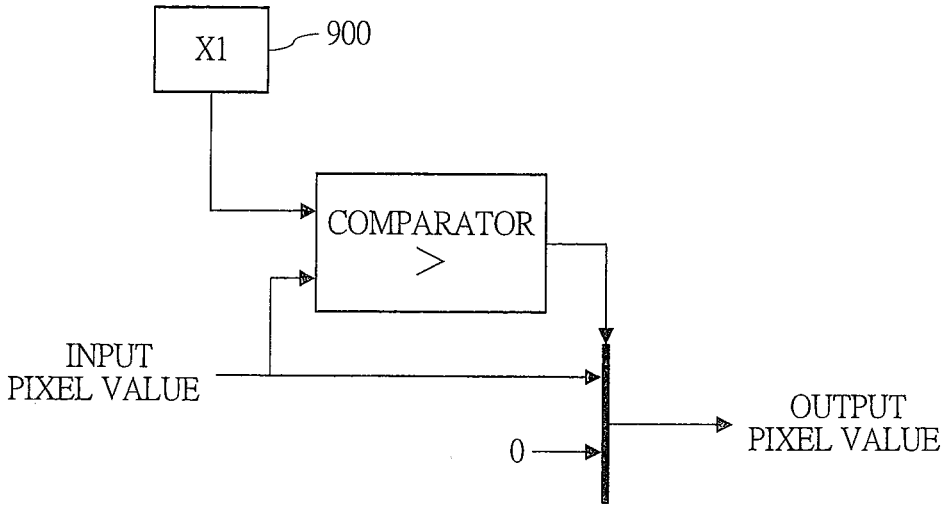
FIG. 17 is a configuration view of a pixel value converter for describing an image grayscale extending process performed in a display driver according to a ninth embodiment of the present invention.

Next, the outline of an image extending process performed in the display driver according to a ninth embodiment of the present invention will be described with reference to FIG. 17. FIG. 17 is a configuration view showing a configuration of a pixel value converter for describing the image extending process performed in the display driver according to the ninth embodiment of the present invention. In the ninth embodiment, the pixel extending circuit 109 of the first embodiment serving as a conversion circuit is changed in the following manner.

When the grayscale value of the pixel of the display image is equal to or larger than z, the conversion is performed by using the histogram equalization, but at this time, the pixel value is adjusted by the pixel value converter shown in FIG. 17 before counting the number of pixels, and the value of the grayscale larger than X1 is converted to 0.

Here, X1 is mounted as the register 900, and an arbitrary value larger than z can be externally set. The conversion is performed for the adjusted pixel value by using used for histogram equalization.

Figure 18:
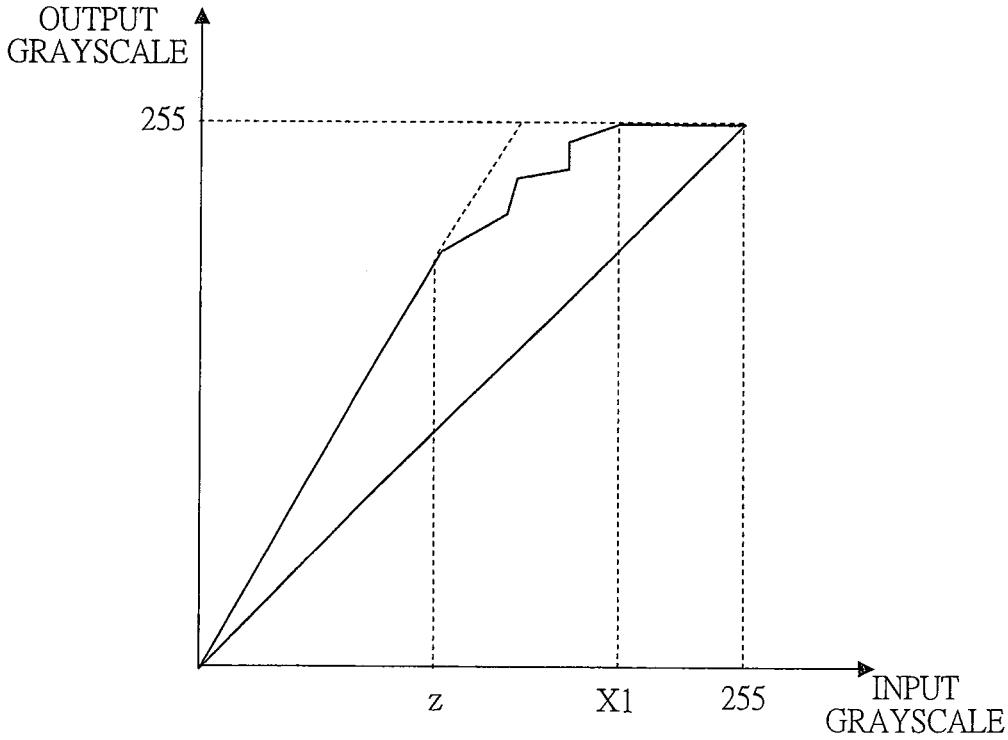
FIG. 18 is a view showing a relationship of input/output of a pixel value of the display driver according to the ninth embodiment of the present invention.
Figure 19:
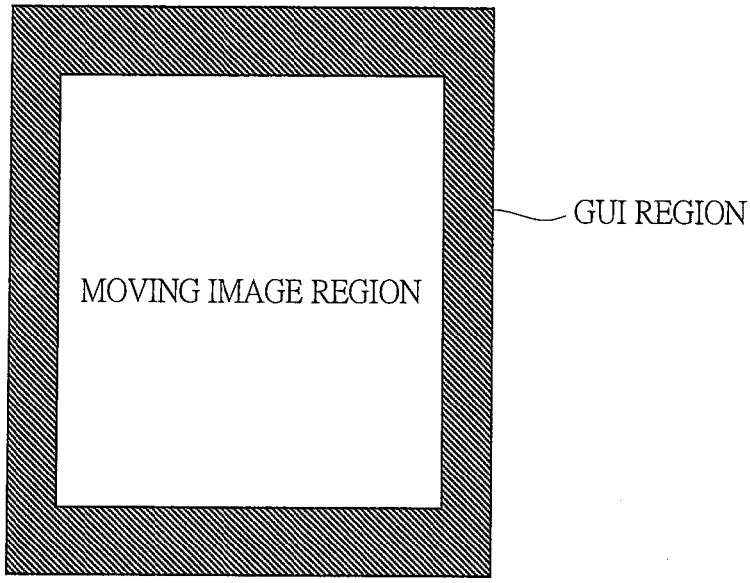
FIG. 19 is a view showing one example of an image in which an effect is expected in the display driver according to the ninth embodiment of the present invention.

The difference from the first embodiment with respect to the conversion method for the input value equal to or higher than the grayscale z in the display driver according to the ninth embodiment of the present invention will be described in detail with reference to FIG. 18 and FIG. 19. FIG. 18 is a view showing a relationship of input/output of the pixel value of the display driver according to the ninth embodiment of the present invention, and FIG. 19 is a view showing an example of an image in which the effect can be expected in the display driver according to the ninth embodiment of the present invention.

Similar to the first embodiment, assuming that the number of pixels of each grayscale can be represented by the function F(x), the cumulative value (total number of pixels) of the histogram from the grayscale z+1 to the grayscale x is expressed as the equation 20 by using F(x).

Equation 20

$$\begin{cases} \sum_{s=z+1}^{x} F(s) & (x \le X1) \\ \sum_{s=z+1}^{X1} F(s) & (x > X1) \end{cases}$$

Since the function F(s) is converted so that the pixel of the grayscale does not exist at s>X1, the value becomes 0. Therefore, when x>X1, the cumulative value of the histogram becomes constant and becomes the cumulative value from z+1 to X1. Accordingly, the output grayscale with respect to the input value x equal to or higher than the grayscale z+1 is expressed as the equation 21.

Equation 21

$$\begin{cases} y = \frac{255}{t} z + \frac{\sum_{s=z+1}^{x} F(s)}{\sum_{s=z+1}^{X1} F(s)} \alpha ka & (x \le X1) \\ y = \frac{255}{t} z + \frac{\sum_{s=z+1}^{X1} F(s)}{\sum_{s=z+1}^{X1} F(s)} \alpha ka = \frac{255}{t}(z + ka) = 255 & (x > X1) \end{cases}$$

In other words, in the region of x≤X1, equation is the same as that of the first embodiment, but in the region of x>X1, the output becomes constant at the maximum grayscale (255). The relationship of the input grayscale and the output grayscale in this case is as shown in FIG. 18. FIG. 18 has three regions, where in the region of x≤z, the relationship expressed by the equation 2 of the first embodiment is obtained, and in the region of z<x≤X1, the relationship expressed by the upper equation of the equation 21, that is, the equation 5 of the first embodiment is obtained. Further, in the region of X1<x≤maximum grayscale (255), the output is always at the maximum grayscale (255) as expressed by the lower equation of the equation 21.

By the conversion as described above, for example, when GUI of high luminance is included in the display image as shown in FIG. 19, the conversion using histogram equalization for the region of equal to or larger than x>z can be performed without being influenced by the high-luminance pixel.

Tenth Embodiment

Next, the outline of an image extending process performed in a display driver according to a tenth embodiment of the present invention will be described. In the tenth embodiment, the pixel extending circuit of the second embodiment is modified in the following manner.

When the grayscale value of the pixel of the display image is equal to or larger than z, the conversion is performed by using the histogram equalization, but at this time, the pixel value is adjusted by the circuit shown in FIG. 17 of the ninth embodiment before counting the number of pixels, and the value of the grayscale larger than X1 is converted to 0. Here, similar to the ninth embodiment, X1 is mounted as the register 900, and an arbitrary value larger than z can be externally set. The conversion is performed for the adjusted pixel value by using histogram equalization.

Figure 20:
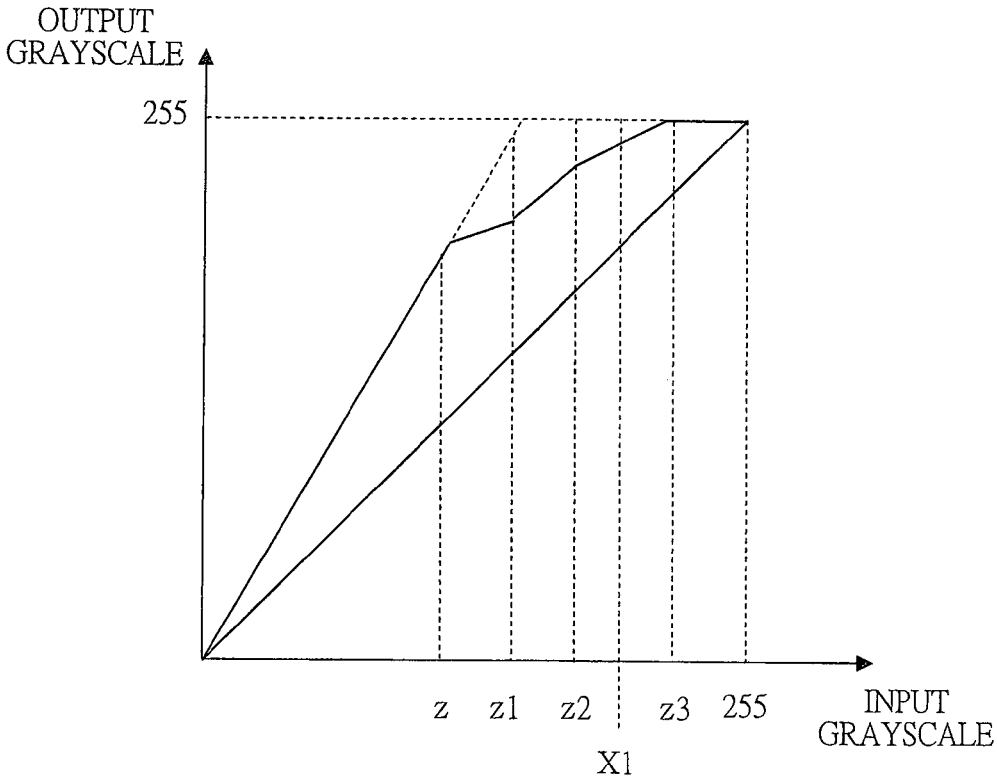
FIG. 20 is a view showing a relationship of input/output of a pixel value of a display driver according to a tenth embodiment of the present invention.

The difference from the second embodiment with respect to the conversion method for the input value equal to or larger than the grayscale z in the display driver according to the tenth embodiment of the present invention will be described in detail with reference to FIG. 20. FIG. 20 is a view showing a relationship of input/output of the pixel value of the display driver according to the tenth embodiment of the present invention.

Similar to the second embodiment, assuming the number of pixels of each grayscale can be represented by the function F(x), N1, N2, and N3 counted by four counters are expressed as the equation 22. In the present embodiment, z2<X1≤z3 is satisfied.

Equation 22

$$\begin{cases} N1 = \sum_{s=z+1}^{z1} F(s) \\ N2 = \sum_{s=z+1}^{z2} F(s) \\ N3 = \sum_{s=z+1}^{X1} F(s) \end{cases}$$

Since the function F(s) is converted so that the pixel of the grayscale does not exist at s>X1, the value becomes 0. Therefore, in N3, the cumulative value of the histogram becomes constant and becomes the cumulative value from z+1 to X1. Accordingly, the output grayscale with respect to the input value x equal to or higher than the grayscale z+1 is expressed as the equation 23.

In other words, in the region of x≤Z3, equation is the same as that of the first embodiment, but in the region of x>Z3, the output becomes constant at the maximum grayscale (255). The relationship of the input grayscale and the output grayscale in this case is as shown in FIG. 20. FIG. 20 has three regions, where in the region of x≤z, the relationship expressed by the equation 2 of the first embodiment is obtained, and in the region of z<x≤Z3, the relationship expressed by the upper three equations excluding the bottom equation of equation 9 is obtained. Further, in the region of Z3<x≤maximum grayscale (255), the output is always at the maximum grayscale (255) as expressed by the bottom equation of equation 23.

By the conversion as described above, similar to the ninth embodiment, for example, when GUI of high luminance is included in the display image as shown in FIG. 19, the conversion using histogram equalization for the region of equal to or larger than x>z can be performed without being influenced by the high-luminance pixel.

Seventeenth Embodiment

Figure 48:
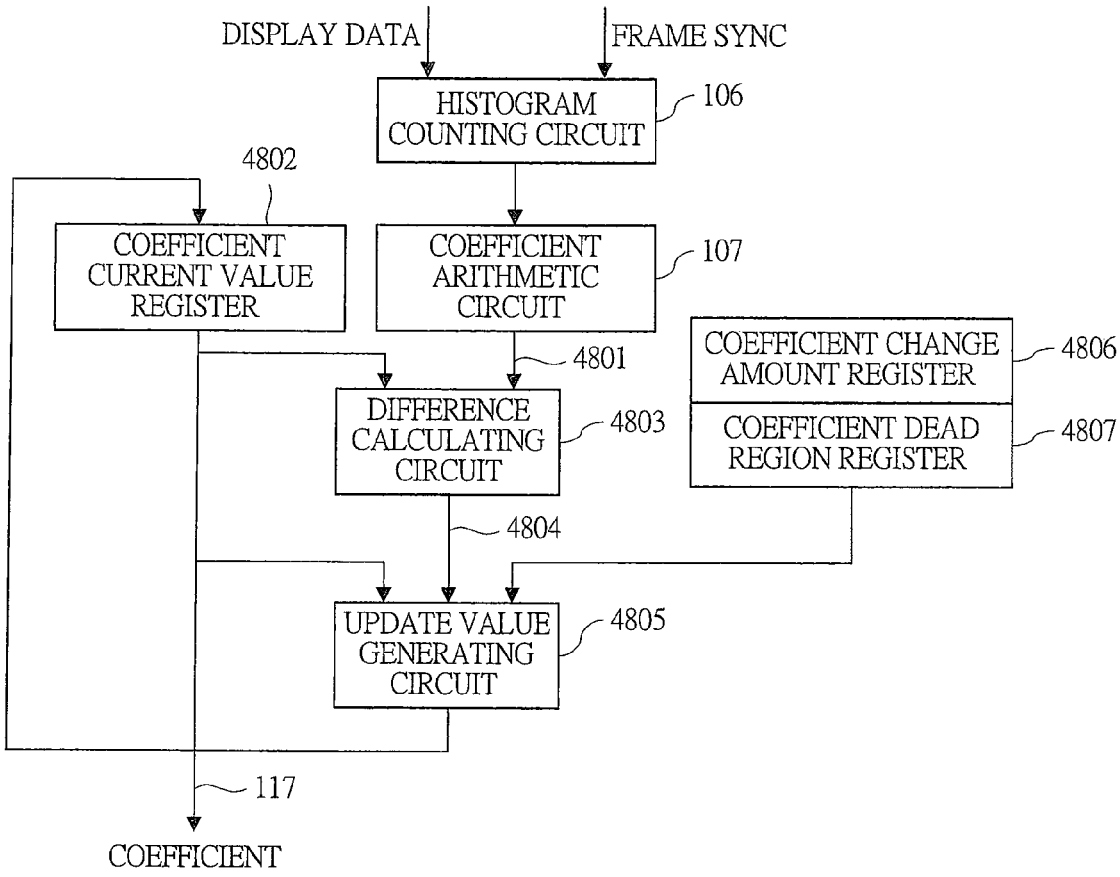
FIG. 48 is a view showing a configuration of a coefficient determining circuit according to a seventeenth embodiment of the present invention.

The difference from the second embodiment with respect to the coefficient determining method in the display driver according to a seventeenth embodiment of the present invention will be described in detail with reference to FIG. 48. FIG. 48 is a view showing a periphery of the coefficient calculating circuit of the display driver according to the seventeenth embodiment of the present invention. The histogram counting circuit 106 and the coefficient calculating circuit 107 operate in the same manner as that of the second embodiment. In the present embodiment, a coefficient 4801 subjected to the arithmetic operation and output from the coefficient calculating circuit 107 is not directly used, and the coefficient 4801 is input to a difference calculating circuit 4803. Then, difference 4804 from a value of a coefficient current value register 4802 separately stored is obtained. This difference 4804 is compared with a value of a coefficient dead region register 4807 in an update value generating circuit 4805. When the difference 4804 is equal to or larger than the value of the coefficient dead region register, the update of the coefficient current value register 4802 is permitted. In this case, the value of the coefficient current value register 4802 is subjected to addition or subtraction so as to be close to the coefficient 4801 subjected to the arithmetic operation, and the coefficient cur- Equation 23

$$y = \begin{cases} \dfrac{\sum_{s=z+1}^{z1} F(s)}{\sum_{s=z+1}^{X1} F(s)} \cdot \dfrac{\alpha ka}{z1 - z}(x - z) + 255 - \alpha ka & (z + 1 \le x \le z1) \\ \dfrac{\sum_{s=z+1}^{z2} F(s) - \sum_{s=z+1}^{z1} F(s)}{\sum_{s=z+1}^{X1} F(s)} \cdot \dfrac{\alpha ka}{z2 - z1}(x - z1) + 255 - \alpha ka + \dfrac{\sum_{s=z+1}^{z1} F(s)}{\sum_{s=z+1}^{X1} F(s)} \alpha ka & (z1 + 1 \le x \le z2) \\ \dfrac{\sum_{s=z+1}^{X1} F(s) - \sum_{s=z+1}^{z2} F(s)}{\sum_{s=z+1}^{X1} F(s)} \cdot \dfrac{\alpha ka}{z3 - z2}(x - z2) + 255 - \alpha ka + \dfrac{\sum_{s=z+1}^{z2} F(s)}{\sum_{s=z+1}^{X1} F(s)} \alpha ka & (z2 + 1 \le x \le z3) \\ \dfrac{\sum_{s=z+1}^{X1} F(s) - \sum_{s=z+1}^{X1} F(s)}{\sum_{s=z+1}^{X1} F(s)} \cdot \dfrac{\alpha ka}{255 - z3}(x - z3) + 255 - \alpha ka + \dfrac{\sum_{s=z+1}^{X1} F(s)}{\sum_{s=z+1}^{X1} F(s)} \alpha ka = 255 & (z3 + 1 \le x \le 255) \end{cases}$$

rent value register 4802 is updated with this value. At this time, as the unit of the addition and subtraction, the value set in a coefficient change amount register 4806 is used. Further, when the difference 4804 is smaller than the value of the coefficient current value register 4802, the coefficient current value register is not updated, and the current value is maintained. Then, the value of the coefficient current value register 4802 is output as the coefficient 117, and thereafter, the same operation as that of the second embodiment is performed. In the configuration as described above, the following operation is performed. Even when an input image is largely changed and an output of the histogram counting circuit 106 is significantly changed, the coefficient is changed only by the value of the coefficient change amount register 4806 in each frame, and the coefficient converges to a coefficient of a new image through several frames. By this means, the rapid change of a display pixel value due to the rapid change of an image can be prevented, and thus, the occurrence of the flicker can be prevented. Further, with respect to the change less than the value of the coefficient dead region register 4807, the coefficient is not changed, and the coefficient change is started only when the change is larger than the value of the coefficient dead region register 4807. Therefore, even when the output of the histogram counting circuit 106 is finely and unstably changed due to the input of a moving image, the coefficient is not changed finely and is kept stable, thereby preventing the flicker.

Figure 49A:
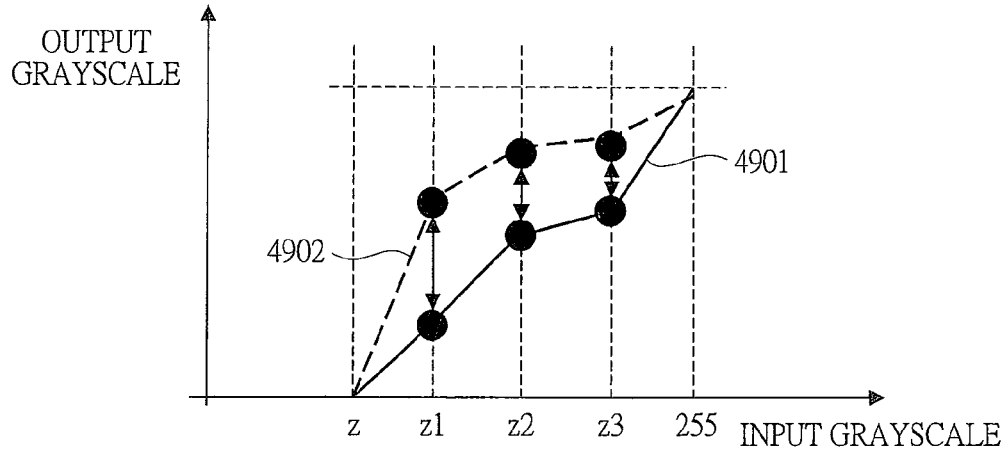
FIG. 49A is a view showing an operation example in the case where an image is rapidly changed according to the seventeenth embodiment of the present invention.
Figure 49B:
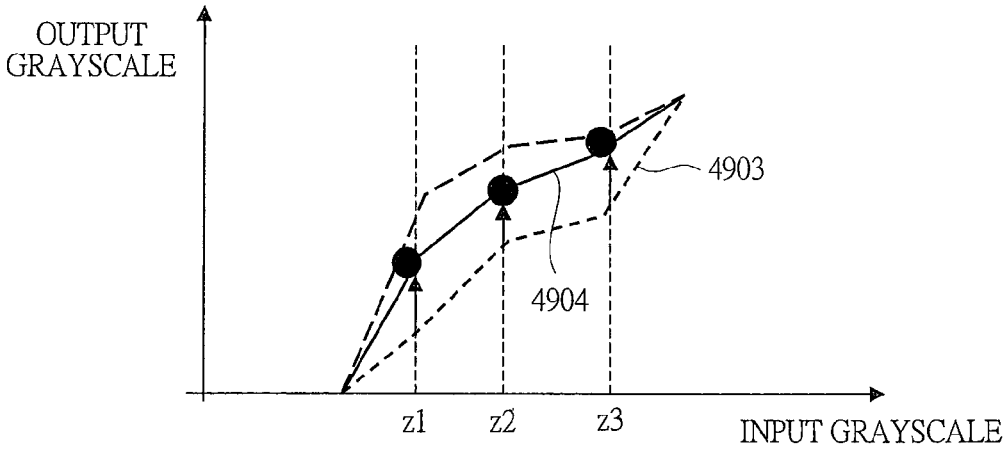
FIG. 49B is a view showing an operation example in the case where an image is rapidly changed according to the seventeenth embodiment of the present invention.
Figure 49C:
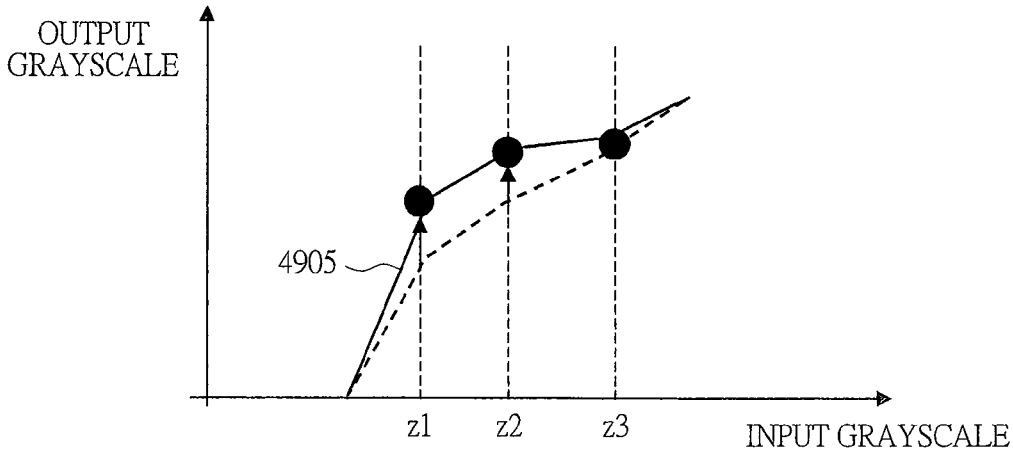
FIG. 49C is a view showing an operation example in the case where an image is rapidly changed according to the seventeenth embodiment of the present invention.

Of the operations of the seventeenth embodiment, the operation in the case where the display pixel value is rapidly changed will be described with reference to FIG. 49. FIG. 49A shows a relationship of a value of the coefficient current value register 4802 and an output value of the coefficient calculating circuit 107. A solid line 4901 shows a graph of input grayscale and output grayscale by the values of the coefficient current value register, and a dotted line 4902 shows a graph of input grayscale and output grayscale by the output values of the coefficient calculating circuit 107. There are the differences at the peaks of the broken lines, by which the difference in the entire graphs is shown. In FIG. 49B, the relationship with the output value of the update value generating circuit 4805 is added to that of FIG. 49A. The amount shown at the peaks of the broken line 4903 is added to the value of the coefficient current value register shown by the line 4901, thereby generating the output value of the update value generating circuit shown by a line 4904. The added value of the line 4903 is the value set in the coefficient change amount register 4806. In this figure, although the line 4904 is close to the output of the coefficient calculating circuit shown by the line 4902, it does not converge. FIG. 49C shows an output value of the update value generating circuit 4805 in the next frame. In the next frame, the value of the coefficient current value register 4802 is changed to the value shown by the line 4904, and the addition to this value is further performed, and finally, it converges to the output value shown by the line 4905, which is the output value of the coefficient calculating circuit 107. In this figure, only the operation in an increasing direction is shown, but the operation in a decreasing direction can be implemented in the same manner.

Figure 50A:
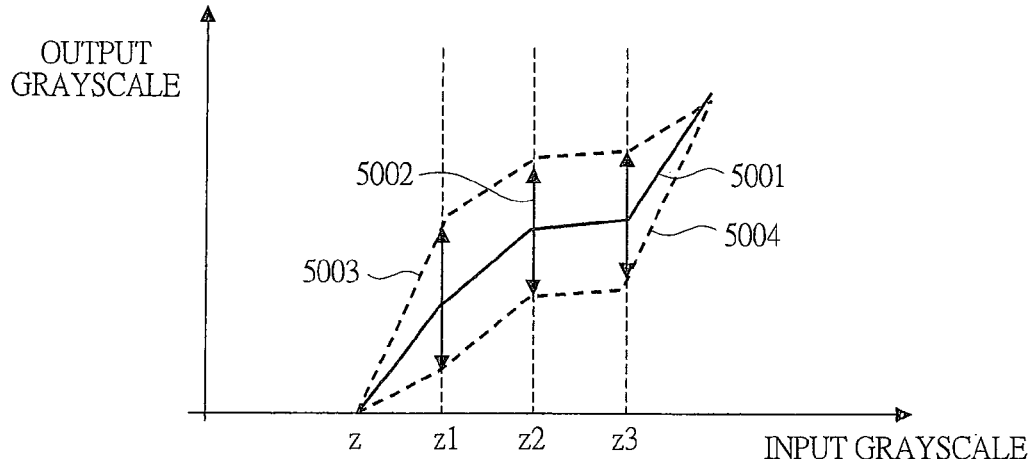
FIG. 50A is a view showing an operation example in the case where an image is finely changed according to the seventeenth embodiment of the present invention.
Figure 50B:
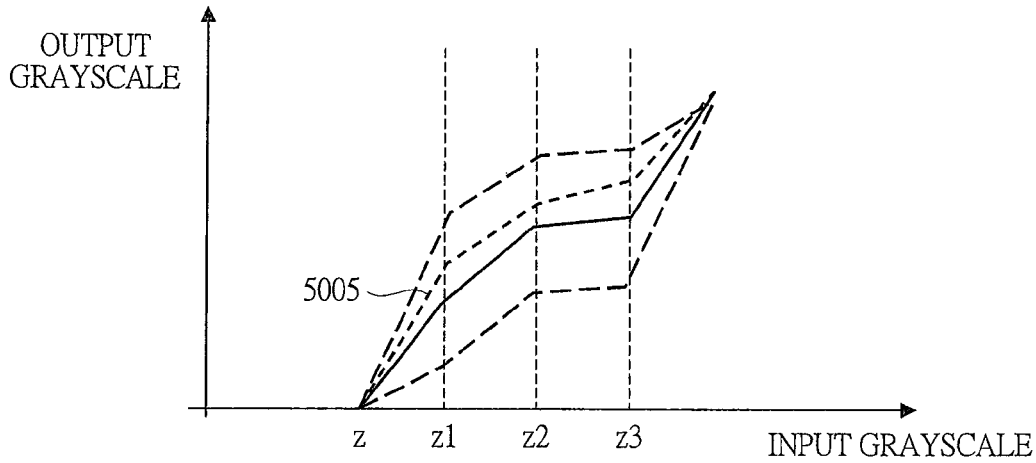
FIG. 50B is a view showing an operation example in the case where an image is finely changed according to the seventeenth embodiment of the present invention.
Figure 50C:
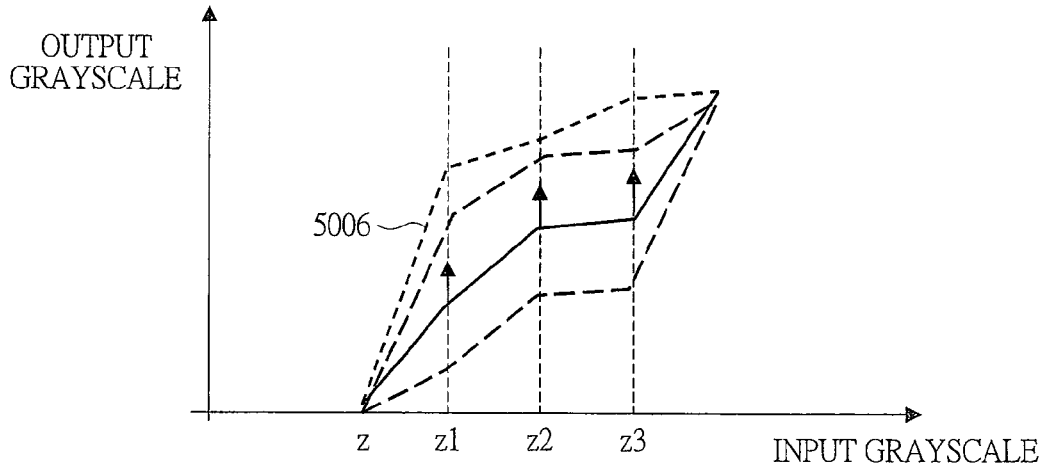
FIG. 50C is a view showing an operation example in the case where an image is finely changed according to the seventeenth embodiment of the present invention.

Of the operations of the seventeenth embodiment, the operation in the case where the output of the histogram counting circuit 106 is finely and unstably changed will be described with reference to FIG. 50. FIG. 50A shows a relationship of an upper limit value and a lower limit value set by the value of the coefficient current value register 4802 and the value of the coefficient dead region register 4807. A solid line 5001 shows a graph of input grayscale and output grayscale by the values of the coefficient current value register. On the other hand, a range shown by 5002 corresponds to the range of dead region set by the value of the coefficient dead region register 4807. By this means, the upper limit value of the dead region is shown by the graph of input grayscale and output grayscale 5003, and the lower limit value is shown by the graph of input grayscale and output grayscale 5004. FIG. 50B shows the case where the output value of the coefficient calculating circuit 107 is within the range of the dead region. The fine dotted line 5005 is the output value of the coefficient calculating circuit, and it exists between the upper limit value and the lower limit value of the dead region shown by rough dotted lines. Therefore, the update of the coefficient current value register 4802 is not performed, and the coefficient 117 is not changed, either. FIG. 50C shows the case where the output value of the coefficient calculating circuit 107 is outside the range of the dead region. The fine dotted line 5006 is the output value of the coefficient calculating circuit, and it exceeds the upper limit value of the dead region shown by the rough dotted line. Therefore, the coefficient current value register 4802 is updated, and the coefficient 117 gradually approaches to the output value 5006. In this figure, the case where the output value of the coefficient calculating circuit exceeds the upper limit value is shown, but the similar operation is performed also in the case where it falls below the lower limit value.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention can be applied to a display device using a backlight and an element for controlling transmissivity of the liquid crystal and the like, for example, a television, a personal computer or a cellular phone using a liquid crystal display device.

Basis of Eleventh to Thirteenth Embodiments

An outstanding peak of the maximum grayscale (255 grayscale) is generated mainly due to the following two reasons.

(1) A light source or the like is displayed on a screen.

(2) All the portions having a luminance equal to or higher than the maximum grayscale (255 grayscale) are aligned at 255 grayscale when an original image having a wide luminance range is taken and digitized.

Figure 36:
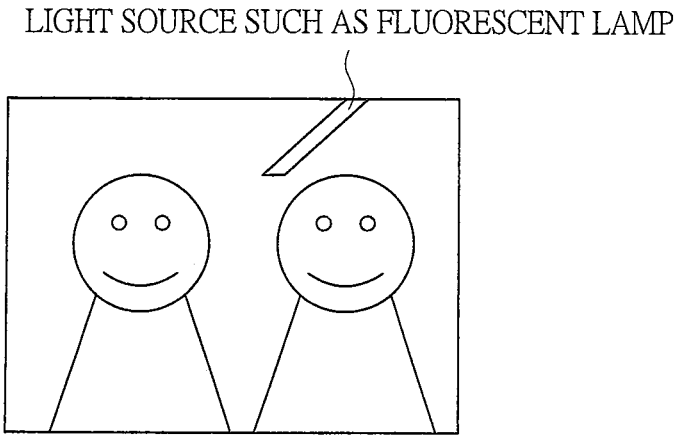
FIG. 36 is a view showing an example of an image having a light source in a screen related to the description of the basis of the present invention.

The case of (1) that a light source or the like is displayed on a screen is the case where a light source such as fluorescent bulb or the sun is in the screen as shown in FIG. 36, and such light source is not important in terms of screen configuration in many cases and no problem will arise even if the brightness is slightly changed.

Figure 37:
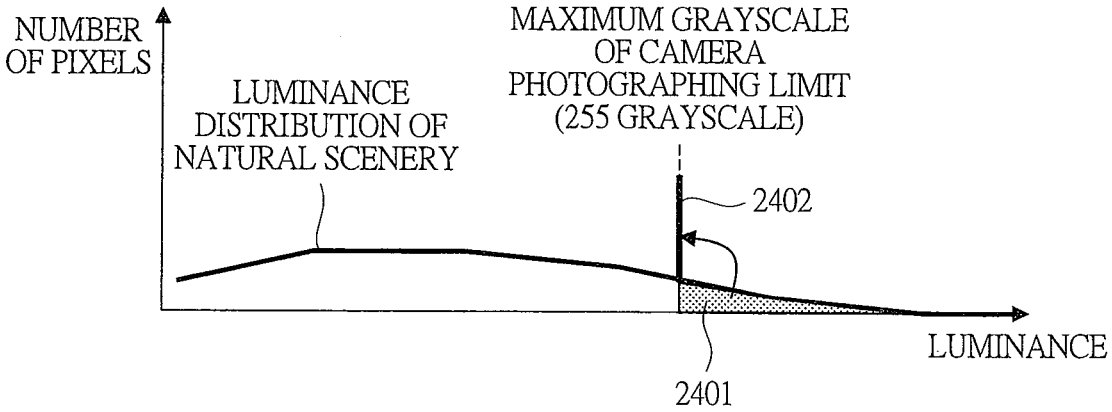
FIG. 37 is a view for describing that the peak is biased to the highest grayscale at the time of analog-digital conversion related to the description of the basis of the present invention.

The case of (2) occurs when the portions having a luminance equal to or higher than the maximum grayscale are aligned at the maximum grayscale as shown in FIG. 37. At a time of digitization, an error is already caused from the original image. Thus, no problem will arise even if the brightness is slightly changed.

To solve the problems described above, in the present invention, a calculation is performed while excluding a number of pixels of a predetermined grayscale (for example, maximum grayscale or its approximate grayscale) when calculating the accumulate value of the histogram from the maximum grayscale.

Next, the image extending process performed to enhance the contrast in the present invention will be described with reference to FIG. 21 and FIG. 22.

Figure 21A:
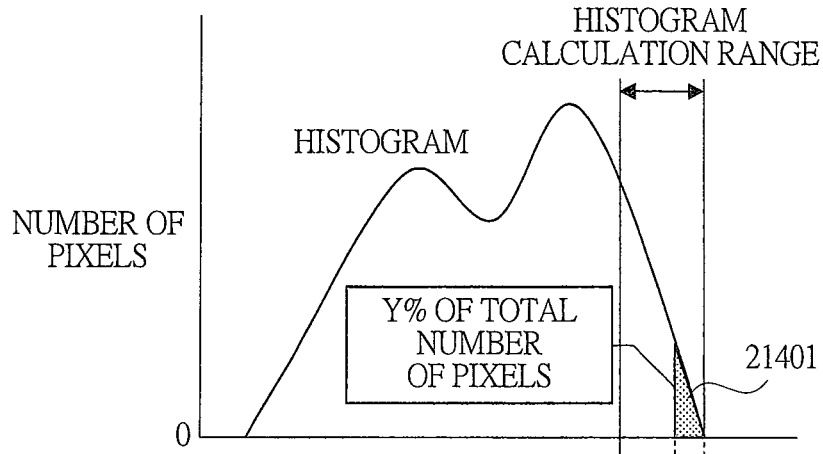
FIG. 21A is a conceptual view for describing a pixel extension coefficient and a threshold determination value in the present invention.

FIG. 21 is a conceptual view of a pixel extension coefficient x and a threshold determination value y.

In FIG. 21, the term of pixel extension coefficient x is used. This refers to, in the display image, the grayscale x at which the number of cumulated pixels of the grayscale value equal to or lower than the maximum grayscale to be cumulated is y % of the total number of pixels included in one frame of an image.

Figure 21B:
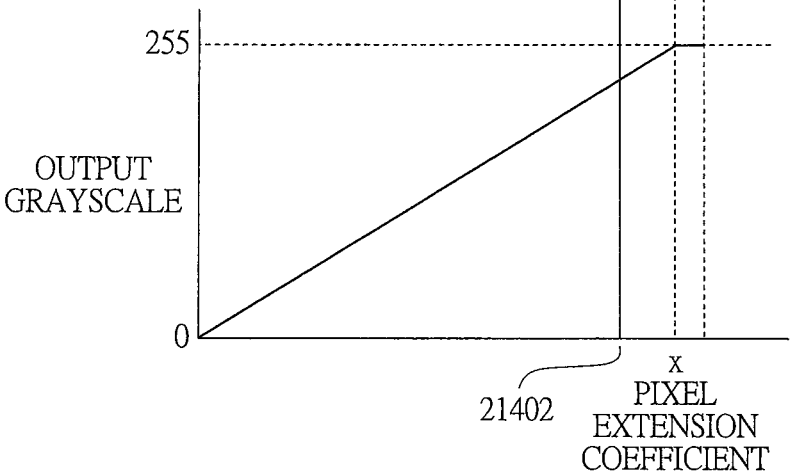
FIG. 21B is a conceptual view for describing a pixel extension coefficient and a threshold determination value in the present invention.

The grayscale x of the pixel extension coefficient is assigned to 255 grayscale as shown in FIG. 21B, and the display data from the grayscale 0 to the grayscale x is linearly assigned to the output grayscale as shown in FIG. 21B. On the other hand, with respect to the display data equal to or higher than the grayscale x, the output grayscale is evenly assigned to the maximum value (255 grayscale).

In this manner, in the present invention described in this specification, the contrast is enhanced by extending the grayscales 0 to x to 0 to 255.

As described above, in the present invention, the grayscale x at which the number of pixels having the grayscale values of the grayscale x or higher and the maximum-γ (255-γ) grayscale or lower is y % of the total number of pixels is referred to as the pixel extension coefficient, and the image is extended by assigning the grayscale to the maximum (255) grayscale. The value of y % is defined as the threshold determination value in the present invention. The threshold determination value is a matter determined in a design stage and is appropriately determined by a circuit designer. It is desired that a number of the pixel of equal to or larger than the pixel extension coefficient of a display image is sufficiently small and inconspicuous with respect to the entire image is set as the threshold determination value.

Figure 22A:
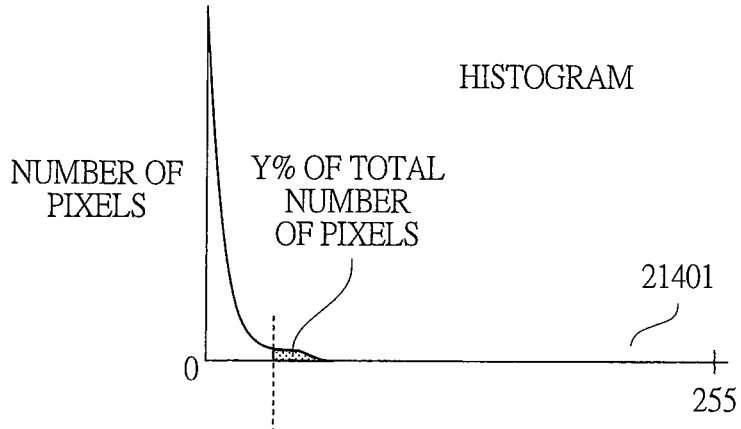
FIG. 22A is a conceptual view for describing a lower limit value of the pixel extension coefficient in the present invention.

On the other hand, FIG. 22 shows an example where the image information is concentrated on the low grayscale, and "lower limit value" of the pixel extension coefficient will be described using the example.

Figure 22B:
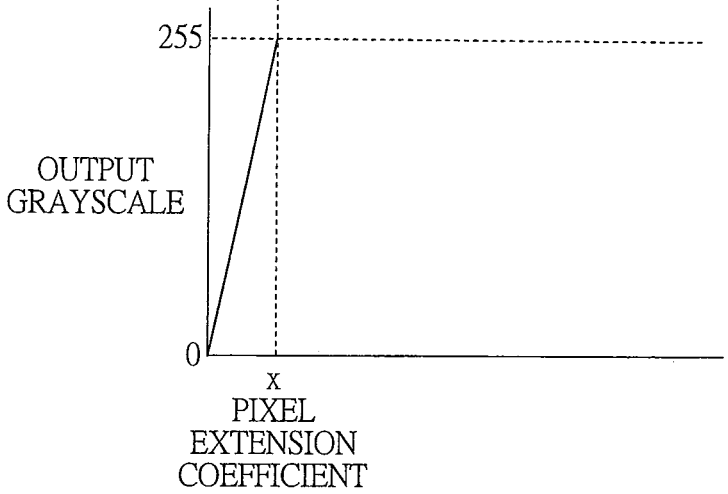
FIG. 22B is a conceptual view for describing a lower limit value of the pixel extension coefficient in the present invention.

When the image information is concentrated on the low grayscale, the pixel extension coefficient x obtained in the above method is a small value. Thus, the extension magnification becomes too large as shown in FIG. 22B, and distortion of the output image becomes large. In order to deal with such a case, the grayscale (21402 of FIG. 21) from which the pixel extension coefficient is not lowered is determined as a design matter. This is hereinafter referred to as "lower limit value".

In the present specification, the data to be handled is described as 8-bit data of 255 grayscales, but it may be 10-bit data (1023 grayscales).

Based on the above premise, each embodiment of the present invention will be described with reference to the drawings.

Eleventh Embodiment

Figure 23:
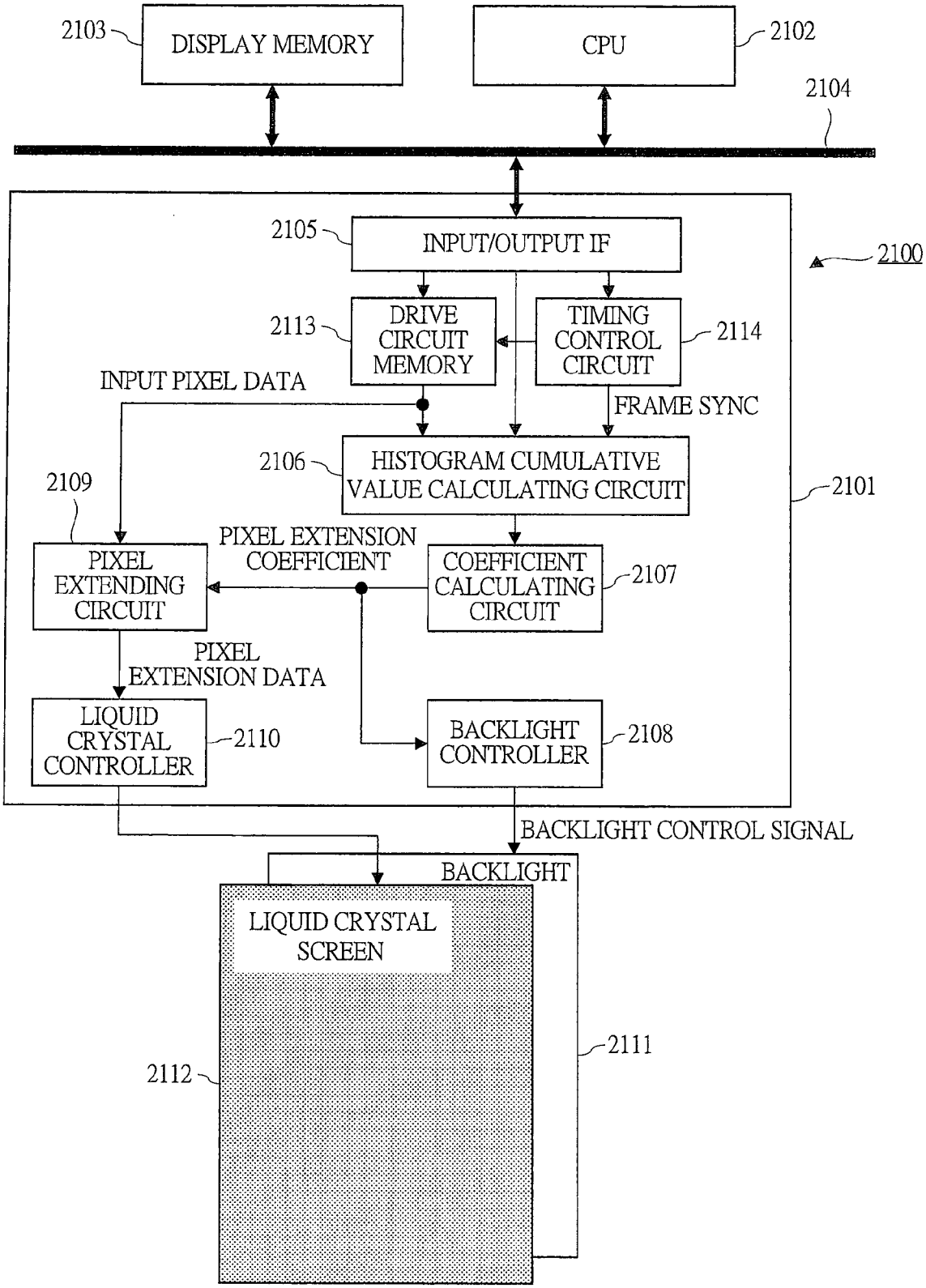
FIG. 23 is a block diagram of a display driver according to an eleventh embodiment of the present invention.

FIG. 23 is a block diagram of a display device of the eleventh embodiment.

A display device 2100 is configured of a display driver 2101, a central processing unit (CPU) 2102, a display memory 2103, an internal bus 2104, a backlight 2111, and a liquid crystal screen 2112.

The display driver 2101 is a circuit for driving the backlight 2111 and the liquid crystal screen 2112. The display driver 2101 is configured to include an input/output interface circuit 2105, a histogram cumulative value calculating circuit 2106, a coefficient calculating circuit 2107, a backlight controller 2108, a pixel extending circuit 2109, a liquid crystal controller 2110, a drive circuit memory 2113, and a timing control circuit 2114.

The CPU 102 is a processor for transmitting data to the display driver 2101 and causing the liquid crystal screen 2112 to display.

The memory 2103 is a memory for holding attributes on luminance, hue, and color saturation for the display on a liquid crystal screen. In the present invention, the memory is connected to the internal bus 2104 outside the display driver 2101. However, the memory may be directly connected to the display driver 2101 to be dedicated to the display driver 2101, or may be incorporated in the display driver 2101. Alternatively, it may be designed to be shared with the CPU 2102.

The internal bus 2104 is a bus used to transfer data between the modules in the display device 2100.

The backlight 2111 is a light source for enhancing visibility of the liquid crystal screen 2112 by irradiating the liquid crystal screen 2112 which does not emit light by itself.

The liquid crystal screen 2112 is an image display device incorporating liquid crystal elements.

Next, the modules inside the display driver 2101 will be described.

The input/output interface circuit (input/output IF circuit) 2105 is an interface unit for receiving data transmitted from the internal bus 2104. The input/output interface circuit 2105 includes a "display start register" (not shown) indicating whether or not the display driver 2101 is in a state for performing a display on the liquid crystal screen (display start mode).

The histogram cumulative value calculating circuit 2106 is a circuit which obtains the number of pixels of each grayscale from the highest grayscale (255 grayscale) to the lower limit value from the display data of one frame and forms a histogram thereof.

The coefficient calculating circuit 2107 obtains the sum of the number of pixels to each grayscale from the output of the histogram cumulative value calculating circuit 2106. The "grayscale x" which is the pixel extension coefficient is thereby obtained.

Note that, since the histogram cumulative value calculating circuit 2106 and the coefficient calculating circuit 2107 are characteristic points of the present invention, they will be described later in detail.

The backlight controller 2108 has a function to adjust the illumination or the like of the backlight 2111. This adjustment of illumination can reduce the power consumption of the backlight 2111.

The pixel extending circuit 2109 is a circuit for performing an extending process for the grayscale of the display image based on the pixel extension coefficient.

The liquid crystal controller 2110 is a controller for performing the display on the liquid crystal screen 2112 based on the output data of the pixel extending circuit 2109.

The drive circuit memory 2113 is a memory for temporarily storing the display data sent via the input/output interface circuit 2105. The capacity of the drive circuit memory 2113 differs depending on the system, but a system usually has a frame memory equivalent to one frame. In the present invention, a FIFO memory with several bytes may be used.

The timing control circuit 2114 outputs a SYNC signal indicating the start position of the display data with respect to the display data sent via the input/output interface circuit 2105. In synchronization with the SYNC signal, the display data is output from the drive circuit memory 2113 to the histogram cumulative value calculating circuit 2106 and the pixel extending circuit 2109.

Hereinafter, the operation of the display device will be described.

The CPU 2102 writes a value indicating the display start to the "display start register" (not shown) in the input/output interface circuit 2105 when displaying the data on the liquid crystal screen 2112. Thereafter, the display data is transferred from the display memory 2103 to the drive circuit memory 2113 via the input/output interface circuit 2105.

In the display start mode, the timing control circuit 2114 of the display driver 2101 outputs a frame SYNC signal indicating the start position of the display data. In synchronization with the frame SYNC signal, the display data is output from the drive circuit memory 2113 to the histogram cumulative value calculating circuit 2106 and the pixel extending circuit 2109.

The display data output from the drive circuit memory 2113 is formed into a histogram in the histogram cumulative value calculating circuit 2106. One example of the histogram is shown in FIG. 24.

Figure 24:
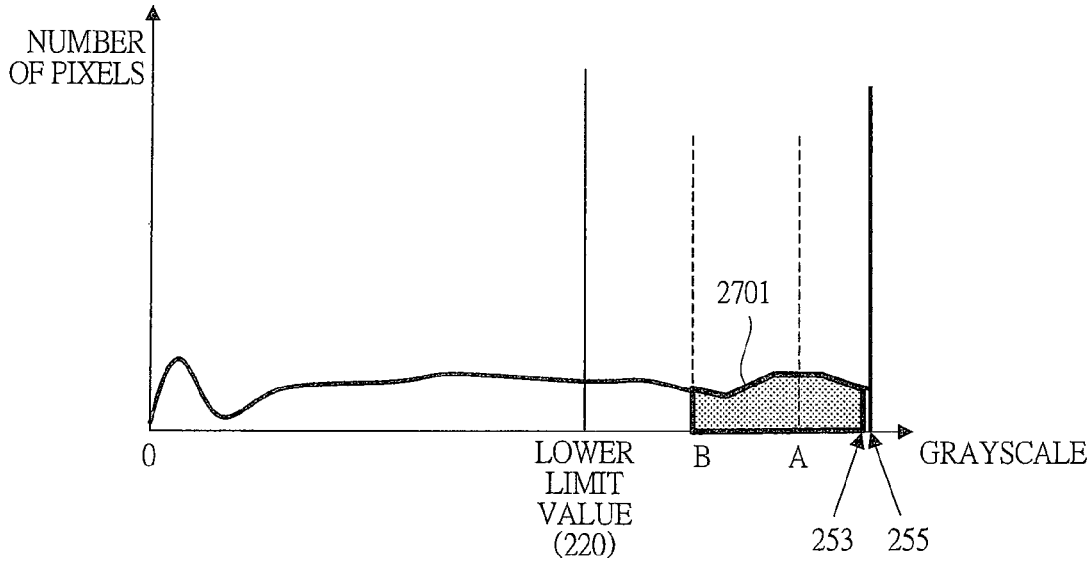
FIG. 24 is a view showing an example of a histogram related to the present invention.

In FIG. 24, the cumulative value (histogram) of the pixels of each grayscale from 255 grayscale as the maximum grayscale value to the lower limit value is obtained. Note that whether or not the number of pixels of the grayscale near the 255 grayscale as the maximum grayscale value is counted is a matter determined in a design stage. The design in which the number of pixels of the grayscale is counted but is not output to the coefficient calculating circuit 2107 or the grayscale is output to the coefficient calculating circuit 2107 but is ignored in the coefficient calculating circuit 2107 may also be adopted.

The histogram data obtained by the histogram cumulative value calculating circuit 2106 is transmitted to the coefficient calculating circuit 2107. The coefficient calculating circuit 2107 obtains the pixel extension coefficient from the histogram data.

The method of obtaining the pixel extension coefficient in the coefficient calculating circuit 2107 will now be described based on FIG. 24. In the example of the present embodiment, the 255 grayscale as the maximum value of the grayscale and the following 254 grayscale are not used in obtaining the pixel extension coefficient (not included in the object to be cumulated). Since the addition cannot be made with only 253 grayscale which is the upper limit of the cumulative target, 255−2(255 grayscale and 254 grayscale)−1, that is, 252 is set as an initial value of a variable a of the counter of the process.

First, the sum of the number of pixels of the grayscale 253 or lower and the variable a grayscale or higher is obtained. If the sum of the number of pixels is smaller than a predetermined threshold determination value, 1 is subtracted from the value a, and the sum of the number of pixels is obtained again. More specifically, a=251 in the example, and the sum of the number of pixels from the grayscale 251 to the grayscale 253 is obtained. This is repeated until the lower limit value is reached or the sum of the number of pixels becomes larger than the threshold determination value.

On the other hand, if the sum of the number of pixels is larger than the predetermined threshold determination value, a value obtained by adding 1 to the value a at that point is decided as the pixel extension coefficient. Further, if the variable a reaches the lower limit value without the sum of the number of pixels becoming larger than the predetermined threshold determination value, the lower limit value (2220 in FIG. 24) is handled as the pixel extension coefficient.

If the pixel extension coefficient is decided, the coefficient calculating circuit 2107 outputs the confirmed pixel extension coefficient to the backlight controller 2108 and the pixel extension circuit 2109.

Next, the operation of the backlight controller 2108 and the grayscale luminance characteristics of the liquid crystal screen 2112 will be described with reference to FIG. 25.

Figure 25:
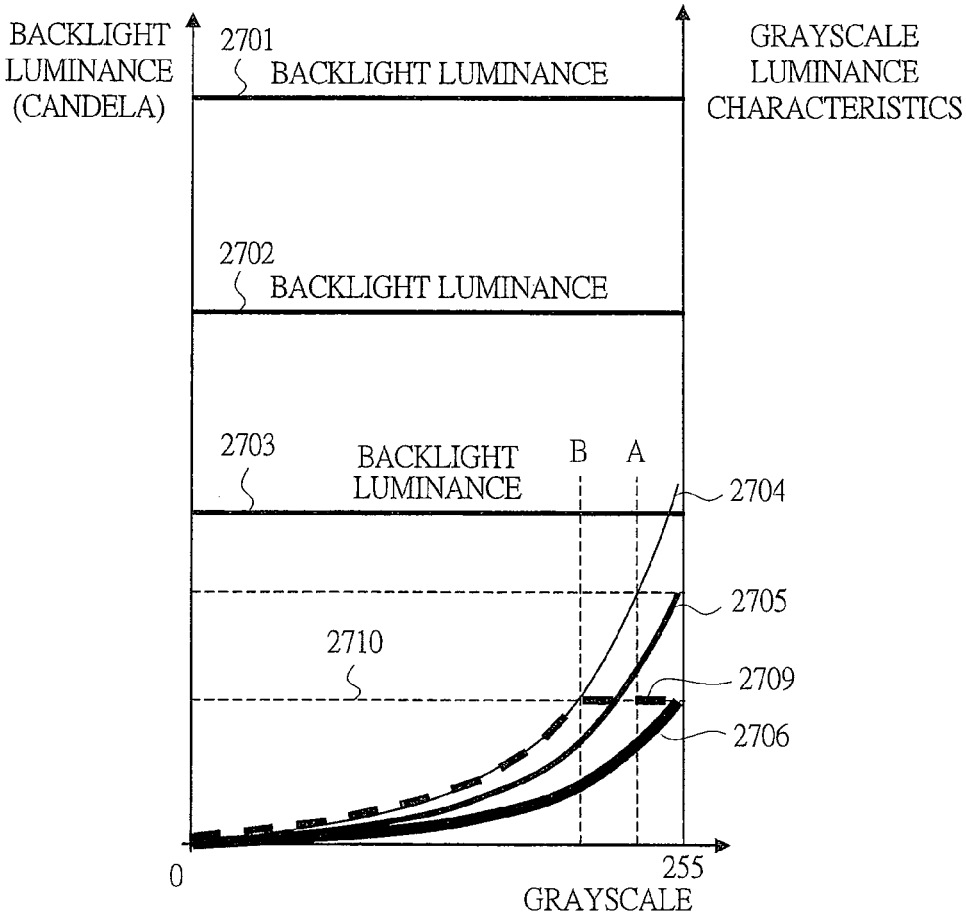
FIG. 25 is a graph showing a correspondence of an operation of a backlight controller and grayscale luminance characteristics of a liquid crystal screen according to the eleventh embodiment of the present invention.

FIG. 25 is a graph showing a correspondence of the operation of the backlight controller 2108 and the grayscale luminance characteristics of the liquid crystal screen 2112.

The horizontal axis of FIG. 25 represents the grayscale of the display pixel. Meanwhile, the left vertical axis represents the luminance of the backlight, and the unit thereof is candela ($cd/m^2$). The right vertical axis represents the grayscale luminance characteristics of the liquid crystal screen 2112.

The luminance 2701 of FIG. 25 is the backlight luminance when the highest grayscale is 255 grayscale. Similarly, the luminance 2702 shows the backlight luminance when the backlight luminance is controlled so that the highest grayscale becomes the luminance of the grayscale indicated by pixel extension coefficient A, and the luminance 2703 shows the backlight luminance when the backlight luminance is controlled so that the highest grayscale becomes the luminance of the grayscale indicated by pixel extension coefficient B.

Further, the grayscale luminance characteristics when the maximum grayscale is 255 grayscale and the backlight luminance is 2701 are grayscale luminance characteristics 2704, the grayscale luminance characteristics of the liquid crystal or the like when the backlight luminance is 2702 are grayscale luminance characteristics 2705, and the grayscale luminance characteristics of the liquid crystal or the like when the backlight luminance is 2703 are grayscale luminance characteristics 2706.

In general, if the backlight luminance is lowered, the current consumption lowers. Also, in the present invention, it is advantageous in terms of power consumption to light the backlight with the luminance 2701 than with the luminance 2702, and it is further advantageous to light the backlight with the luminance 2703. The backlight controller of the present invention focuses on such an aspect and performs the following process.

More specifically, the backlight luminance is fixed to 2703 (luminance when highest grayscale is pixel extension coefficient B). Meanwhile, from the grayscale 0 to grayscale B, the grayscale luminance characteristics 2704 are used as the grayscale luminance characteristics of the liquid crystal or the like. Further, in the range from the grayscale B to the grayscale 255, the maximum grayscale is fixed so as to have the grayscale luminance characteristics 2709 in which the luminance 2710 equal to the luminance at the grayscale B of the grayscale luminance characteristics 2704 is the luminance of the highest grayscale. By the control as described above, the power consumption can be significantly reduced.

Figure 26:
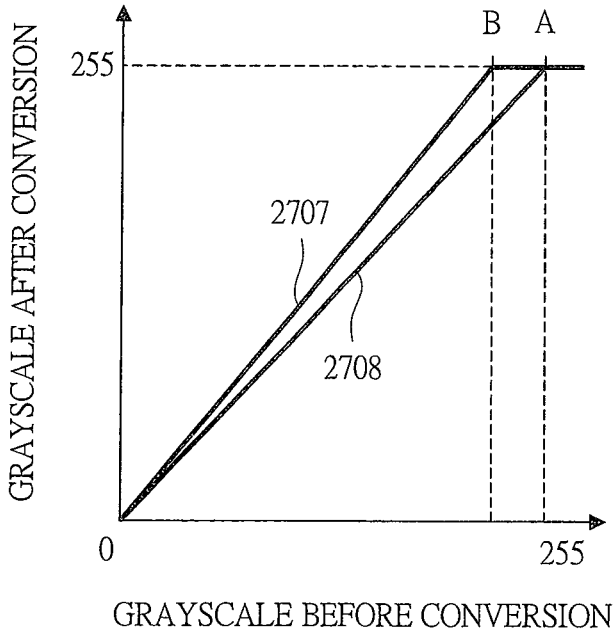
FIG. 26 is a conceptual view of pixel extension according to the eleventh embodiment of the present invention.

In the pixel extending circuit 2109, the conversion shown by the characteristics 2707 of FIG. 26 is performed to the grayscale of the display image. FIG. 26 is a conceptual view of the pixel extension in the pixel extending circuit 2109.

The characteristics 2708 of FIG. 26 are the input/output characteristics of the pixel extending circuit when extension is not performed.

In the pixel extending circuit 2109 of the present invention, the portions of the pixel extension coefficient (grayscale B) or higher of the display image are all processed as the grayscale 255, and only the portions of 0 or higher and the pixel extension coefficient (grayscale B) or lower are converted linearly as shown by the characteristics 2707.

The luminance displayed on the liquid crystal screen 2112 has the characteristics 2709 of FIG. 25 by converting the backlight luminance and the grayscale of the image in the manner described above. Since a value which is sufficiently small and inconspicuous with respect to the entire image is set as the threshold determination value, even if the luminance of grayscale of the pixel extension coefficient or larger is flat at a predetermined luminance as in the characteristics 2709, it is inconspicuous as the entire image, and the significant degradation of the image quality does not occur. Further, as described above, the case where there is a peak at the grayscale 255 is the case where the light source is in the screen or the case where the grayscales equal to or higher than the grayscale 255 appear as the grayscale 255 in the digitization. Therefore, the image quality does not significantly degrade even if the portion of the grayscale 255 is flat at the luminance of the pixel extension coefficient.

Incidentally, in the case of a method of using the cumulative value of the histogram including the highest grayscale, if the same determining method of the threshold determination value is used, the pixel extension coefficient shifts to the high grayscale side. This is because the peak is normally at the grayscale 255. In the case of the method of using the cumulative value of the histogram including the highest grayscale, the pixel extension coefficient shifts from B to A on the grayscale 255 side as shown in FIG. 24. In the backlight controller 2108, the backlight luminance is lowered to 2702 so as to have the grayscale luminance characteristics 2705 in which the luminance equal to the luminance of 2704 at the grayscale A where the pixel extension coefficient is the highest grayscale is the luminance of the highest grayscale. By this means, the luminance of the highest grayscale are higher than that of the case where the sum of the number of pixels is obtained while excluding the highest grayscale. From the opposite standpoint, the power consumption can be significantly reduced by calculating the histogram excluding the highest grayscale in the pixel extending circuit 2109.

Next, the detailed block diagram and the operation of the histogram cumulative value calculating circuit 2106 and the coefficient calculating circuit 2107 of the eleventh embodiment will be described with reference to FIG. 27 and FIG. 28.

Figure 27:
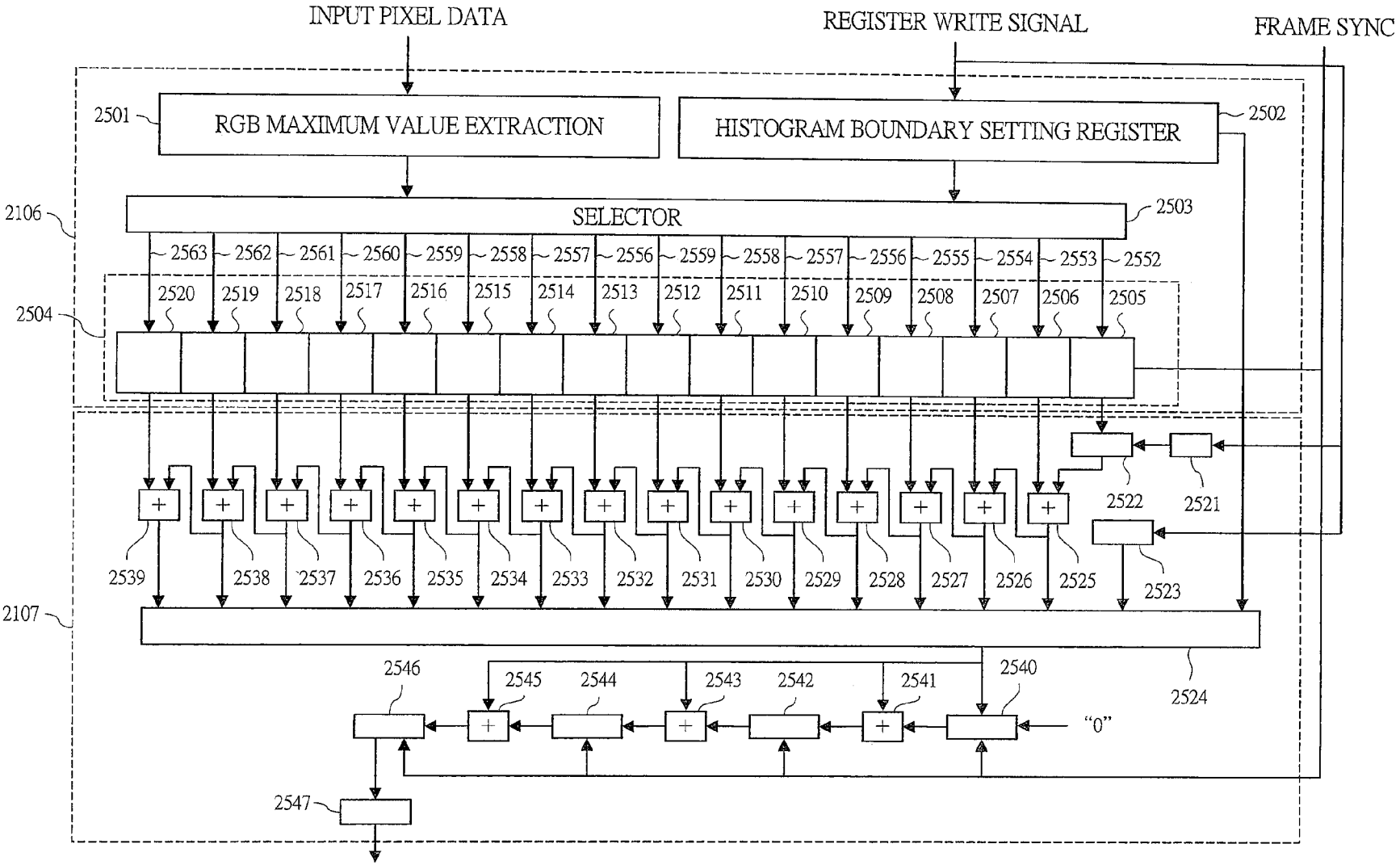
FIG. 27 is a detailed block diagram of a histogram cumulative value calculating circuit and a coefficient calculating circuit according to the eleventh embodiment of the present invention.

FIG. 27 is a detailed block diagram of the histogram cumulative value calculating circuit 2106 and the coefficient calculating circuit 2107. FIG. 28 is an example of the setting of the histogram boundary setting register 2502, and the setting items include counter, histogram boundary register setting value, and count up range.

The histogram cumulative value calculating circuit 2106 is configured of an RGB maximum value extracting circuit 2501, the histogram boundary setting register 2502, a selector 2503, and a histogram counter 2504.

On the other hand, the coefficient calculating circuit 2107 is configured of a threshold value storage register 2521, a selector 2522, a threshold determination value storage register 2523, a selector 2524, adders 2525 to 2539, registers 2540, 2542, 2544 and 2546, adders 2541, 2543 and 2545, and a divider 2547.

The RGB maximum value extracting circuit 2501 is a circuit which selects the maximum grayscale value from the data of red (R), green (G), and blue (B) of one pixel transmitted from the input/output interface 2105, and outputs the same to the selector 2503.

The histogram boundary setting register 2502 is a register which is set by the CPU 2102 via the input/output interface 2105, and has a function to set which counter is to be counted up in accordance with the value of the output of the RGB maximum value extracting circuit 2501.

The selector 2503 is a selector which compares the output of the RGB maximum value extracting circuit 2501 and the output of the histogram boundary setting register 2502 to determine the output to the histogram counter 2504. In the present embodiment, the histogram counter 2504 is a counter configured of sixteen counters 2505 to 2520. Although the number of counters is sixteen here, the number of counters is determined in consideration of the lower limit value of the pixel extension coefficient and the count up range of FIG. 28. More specifically, although the lower limit value is set to 220 in the present embodiment, more number of counters are required if a lower value is set to the lower limit value. Further, if the count up range in the setting item of the histogram boundary setting register 2502 becomes wider, the number of counters decreases accordingly.

The threshold value storage register 2521 is a register which sets a threshold value for not adding the value of the counter 2505 to the histogram cumulative value when the value of the counter 2505 is smaller than the value of the threshold value storage register, and adding the value of the counter 2505 to the histogram cumulative value when the value of the counter 2505 is larger than the value of the threshold value storage register.

The selector 2522 is a selector which outputs "0" when the value of the counter 2505 is smaller than the value of the threshold value storage register 2521, and outputs the value of the counter 2505 when the value of the counter 2505 is equal to or larger than the value of the threshold value storage register 2521. Accordingly, if the cumulative value of the highest grayscale is equal to or lower than the predetermined value, the value can be ignored. To the contrary, if the value of the threshold value storage register 2521 is set to "0", the highest grayscale is always output.

The threshold determination value storage register 2523 is a register for storing the threshold determination value.

The selector 2524 is a selector which compares the cumulative values 2526 to 2539 from the highest grayscale to the corresponding grayscale to be cumulated and the value of the threshold determination value storage register 2523, and outputs the grayscale value corresponding to the maximum grayscale from the cumulative values smaller than the value of the threshold determination value storage register 2523. The output of the selector 2524 corresponds to the pixel extension coefficient obtained from the display data for one frame.

The adder 2525 adds the output of the selector 2522 and the output of the register 2506 in the histogram counter 2504, and outputs to the selector 2524 and the adder 2526. More specifically, when the value of the counter 2505 is equal to or larger than the value of the threshold value storage register 2521, the sum of the values of the counter 2505 and the counter 2506 is output, and when the value of the counter 2505 is smaller than the value of the threshold value storage register 2521, the value of the counter 2506 is output.

Similarly, the values of the adders 2526 to 2539 become the cumulative value from the grayscale 255 to the grayscale corresponding to the corresponding counter when the value of the counter 2505 is equal to or larger than the value of the threshold value storage register 2521, and the values of the adders 2526 to 2539 become the cumulative value from the grayscale 253 to the grayscale corresponding to the corresponding counter excluding the grayscales 255 and 254 when the value of the counter 2505 is smaller than the value of the threshold value storage register 2521.

The registers 2540, 2542, 2544, and 2546 are registers for holding the cumulative value of the pixel extension coefficients for the most recent four frames. Further, the adders 2541, 2543 and 2545 and the divider 2547 are provided so as to take the average of the pixel extension coefficients of the most recent four frames.

The adder 2541 is an adder for adding the output of the selector 2524 and the output of the register 2540 and outputting the same to the register 2542. Also, the adder 2543 is an adder for adding the output of the selector 2524 and the output of the register 2542 and outputting the same to the register 2544, and the adder 2545 is an adder for adding the output of the selector 2524 and the output of the register 2544 and outputting the same to the register 2546.

In the present embodiment, the divider 2547 is a divider for dividing by four. The division by four is carried out so as to obtain the average value of the most recent four frames, and if it is intended to increase the target to be cumulated of the pixel extension coefficients of the most recent frame, the divider is increased accordingly.

Hereinafter, the operation of the histogram cumulative value calculating circuit 2106 will be described based on the circuit configuration mentioned above.

When the frame SYNC signal is input to the histogram cumulative value calculating circuit 2106, the histogram counter 2504 is reset. In other words, the sixteen counters 2505 to 2520 in the histogram counter 2504 become 0.

Next, the display data is transferred from the input/output interface circuit 2105 to the RGB maximum value extracting circuit 2501 by one pixel at a time. In the RGB maximum value extracting circuit 2501, the maximum value of the grayscales of the data of R (red), G (green), and B (blue) is selected and output to the selector 2503.

The selector 2503 compares the output of the RGB maximum value extracting circuit 2501 and the value of the histogram boundary setting register 2502. An example of setting the histogram boundary setting register 2502 will be described with reference to FIG. 28.

After obtaining the output of the RGB maximum value extracting circuit 2501, the selector 2503 checks in which range of the count up value the output value exists. Then, the output signal is determined so as to count up the counter corresponding to the range.

In the setting of FIG. 28, when the output of the RGB maximum value extracting circuit 2501 is 254 or 255, the output 2552 of the selector 2503 becomes active. The counter 2505 in the histogram counter 2504 is counted up. On the other hand, the output signal lines 2553 to 2563 do not become active, and the counters 2506 to 2520 in the histogram counter 2504 are not counted up.

On the other hand, when the output of the RGB maximum value extracting circuit 2501 is 253 or 252, the output 2553 of the selector 2503 becomes active, and other output signal lines 2552 and 2554 to 2563 do not become active. Thus, only the counter 2506 in the histogram counter 2504 is counted up.

Further, when the output of the RGB maximum value extracting circuit 2501 is smaller than "200" (minimum count up range of the counter 2520), any of the outputs 2552 to 2563 does not become active, and the counters 2505 to 2520 are not counted up.

As described above, the output of the selector 2503 is determined in accordance with the setting value of the histogram boundary setting register 2502 and the output of the RGB maximum value extracting circuit 2501. As a result, each counter in the histogram counter 2504 is appropriately counted up.

In this manner, the number of pixels for each boundary set in the histogram boundary setting register 2502 is accumulated in the histogram counter 2504 when the display data for one frame is input.

Next, the operation of the coefficient calculating circuit 2107 will be described.

The coefficient calculating circuit 2107 obtains the pixel extension coefficient by the calculating operation from the value of each counter obtained by the histogram cumulative value calculating circuit 2106. The detailed calculating operation method will be described below.

When the value of the counter 2505 is smaller than the value of the threshold value storage register 2521, the selector 2522 outputs "0", and the selector 2522 outputs the value of the counter 2505 when the value of the counter 2505 is equal to or larger than the value of the threshold value storage register 2521. Thus, the output of the adder 2525 becomes the sum of the values of the counter 2505 and the counter 2506 when the value of the counter 2505 is equal to or larger than the value of the threshold value storage register 2521, and it becomes the value of the counter 2506 when the value of the counter 2505 is smaller than the value of the threshold value storage register 2521.

Similarly, the values of the adders 2526 to 2539 are the cumulative values of corresponding counter values from the grayscale 255 to the grayscale corresponding when the value of the counter 2505 is equal to or larger than the value of the threshold value storage register 2521, and the values of the adders 2526 to 2539 are the cumulative values of corresponding counter values from the grayscale 253 to the grayscale corresponding excluding the grayscales 255 and 254 when the value of the counter 2505 is smaller than the value of the threshold value storage register 2521.

The selector 2524 compares the cumulative values 2525 to 2539 from the grayscale 253 to the grayscale corresponding to the corresponding counter and the value of the threshold determination value storage register 2523, and outputs the grayscale value corresponding to the minimum grayscale from the cumulative values smaller than the value of the threshold determination value storage register 2523. The output of the selector 2524 becomes the pixel extension coefficient of the frame obtained from the display data for one frame.

However, if the pixel extension coefficient and the backlight luminance and the grayscale luminance characteristics obtained from the pixel extension coefficient are determined with only one frame, the fluctuation of the luminance occurs and the flickers occur in some cases.

Therefore, the pixel extension coefficients of the most recent four frames are added in the registers 2540, 2542, 2544 and 2546, and the average of each pixel extension coefficient is obtained in the divider 2547. By this means, the fluctuation of the luminance for each one frame reduces, the occurrence of the flickers is suppressed, and a satisfactory display state can be obtained.

The averaged pixel extension coefficient is output to the backlight controller 2108 and the pixel extending circuit 2109 as the final pixel extension coefficient.

Figure 29:
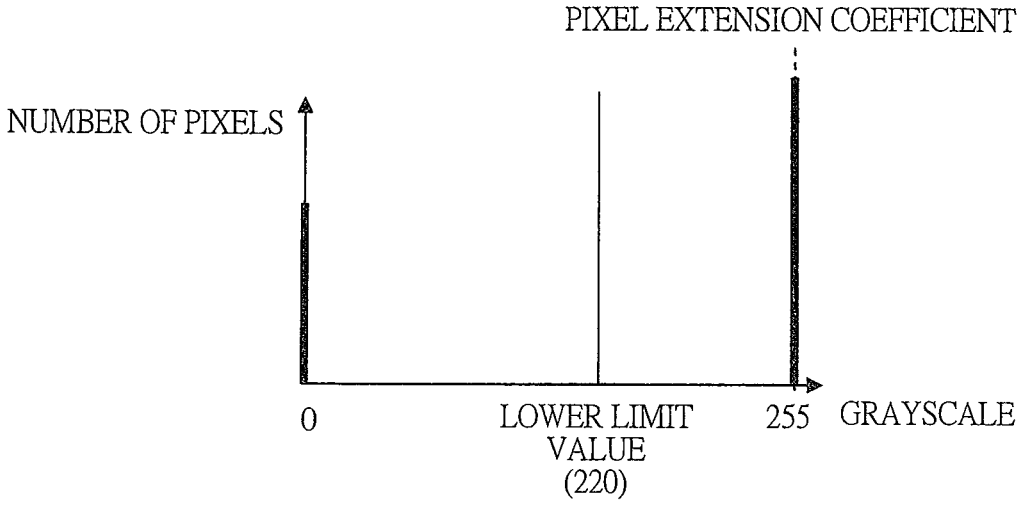
FIG. 29 is a view showing an example of a histogram of a binary image of black and white related to the description of the eleventh embodiment of the present invention.

The case where the circuit of the eleventh embodiment is applied to a binary image in which black characters are written on a white background will be considered. In the case of a binary value such as a monotone image, the histogram of FIG. 29 is obtained. In this case, since the number of pixels of the grayscale 255 becomes sufficiently large, in the present invention, the selector 2522 outputs the value of the register 2505, and the value of the adder 2525 becomes larger than the value of the threshold determination value storage register 2523. Therefore, the selector 2524 outputs the maximum grayscale value 255 as the pixel extension coefficient. As a result, the luminance of the white background is not lowered, and the screen does not become darker.

Figure 30:
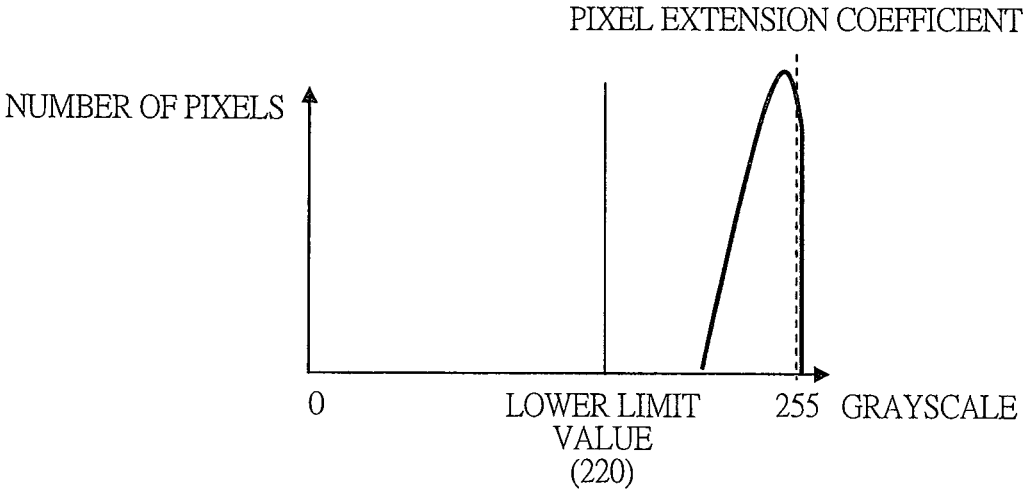
FIG. 30 is a view showing an example of a histogram of an image having high luminance and slight shade related to the description of the eleventh embodiment of the present invention.

In an image in which the luminance is high and a slight shade is included such as an image of cloud or snow, the histogram of FIG. 30 is obtained. In this case, since the number of pixels of grayscale 253 is sufficiently large, the value of the adder 2525 becomes larger than the value of the threshold determination value storage register 2523. Therefore, since the selector 2524 outputs the maximum value 255 of the grayscale as the pixel extension coefficient, the luminance of the white background is not lowered, and the screen does not become darker.

In the present embodiment, in the case of the setting value of the threshold value storage register 2521 is set to "0", the output of the selector 2522 always becomes the value of the register 2505 if a value of 1 or larger is in the register 2505. Therefore, the threshold value storage register 2521 can be used as a register for specifying whether or not the number of pixels of the grayscale 255 and the grayscale 254 is calculated.

Also, the configuration in which the CPU 2102 can rewrite the threshold value storage register 2521 of the present invention is possible. For example, in the case of the document data including many binary images, the value of the threshold value storage register 2521 is set relatively small, and in the case of an image including many light source projections such as a display of the television image, the value of the threshold value storage register 2521 is set relatively large. In this manner, the power reduction can be achieved without degrading the image quality.

Figure 31:
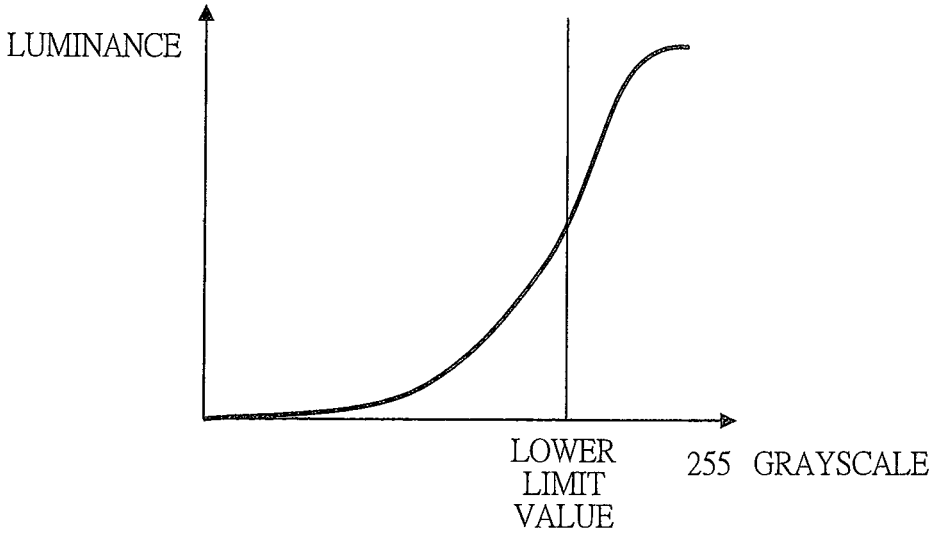
FIG. 31 is a view showing an example of a histogram of an image in which grayscale-luminance characteristics have an upper convex near the highest grayscale related to the description of the eleventh embodiment of the present invention.

Further, since the threshold determination value storage register 2523 can be rewritten by the CPU 2102, when the grayscale-luminance characteristics have an upper convex near the highest grayscale (255 grayscale) as shown in FIG. 31, the power reduction can be achieved by setting a large setting value to the threshold determination value storage register 2523.

Furthermore, even when the luminance of the backlight lowers due to aging, the luminance of the screen is prevented from being lowered too much by measuring the passage of time from the start of use and reducing the value of the threshold determination value storage register 2523 by the CPU at the point when predetermined time have passed.

In the present embodiment, the maximum value of the data of R, G, and B is selected in the RGB maximum value extracting circuit 2501 to obtain a histogram, but the present invention is not limited thereto. For example, the histogram may be calculated using the luminance calculated from the R, G, B data, or the histogram may be obtained using all the R, G, B data. Further, in accordance with the color properties of the display system, the histogram may be configured only by the color (usually G (green)) with which the color properties of high grayscale are visually influenced. The method of configuring the histogram does not restrict the present patent.

Further, in another configuration, the histogram is created for each of R, G, and B, and only for the color (usually B (blue)) with which the color properties of high grayscale are not visually influenced, the number of pixels of a specific grayscale including the highest grayscale may not be added to the cumulative value of the histogram. Alternatively, the color in which the number of pixels of a specific grayscale including the highest grayscale is not added to the cumulative value of the histogram may be plural in number (for example, B (blue) and R (red)). By the configuration as described above, the power consumption reduction suited to the display characteristics of the display device can be realized without affecting the image quality.

Twelfth Embodiment

Next, a twelfth embodiment of the present invention will be described. The configuration of the entire display device of the present embodiment is similar to that of the eleventh embodiment. In the present embodiment, the configuration of the histogram cumulative value calculating circuit 2106 and the coefficient calculating circuit 2107 in the display driver 2101 is different from that of the eleventh embodiment. However, the input/output interface 2105, the pixel extending circuit 2109, the backlight controller 2108, the liquid crystal controller 2110, the drive circuit memory 2113, the timing control circuit 2114 and the like perform the same operation. Further, components other than the display driver 2101 also perform the same operation as the eleventh embodiment.

Figure 32:
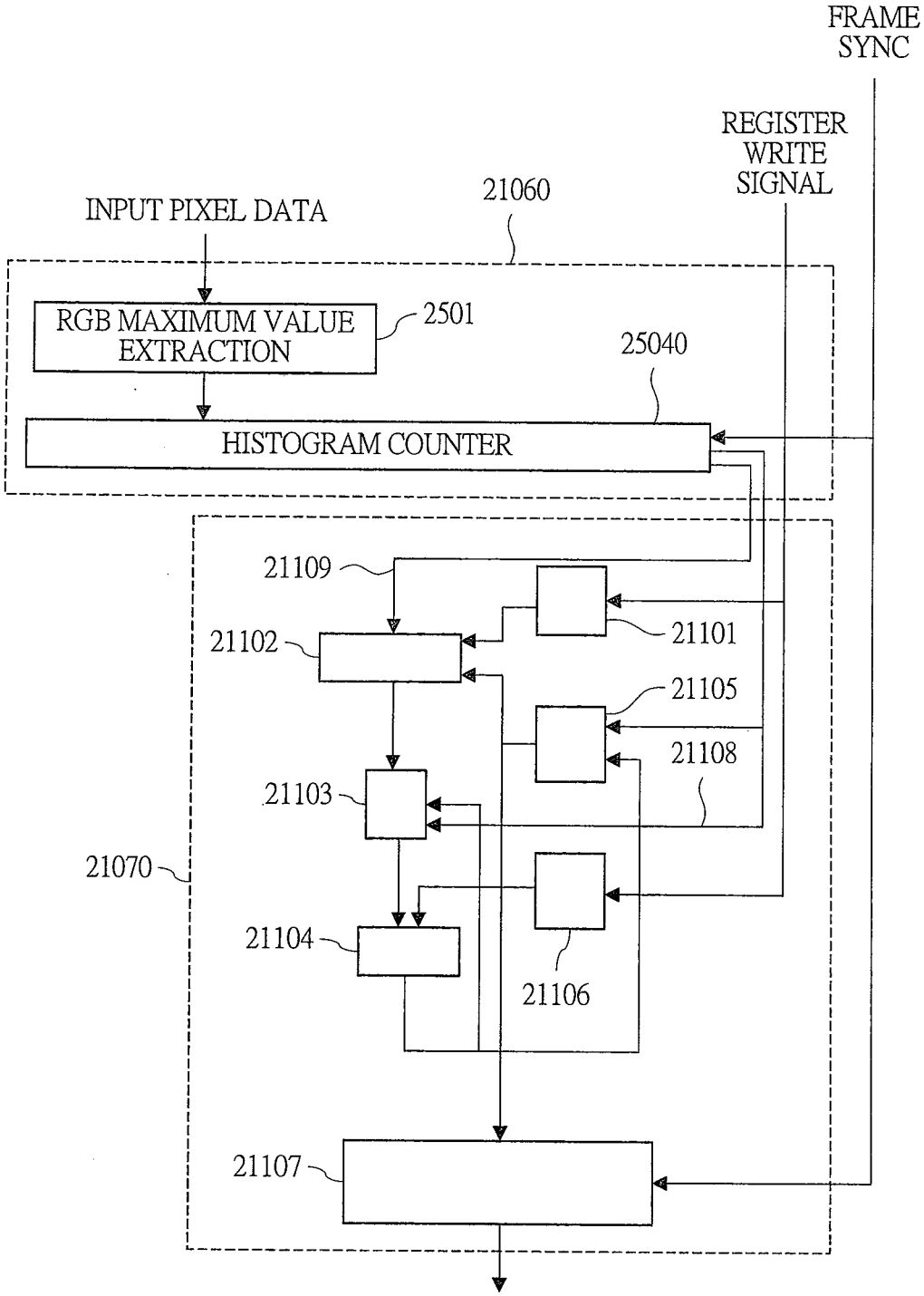
FIG. 32 is a block diagram of a histogram cumulative value calculating circuit and a coefficient calculating circuit according to a twelfth embodiment of the present invention.

The detailed block diagram of the histogram cumulative value calculating circuit 21060 and the coefficient calculating circuit 21070 of the twelfth embodiment is shown in FIG. 32.

The histogram cumulative value calculating circuit 21060 is configured of the RGB maximum value extracting circuit 2501 and the histogram counter 25040. Meanwhile, the coefficient calculating circuit 21070 is configured of the mode setting register 21101, the selector 21102, the adder 21103, the selector 21104, the counter 21105, the threshold determination value storage register 21106, and the averaging circuit 21107.

The RGB maximum value extracting circuit 2501 is a circuit which selects the maximum value from the data of red (R), green (G), and blue (B) of one pixel transmitted from the input/output interface circuit 2105, and outputs the same to the selector 2503, and it has the same circuit configuration as the eleventh embodiment.

The histogram counter 25040 creates a histogram from the display data for one frame. The histogram counter 25040 differs from the histogram counter 2504 of the eleventh embodiment in that the frame termination signal 21008 is output to the adder 21103 and the counter 21105 after terminating the creation of the histogram.

The mode setting register 21101 is a register which selects the mode of whether or not the count value of the maximum grayscale is included in the coefficient calculating operation. When the register is "1", the count value of the maximum grayscale is not included in the histogram, and when the register is "0", the count value of the maximum grayscale is included therein. The mode setting register 21101 is assumed to be rewritten with a register write signal used as a trigger.

The selector 21102 is a selector which outputs "0" when the mode register 21101 is at the mode "1" and the counter 21105 is 256, and outputs the histogram data 21109 as it is in other cases.

The adder 21103 is an adder which adds the output of the selector 21102 to the currently holding value, holds the same, and outputs the same with an internal clock (not shown) used as a trigger when the output of the selector 21104 is "0".

The selector 21104 is a selector which outputs "0" when the output of the adder 21103 is smaller than the value of the threshold determination value storage register 21106, and outputs "1" when the output of the adder 21103 is equal to or larger than the value of the threshold determination value storage register 21106.

The counter 21105 is a decrement counter which is preset to 256 by the frame termination signal 21108, and is decremented by one in synchronization with the internal clock when the output of the selector 21104 is "0" and the frame termination signal 1108 is "1". The counter 21105 operates with the rise of the internal clock used as the trigger.

The threshold determination value storage register 21106 is a register which stores a determination value for setting the minimum grayscale as the threshold grayscale when the histogram cumulative value is smaller than the value of the threshold determination value storage register 2523. The threshold determination value storage register 21106 has the same function as the threshold determination value storage register 2523 of the eleventh embodiment. Similar to the mode setting register 21101, the threshold determination value storage register 21106 is assumed to be rewritten with the register write signal as used a trigger.

The averaging circuit 21107 obtains the average value of the pixel extension coefficients of the most recent several frames so as to prevent flickers, and it has the configuration similar to the registers 2540, 2542, 2544 and 2546, the adders 2541, 2543 and 2545, and the divider 2547 of the eleventh embodiment.

Figure 33:
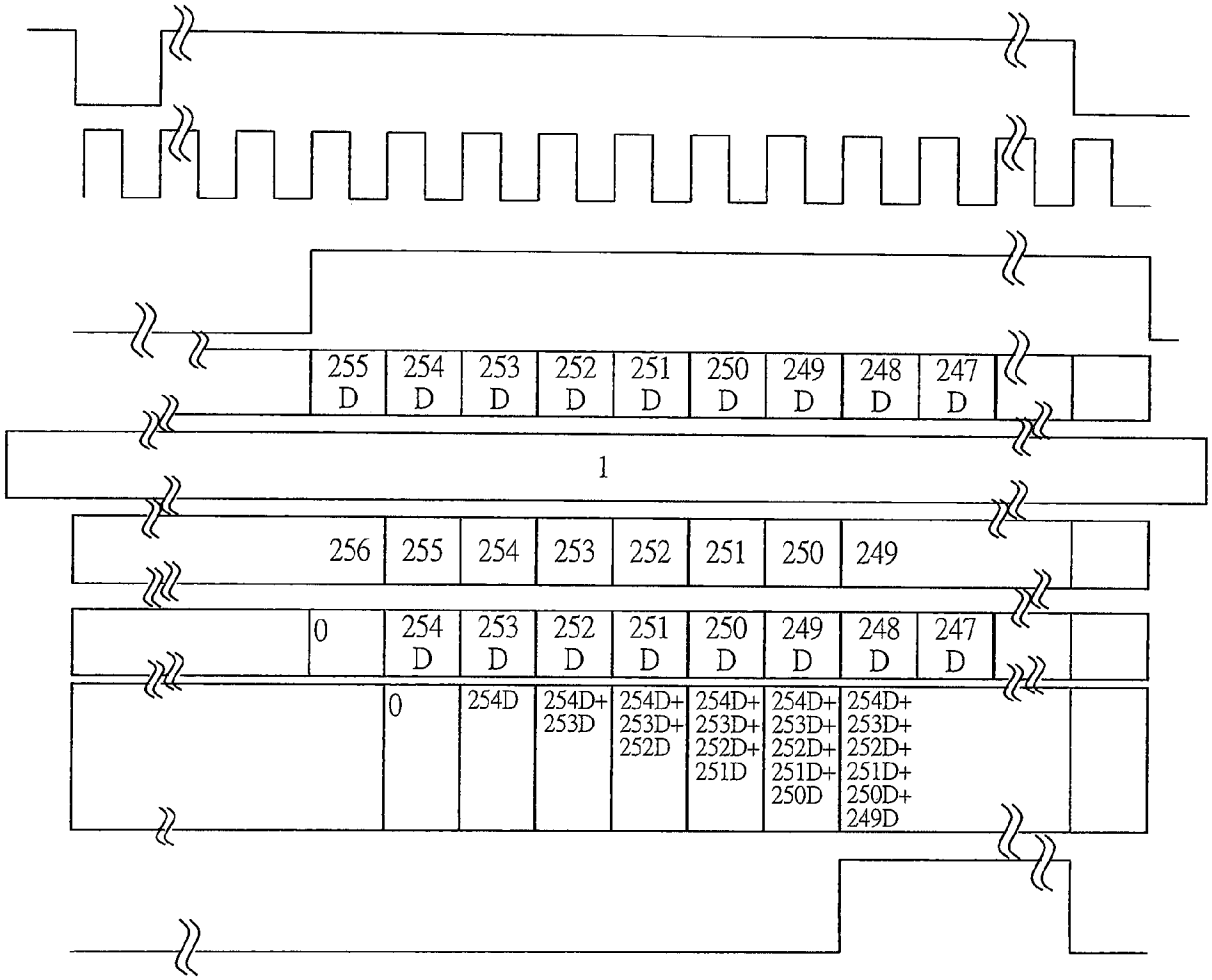
FIG. 33 is a timing chart showing an operation of the coefficient calculating circuit according to the twelfth embodiment of the present invention.

FIG. 33 is a timing chart showing the operation of the coefficient calculating circuit 21070 of the twelfth embodiment. The operation of the twelfth embodiment will be described in consideration of the above-mentioned configuration and the timing chart of FIG. 33.

The histogram counter 25040 outputs the frame termination signal 21108 when the creation of the histogram is completed. The histogram data 21109 is sequentially outputted by one grayscale at a time from the grayscale 255 in synchronization with the internal clock to the selector 21102.

The counter 21105 is preset to 256 by the frame signal and is decremented by one in synchronization with the internal clock when the output of the selector 21104 is "0" and the frame termination signal 21108 is "1", as described above.

When the frame termination signal 21108 is active ("1"), the output of the selector 21104 is "0". Therefore, when the frame termination signal 21108 becomes active ("1"), the counter 21105 starts to decrement by one from 256 at the timing of the rise of the internal clock.

In the operation condition of FIG. 33, the value of the mode setting register 21101 is "1". More specifically, the count value of the maximum grayscale is not included in the cumulative value of the pixel extension coefficient. Therefore, when the counter 21105 is 256, the output of the selector 21102 becomes "0", and the histogram value 255D at the grayscale 255 is not output. On the other hand, the histogram value of the grayscale 254 or lower has the operation condition of the selector 21102 because the counter 21105 becomes 255 or lower. Therefore, the output of the histogram counter is output by the selector 21102 in synchronization with the timing of the rise of the internal clock in a manner such as the following: the histogram value 254D of the grayscale 254; the histogram value 253D of the grayscale 253; . . . and the like.

When the output of the selector 21104 is "0", the adder 21103 adds the output of the selector 21102 to the currently holding value, holds the same, and outputs the same. Therefore, the output of the adder 21103 increases in a manner such as the following: "0" because the output of the selector 21102 is "0" at the first clock; "254D" because the output of the selector 21102 is "254D" at the second clock; and "254D+253D" because the output of the selector 21102 is "253D" at the third clock.

It is assumed here that the value of the threshold determination value storage register 21106 is larger than "254D+253D+252D+251D+250D" and smaller than "254D+253D+252D+251D+250D+249D". Since the selector 21104 has the operation condition when the output of the adder becomes "254D+253D+252D+251D+250D+249D", it outputs "1".

The operation condition of the counter 21105 is not satisfied due to the change in the output value of the selector 21104. Therefore, the counter 21105 stops decrementing. Also, the operation condition of the adder 21103 is not satisfied, either. Therefore, the addition is also stopped and the current value is maintained. The value of the counter 21105 ("249" in FIG. 33) at this time is output as the pixel extension coefficient for one frame.

The pixel extension coefficient for one frame is output to the averaging circuit 21107. The value of the average of the pixel extension coefficients of plural frames is output to the backlight controller 2108 and the pixel extending circuit 2109 of FIG. 33 as the pixel extension coefficient.

By the operation as described above, in the twelfth embodiment, the CPU 2102 determines the application in the case of a binary image such a black character on a white background, so that "0" is written to the mode setting register 21101 and the pixel extension coefficient is determined while including the histogram value of the grayscale 255. Therefore, even in the binary image, a satisfactory image quality is maintained without lowering the luminance.

In the case of displaying images of a digital camera including many natural images, the CPU 2102 determines the application, so that "1" is written to the mode setting register 21101 and the pixel extension coefficient is determined while excluding the histogram value of the grayscale 255. Therefore, since the peak at the grayscale 255 is not taken in the calculation, power consumption can be reduced without greatly degrading the image quality.

Thirteenth Embodiment

Next, a thirteenth embodiment will be described.

Figure 34:
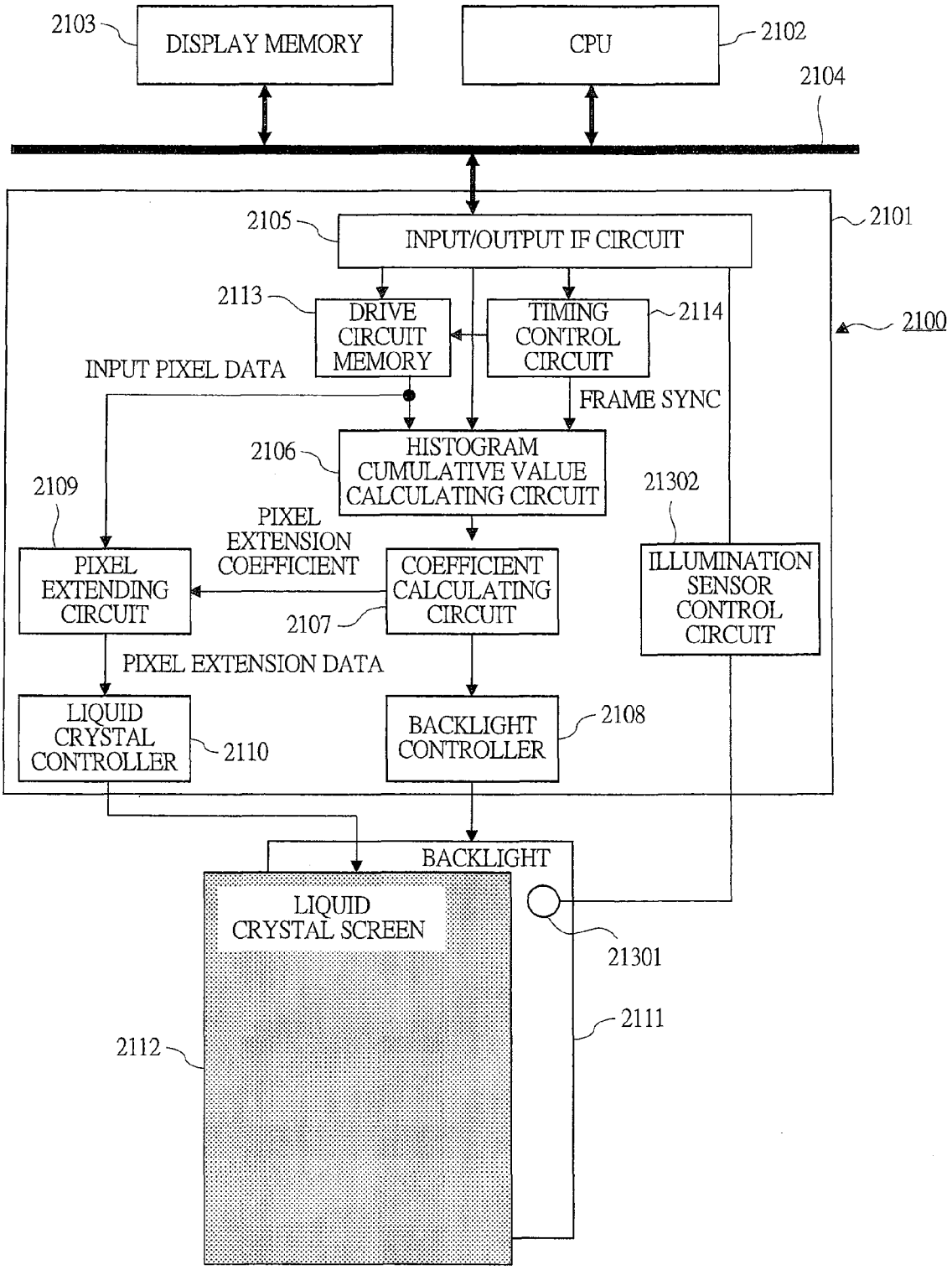
FIG. 34 is a block diagram of a display driver according to a thirteenth embodiment of the present invention.
Figure 35:
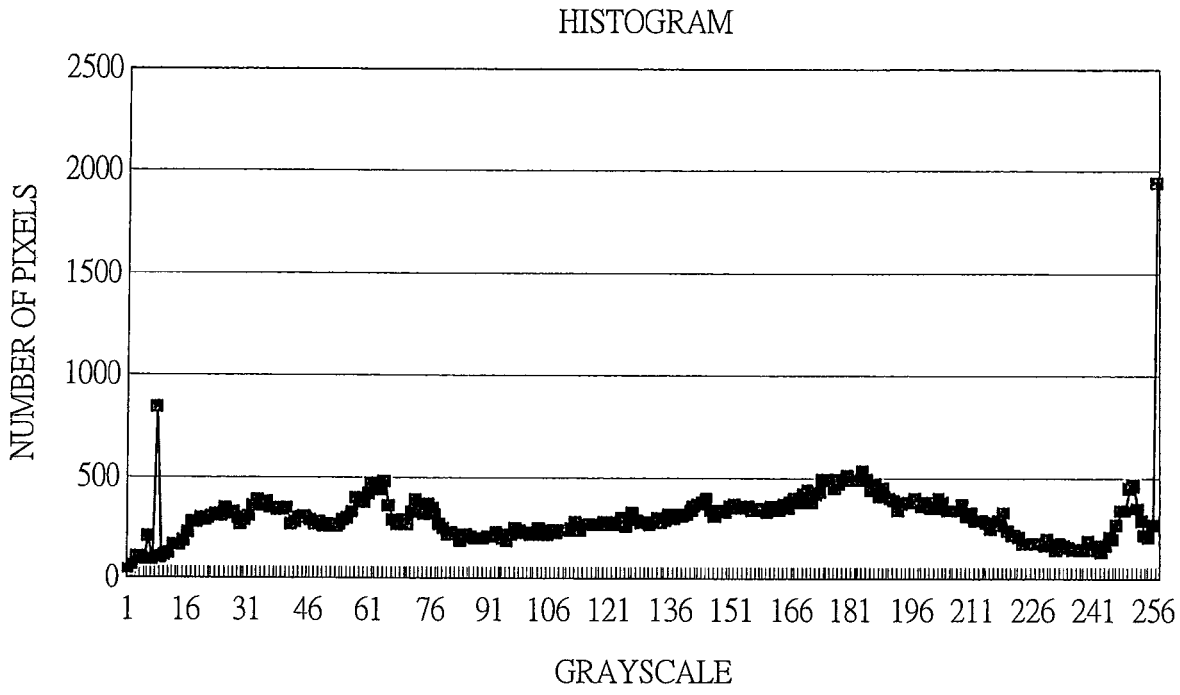
FIG. 35 is a view showing an example of a histogram having an outstanding peak at the maximum grayscale related to the description of the basis of the present invention.

FIG. 34 is a block diagram of the thirteenth embodiment.

The display device of the thirteenth embodiment differs from the eleventh embodiment in that an illumination sensor 21301 for measuring the illumination of the backlight 2111 and an illumination sensor control circuit 21302 for controlling the illumination sensor 21301 are provided in the display driver 2101.

In the thirteenth embodiment, the illumination of the backlight is acquired when the CPU 2102 issues a backlight illumination acquiring command through the input/output interface circuit 2105, and the illumination is notified to the CPU 2102. The CPU 2102 acquires the backlight illumination at the time of system activation or the like, and when the backlight illumination is large, the value of the threshold determination value storage register 2523 is increased to obtain a satisfactory power saving characteristics. Also, if the backlight illumination is lowered due to aging, the value of the threshold determination value storage register 2523 is decreased to prevent the illumination of the screen from being lowered too much.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention can be applied to a display device using a backlight and an element for controlling transmissivity of the liquid crystal and the like, for example, an electronic equipment such as a television, a personal computer or a cellular phone using a liquid crystal display device.

A liquid crystal display device will be described as an example of an image display device for displaying an image by irradiating a backlight on a display screen, but the application of the present invention is not limited thereto.

Figure 38:
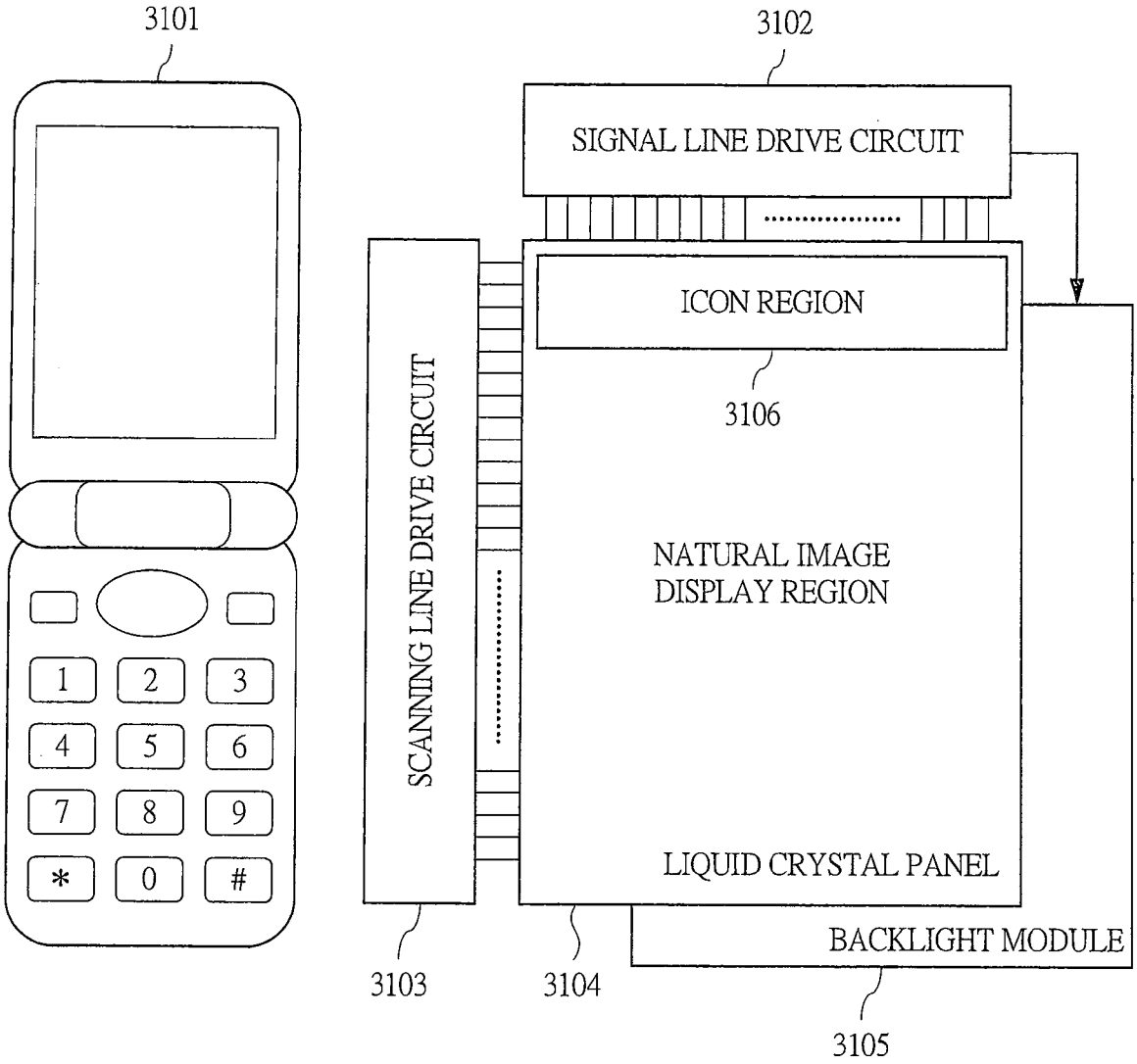
FIG. 38 is a conceptual view of the liquid crystal display device for describing the concept of the embodiment of the present invention.

FIG. 38 is a view for describing the concept of the embodiment of the present invention, and is a conceptual view of a liquid crystal display device in the case where a natural image of television or camera is displayed on a cellular phone.

In recent years, even on a cellular phone 3101, a natural image such as a television image or a camera image and an icon region 3106 including an operation button, a battery remaining amount, wave reception sensitivity and time are simultaneously displayed on a liquid crystal panel 3104. A signal line drive circuit 3102 and a scanning line drive circuit 3103 for driving the liquid crystal panel 3104 and a backlight module 3105 equally handle even the display data in which the icon region 3106 and the other natural image display region coexist.

The natural image generally tends to have a dark image source, and if applying the backlight control method proposed in Japanese Patent Application Laid-Open Publication No. 11-65531 when displaying only the natural image, the backlight emission amount can be reduced by about 30 or 40 percent in many cases. However, when simultaneously displaying a natural image and an icon, since many high-luminance pixels are contained in the icon, the backlight emission amount cannot be reduced with the same backlight control method.

When simultaneously displaying a natural image and an icon, if the backlight emission amount is reduced by 30 or 40 percent in the same manner as the case where only a natural image is displayed, the display luminance of the icon including high-luminance pixels is lowered. However, there is no problem if the icon can be distinguished from another image in a practical use. Even if the image quality of the icon degrades by reducing the backlight emission amount, the influence on the entire image display quality is small.

In the embodiment of the present invention, not limited to the icon display region, a region where the influence on the display quality is high or low in a display screen is distinguished from other regions, and the backlight emission amount is appropriately controlled while taking into account the influence on the display quality. For example, a region where the influence on the display quality is low includes a region in which an image with painted figure, an image with small number of grayscales (number of luminance levels), and an image with small grayscale change (luminance change) are displayed.

Fourteenth Embodiment

A drive circuit of a liquid crystal display device of a fourteenth embodiment of the present invention will be described with reference to FIG. 39 and FIG. 40. In the fourteenth embodiment, the icon region 3106 is disposed on the display screen as shown in FIG. 38, and weighting in accordance with the influence on the display quality is applied to the natural image display region and the icon region 3106 at a time of histogram counting, thereby controlling the backlight emission amount.

Figure 39:
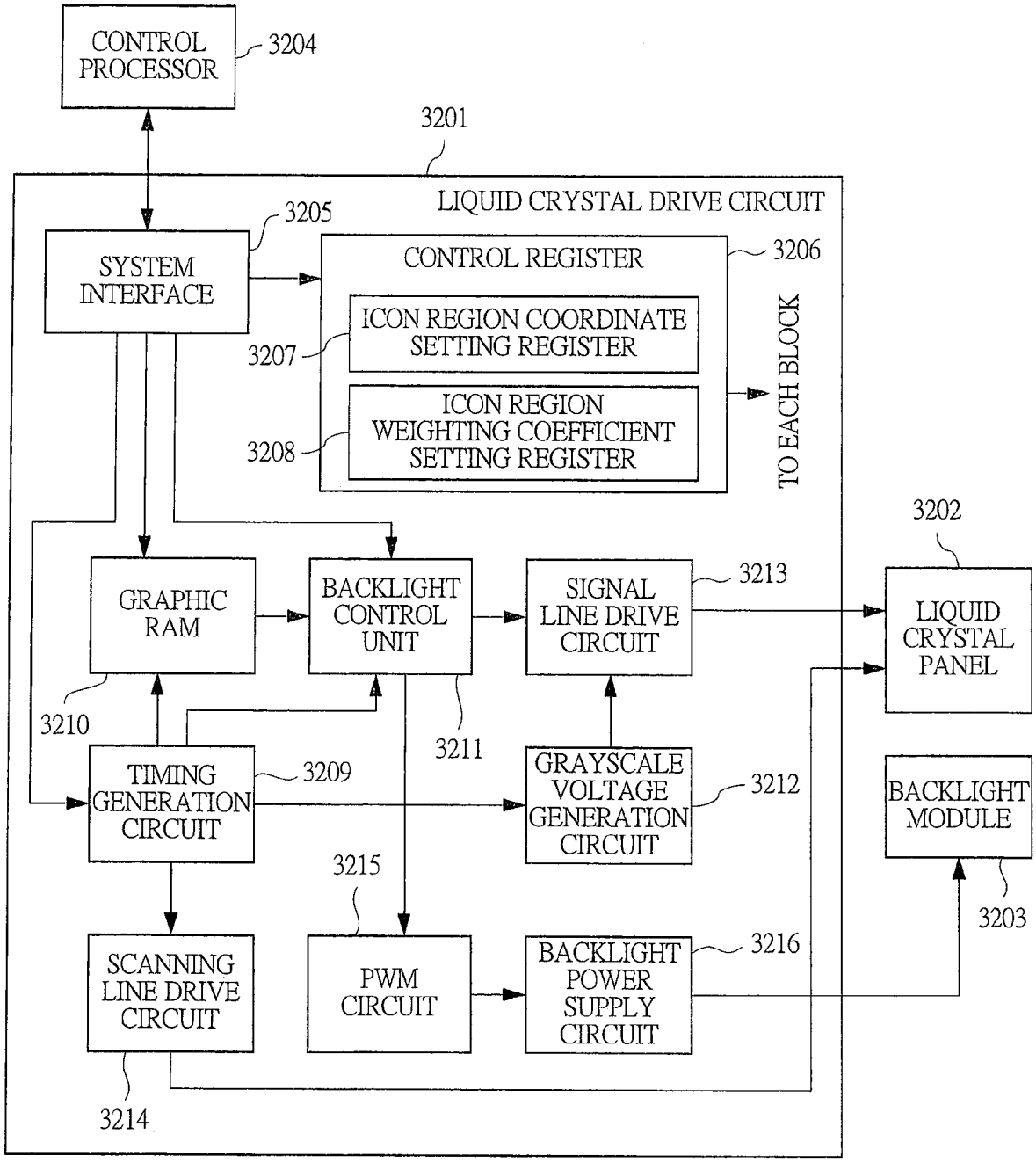
FIG. 39 is a view showing a configuration of a liquid crystal display device including the liquid crystal drive circuit according to a fourteenth embodiment of the present invention.
Figure 40:
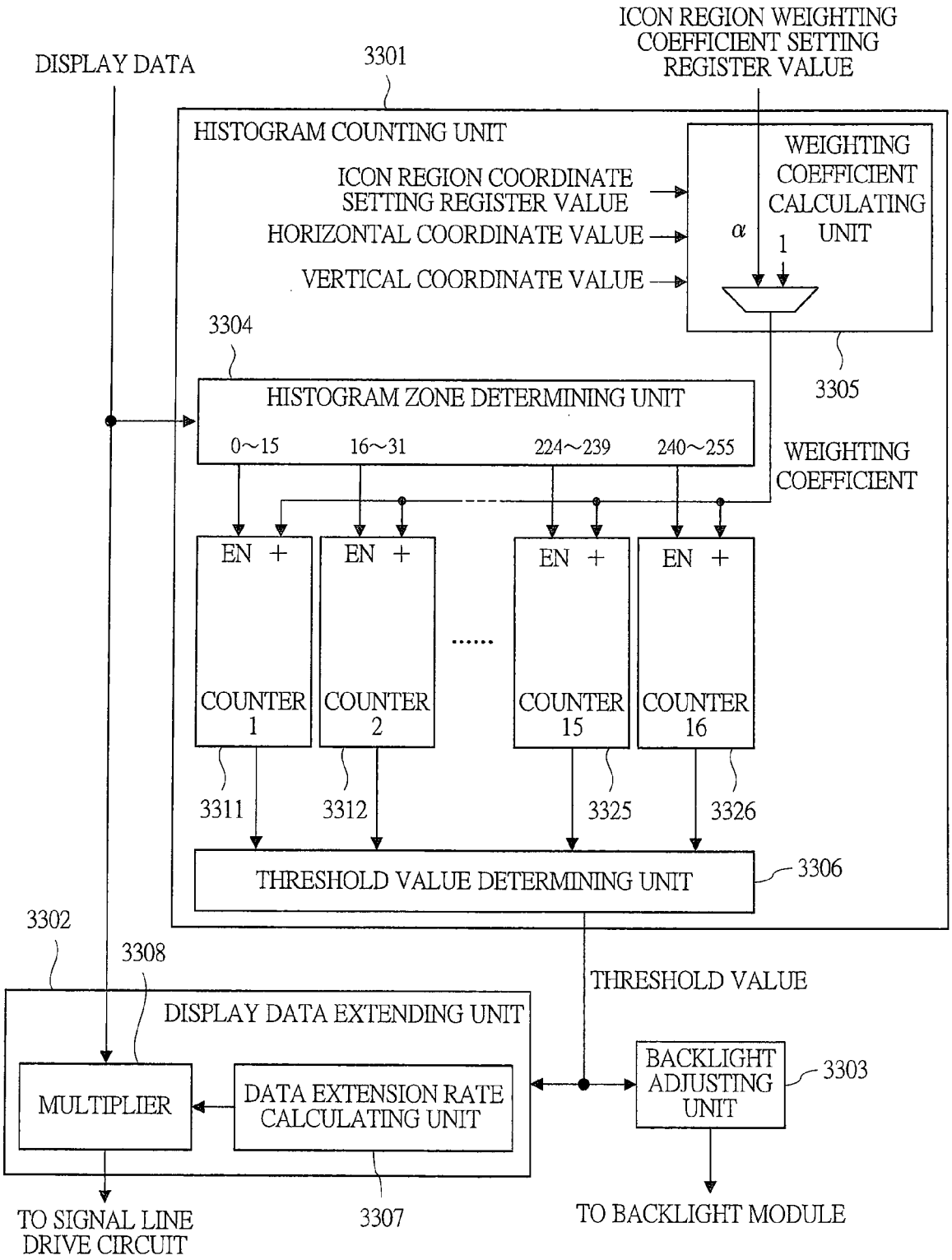
FIG. 40 is a view showing a configuration of the backlight control unit according to the fourteenth embodiment of the present invention.

FIG. 39 is a view showing a configuration of a liquid crystal display device including a liquid crystal drive circuit according to the fourteenth embodiment of the present invention. The liquid crystal display device is configured to have a liquid crystal drive circuit 3201, a liquid crystal panel 3202, a backlight module 3203, and a control processor 3204.

The display luminance of the liquid crystal panel 3202 is controlled by the level of voltage applied from the liquid crystal drive circuit 3201 described later, and the liquid crystal panel 3202 is defined as an active matrix panel in which a TFT is arranged for each pixel and a signal line and a scanning line are laid in a matrix form with respect thereto.

The liquid crystal drive circuit 3201 applies a scanning pulse for turning ON the TFT to the scanning line in the liquid crystal panel 3202 in a line-sequential manner, and applies a grayscale voltage for controlling the display luminance to the pixel electrode connected to a source terminal of the TFT via the signal line. Note that the effective value on the liquid crystal molecule of the liquid crystal panel 3202 changes by the grayscale voltage applied to the pixel electrode, and thus the display luminance is controlled.

The backlight module 3203 determines the light emission amount by the current amount flowing to the light emitting element configuring the backlight, and the light emitting operation thereof is ON/OFF controlled by the pulse signal input from outside, for example, from the liquid crystal drive circuit 3201. The control processor 3204 creates the display data of the image and transfers the same to the liquid crystal drive circuit 201.

The liquid crystal drive circuit 3201 is configured to have a system interface 3205, a control register 3206, a timing generation circuit 3209, a graphic RAM 3210, a backlight control unit 3211, a grayscale voltage generation circuit 3212, a signal line drive circuit 3213, a scanning line drive circuit 3214, a PWM circuit 3215, and a backlight power supply circuit 3216.

The system interface 3205 receives the display data and instruction transferred from the control processor 3204 and performs the operation to output the same to the control register 3206 described later. The instruction mentioned here is information for determining the internal operation of the liquid crystal drive circuit 3201, and it includes various parameters such as frame frequency, the number of drive lines, the number of colors, weighting coefficients when counting the histogram described later, and others.

The control register 3206 incorporates a latch circuit and transfers the coordinate information of the icon region and the weighting coefficient of the icon region received from the system interface 3205 to the backlight control unit 3211 described later. The control register 3206 is configured to have an icon region coordinate setting register 3207 and an icon region weighting coefficient setting register 3208.

The icon region coordinate setting register 3207 is a register for specifying the position of the icon region in the display screen, and it specifies the coordinates of two points corresponding to opposing corners of a rectangular region. The configuration of specifying one vertex of the rectangular region and lengths of a long side and a short side of the rectangle is also possible. The icon region weighting coefficient setting register 3208 is a register for specifying the weighting coefficient at the time of counting the histogram for the pixels in the icon region. When the weighting of the pixels in the icon region is increased with respect to the natural image region, a value larger than 1 is set in the icon region weighting coefficient setting register 3208, and a value smaller than 1 is set therein when the weighting is decreased.

The timing generation circuit 3209 has a dot counter and generates a line clock by counting the dot clocks. The timing of the data transfer from the graphic RAM 3210 to the backlight control unit 3211 and the output timing of the scanning line drive circuit 3214 are defined based on the line clock. The graphic RAM 3210 accumulates the display data transferred from the system interface 3205 and transfers the same to the backlight control unit 3211 described later.

The backlight control unit 3211 is a block taking a leading part in the liquid crystal drive circuit 3201 of the fourteenth embodiment, and it receives the display data transferred from the graphic RAM 3210, executes the extending process of the display data, and transfers the same to the signal line drive circuit 3213 described later. Further, the backlight control unit 3211 calculates and outputs the backlight setting value for controlling the backlight emission amount. The grayscale voltage generation circuit 3212 generates an analog grayscale voltage level for realizing plural grayscale displays.

The signal line drive circuit 3213 functions as a DA converter which converts the digital display data transferred from the backlight control unit 3211 to an analog grayscale voltage level in the built-in decoder circuit, level shifter, and selector circuit. The analog grayscale voltage obtained here is applied to the liquid crystal panel 3202, thereby controlling the display luminance thereof.

The scanning line drive circuit 3214 generates a scanning pulse that is line sequential to the scanning line in the built-in shift register in synchronization with the line clock transferred from the timing generation circuit 3209. Further, after the built-in level shifter converts the scanning pulse of a Vcc-GND level transferred from the shift register to a VGH-VGL level, the scanning line drive circuit 3214 outputs the scanning pulse to the liquid crystal panel 3202. Note that VGH is the voltage level at which the TFT is turned ON, and VGL is the voltage level at which the TFT is turned OFF.

The PWM circuit 3215 modulates the backlight setting value transferred from the backlight control unit 3211 to a pulse width. More specifically, the PWM circuit 3215 counts the dot clock transferred from the timing generation circuit 3209 with the built-in counter, and compares the counter value and the above-described backlight setting value with the built-in comparator. By this means, the backlight control pulse that becomes a high voltage during the clock time equivalent to the backlight setting value is generated.

The backlight power supply circuit 3216 converts the backlight control pulse of the Vcc-GND level transferred from the PWM circuit 3215 to the operation voltage of the backlight module 3203 with the built-in level shifter. The backlight control pulse after the voltage conversion is input to the backlight module 3203, but the light amount thereof is not always constant and is controlled in accordance with the display data.

Next, the operation in the backlight control unit 3211 will be described. FIG. 40 is a view showing a configuration of the backlight control unit 3211 according to the fourteenth embodiment. The backlight control unit 3211 is configured to have the histogram counting unit 3301, the display data extending unit 3302, and the backlight adjusting unit 3303.

The histogram counting unit 3301 is configured to have the histogram zone determining unit 3304, the weighting coefficient calculating unit 3305, the threshold value determining unit 3306, and counters 1 to 16 (3311 to 3326). The histogram counting unit 3301 acquires histogram by counting the display data in units of frame of the display image and performs a process of calculating the threshold value corresponding to the value of the display data at a specific upper position of the histogram.

The histogram zone determining unit 3304 determines the zone of the histogram in accordance with the grayscale value of the input display data. FIG. 40 shows the case of dividing the grayscales from 0 to 255 into sixteen zones and counting the appearance frequency of each of the sixteen grayscale zones. For example, if the grayscale value of the input display data is within the range of 0 to 15, the histogram zone determining unit 3304 sends an enable signal to the counter 1 (3311) for counting the appearance frequency of the grayscale values 0 to 15 to count up the counter 1 (3311).

The weighting coefficient calculating unit 3305 determines whether the input display data is the pixel belonging to the icon region on the display screen or the pixel belonging to the other region, and then it calculates the weighting coefficient corresponding to the belonging region and outputs the same to the counters 1 to 16 (3311 to 3326). The icon region is assumed to hold two points of coordinates which are specified by the icon region coordinate setting register 3207, define the region where the icon is displayed with a rectangular region, and are located at opposing corners of the rectangular region.

The coordinate information of the rectangular region set in the icon region coordinate setting register 3207 and the horizontal coordinate value and vertical coordinate value of the display data are input to the weighting coefficient calculating unit 3305, and the weighting coefficient calculating unit 3305 determines whether the display data is in the rectangular region which is the icon region. When the display data is in the icon region, a holding value $\alpha$ of the icon region weighting coefficient setting register 3208 is output, and when the display data is outside the icon region, the value of 1 is output.

If the influence of the icon region on the display quality is lower than other region, the value smaller than 1 is set to the holding value $\alpha$ of the icon region weighting coefficient setting register 3208, and if the influence of the icon region on the display quality is higher than other region, the value larger than 1 is set thereto.

The threshold value determining unit 3306 is a circuit which calculates the threshold value to be a reference for determining a data extension rate from the values of the counters 1 to 16 (3311 to 3326) holding the histograms of each grayscale zone. The threshold value is a grayscale value corresponding to the position of upper several % in the histogram of the display screen.

The threshold value determining unit 306 first calculates the total value of the values held in the counters 1 to 16 (3311 to 3326) and then outputs a value of 255 if the holding value of the counter 16 (3326) is larger than several % of the total value. In other cases, if the sum of the holding values of the counter 16 (3326) and the counter 15 (3325) is a value larger than several % of the total value, the threshold value determining unit 306 outputs a value of 239. By repeating the calculation as described above from a higher value of each grayscale zone toward a lower value, the grayscale value corresponding to the position of upper several % in the histogram of the display screen is calculated, and the calculated grayscale value is output as the threshold value.

The counters 1 to 16 (3311 to 3326) incorporate registers, and performs an operation of adding a numerical value input to a positive (+) terminal to the holding value in the register when an enable signal is input to an EN terminal. The counters 1 to 16 (3311 to 3326) correspond to a counter of dividing the grayscale of the display data to plural zones and counting the number of appearing pixels in the display data for each grayscale zone disclosed in the conventional technique of Japanese Patent Application Laid-Open Publication No. 11-65531. In the fourteenth embodiment, the number of appearing pixels is not simply counted, but the numerical value weighted in accordance with the influence of the display position on the display quality is added to the counter corresponding to each grayscale zone to which the display data belongs.

The register holding value of the counters 1 to 16 (3311 to 3326) is reset to 0 at the beginning of one frame period, and the addition process described above is repeated in each one frame period to count the histogram, but the addition process may be performed in plural frame periods.

The display data extending unit 302 is configured to have a data extension rate calculating unit 3307 and an multiplier 3308, and performs a process of extending each display data based on the threshold value.

The data extension rate calculating unit 3307 calculates the data extension rate, which is the coefficient for extending the display data, from the threshold value calculated in the threshold value determining unit 3306 of the histogram counting unit 3301 through an arithmetic operation of (maximum value of display data)/(threshold value). Therefore, when the input display data is the same value as the threshold value, the output of the multiplier 3308 described later becomes equal to the maximum value of the display data. The maximum value of the display data mentioned here is not the maximum value in the values of all pixels of the display image, but is a value such as 255 in the case of 8-bit grayscale or 63 in the case of 6-bit grayscale.

The multiplier 3308 calculates the product of the display data and the data extension rate and outputs the same to the signal line drive circuit 3213. When the product exceeds the above-mentioned maximum value of the display data, the maximum value of the display data is output. This is because even if the value exceeding the maximum value of the display data is input to the signal line drive circuit 3213, it is not displayable in the liquid crystal panel 3203.

The backlight adjusting unit 3303 performs a process of outputting a backlight setting value for determining the light emission amount of the backlight based on the threshold value. The backlight setting value is calculated so as to have the light emission amount that cancels out the extension of the display data in the display data extending unit 3302. The method of calculating the backlight setting value includes a method in which a table of the backlight setting value corresponding to the threshold value is defined in advance and the backlight setting value is calculated based on the table and a method in which the backlight setting value is calculated using a certain function having the threshold value as an input.

Next, the entire operation of the backlight control unit 3211 will be described in order. First, all the holding values of the registers of the counters 1 to 16 (3311 to 3326) are reset to 0 at the beginning of the one frame period.

When the display data is input to the backlight control unit 3211 with the horizontal coordinate value and the vertical coordinate value indicating the display position thereof, the weighting coefficient calculating unit 3305 determines whether or not the horizontal coordinate value and the vertical coordinate value are within the rectangular region which is the icon region specified by the icon region coordinate setting register 3207. Then, it outputs the weighting value set in the icon region weighting coefficient setting register 3208 to the counters 1 to 16 (3311 to 3326) if they are within the icon region, and outputs the value of 1 thereto if they are not within the icon region.

In the histogram zone determining unit 3304, the grayscale zone to which the display data belongs is determined from the grayscale value of the display data, and the enable signal for validating the addition process of the counter corresponding to the grayscale zone is output. Of the counters 1 to 16 (3311 to 3326), the counter which receives the enable signal adds the weighting coefficient output from the weighting coefficient calculating unit 305 to the register in the counter. By performing the calculation described above for each one pixel of the entire display screen, the histogram weighted in consideration of the influence on the display quality to the counters 1 to 16 (3311 to 3326) is acquired.

When the histogram is acquired, the threshold value determining unit 3306 calculates the grayscale value at a position of upper several % of the histogram, and outputs the same as the threshold value. The threshold value will be supplementary described here. The threshold value is used in the calculation of the extension rate of the display data in the data extension rate calculating unit 3307 of the display data extending unit 3302, and is used to control the backlight emission amount in the backlight adjusting unit 3303.

The data extension rate has the magnification at which the output from the multiplier 3308 of the display data extension rate 3302 becomes a maximum value of the display data when the grayscale value of the input display data is the same as the threshold value. Therefore, when the grayscale value of the input display data is equal to or lower than the threshold value, the luminance resolution remains even after the extension process in the multiplier 3308.

However, when the grayscale value of the input display data is equal to or larger than the threshold value, since the value larger than the maximum value of the display data cannot be input to the signal line drive circuit 3213, the output from the multiplier 3308 is fixed at the maximum value of the display data, and the luminance resolution disappears. Therefore, the threshold value is, of the grayscale values of the input display data, the boundary point between the region where the luminance resolution remains and the region where the luminance resolution disappears after the process in the backlight control unit 3211.

In the conventional technique, the grayscale value at the position of upper several % of the histogram is set as the threshold value, so that the ratio on the total number of pixels of the number of pixels ($\propto$ area) at which the grayscale value becomes equal to or larger than the threshold value in the display screen also becomes the same percentage. By adjusting the percentage, the area in which the luminance resolution disappears in the display screen can be adjusted.

In the fourteenth embodiment, since weighting in consideration of the influence on the display quality by the display position is applied when counting the histogram, the percentage used in calculating the threshold value from the histogram is not equal to the percentage of the pixels having the grayscale value of the threshold value or larger (=pixel in which luminance resolution disappears after data extending process) on the total number of pixels.

However, if a high luminance icon whose display is not important exists in the display screen, since the drive circuit of the fourteenth embodiment calculates the threshold value to be lower than the case of using the conventional technique, the data extension rate is increased and the backlight emission amount is lowered, and the power consumption can be reduced. To the contrary, if many high-luminance pixels exist in the region whose display is important, since the drive circuit of the fourteenth embodiment calculates the threshold value to be higher, the data extension rate is decreased and the degradation of the display quality can be prevented.

Based on the threshold value having the features as described above, in the display data extending unit 3302, the extension rate of the display data is determined by the data extension rate calculating unit 3307 and the display data is extended by the multiplier 3308. Further, in the backlight adjusting unit 3303, the backlight setting value for controlling the backlight emission amount is calculated and output.

According to the configuration and the operation described above, the influence on the display quality by the display position can be reflected on the histogram counting process. As a result, the influence on the display quality of the entire display screen can be appropriately controlled and reflected on the control of the backlight emission amount. Therefore, the power consumption reducing effect by the backlight control can be further enhanced while maintaining the display quality.

In the example of the fourteenth embodiment described above, on the basis that the influence on the display quality is low even if the luminance resolution in the icon display region at the end portion of a screen is lowered by the backlight control, the control is performed so as to lower the influence on the histogram counting process by the display data in the rectangular region in which the icon at the end portion of the screen is displayed. However, the setting position of the rectangular region is not limited to the icon display region and the end portion of the screen. Further, it is also possible to perform the control so that the influence on the histogram counting process by the display data of the pixels in the rectangular region is increased.

Further, in the fourteenth embodiment, an example of a liquid crystal panel for a mobile telephone has been described. However, the invention can also be applied to any liquid crystal panel for other applications. In the fourteenth embodiment, a direct liquid crystal display device in which the backlight source is disposed on the rear face and a screen is viewed through the liquid crystal panel has been described. However, the invention can also be applied to a projection liquid crystal display device such as a liquid crystal projector.

Fifteenth Embodiment

A drive circuit of a liquid crystal display device of a fifteenth embodiment of the present invention will be described with reference to FIG. 41 to FIG. 43. In the fifteenth embodiment, the display screen is divided into three regions, and weighting in accordance with the influence on the display quality is applied to each region when counting the histogram, thereby controlling the backlight emission amount.

Figure 41:
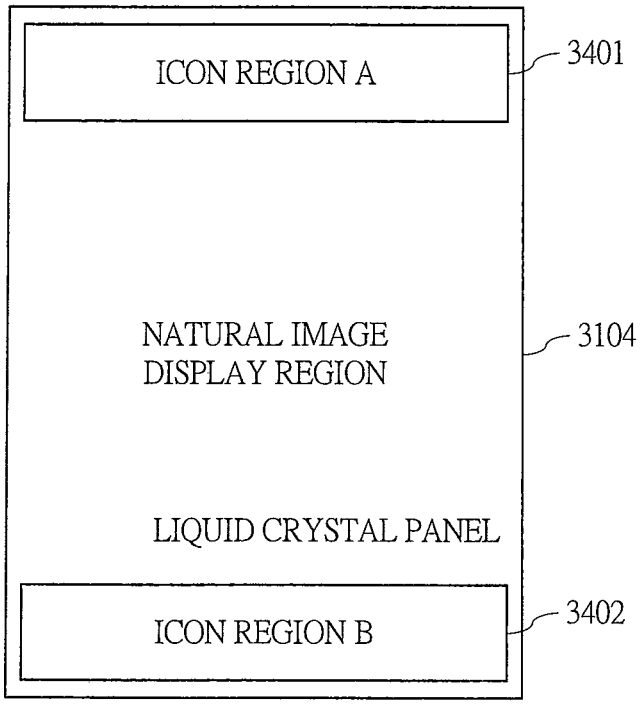
FIG. 41 is a view showing an example of a screen display of the liquid crystal display device according to a fifteenth embodiment of the present invention.
Figure 42:
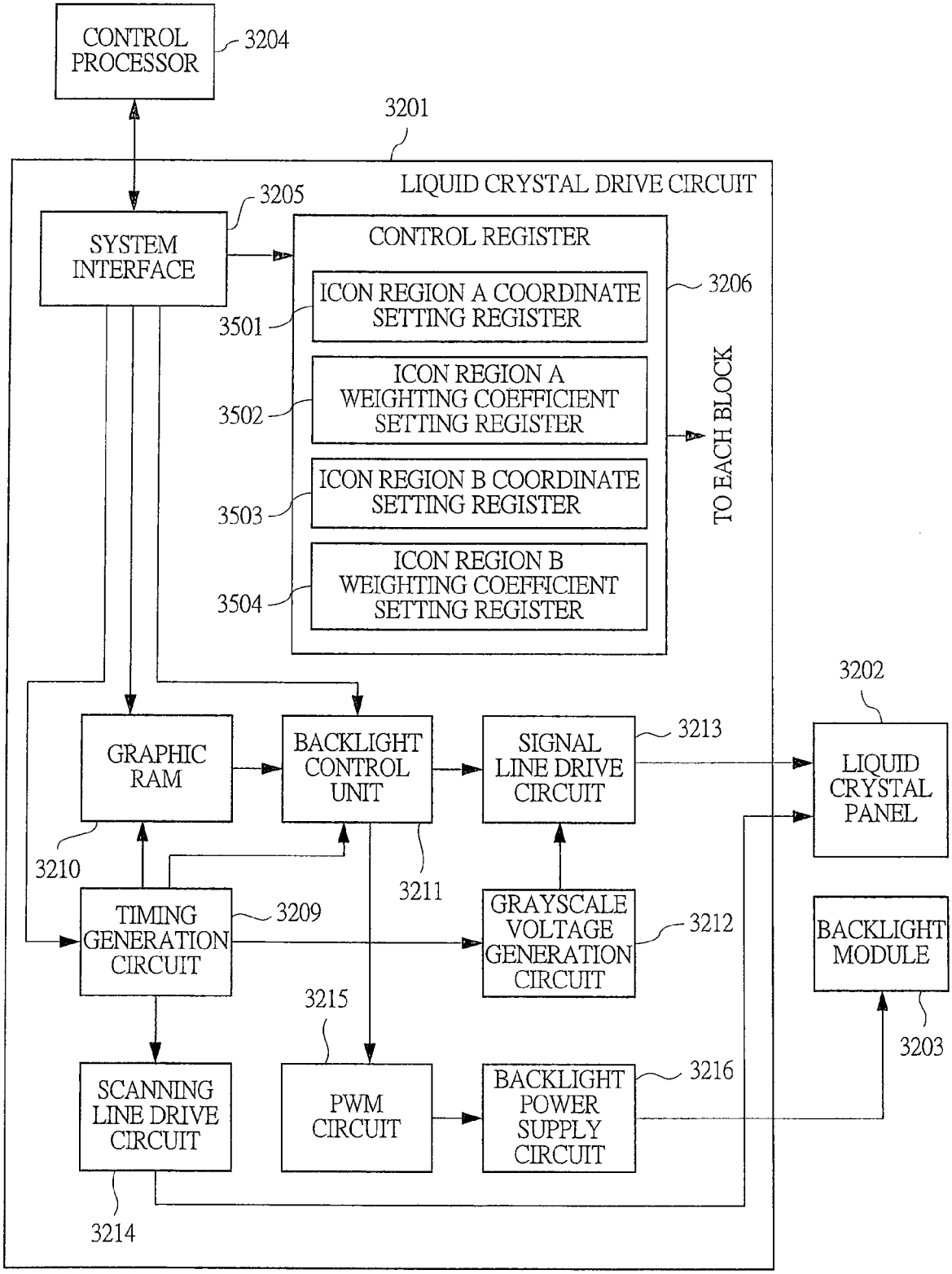
FIG. 42 is a view showing a configuration of the liquid crystal display device including a liquid crystal drive circuit according to the fifteenth embodiment of the present invention.

FIG. 41 is a view showing an example of a screen display of the liquid crystal display device according to the fifteenth embodiment. In this case, a natural image is displayed on the display screen of the liquid crystal panel 3104, and an icon region A3401 and an icon region B3402 for displaying the icon are disposed on the upper end and the lower end of the display screen.

Figure 45:
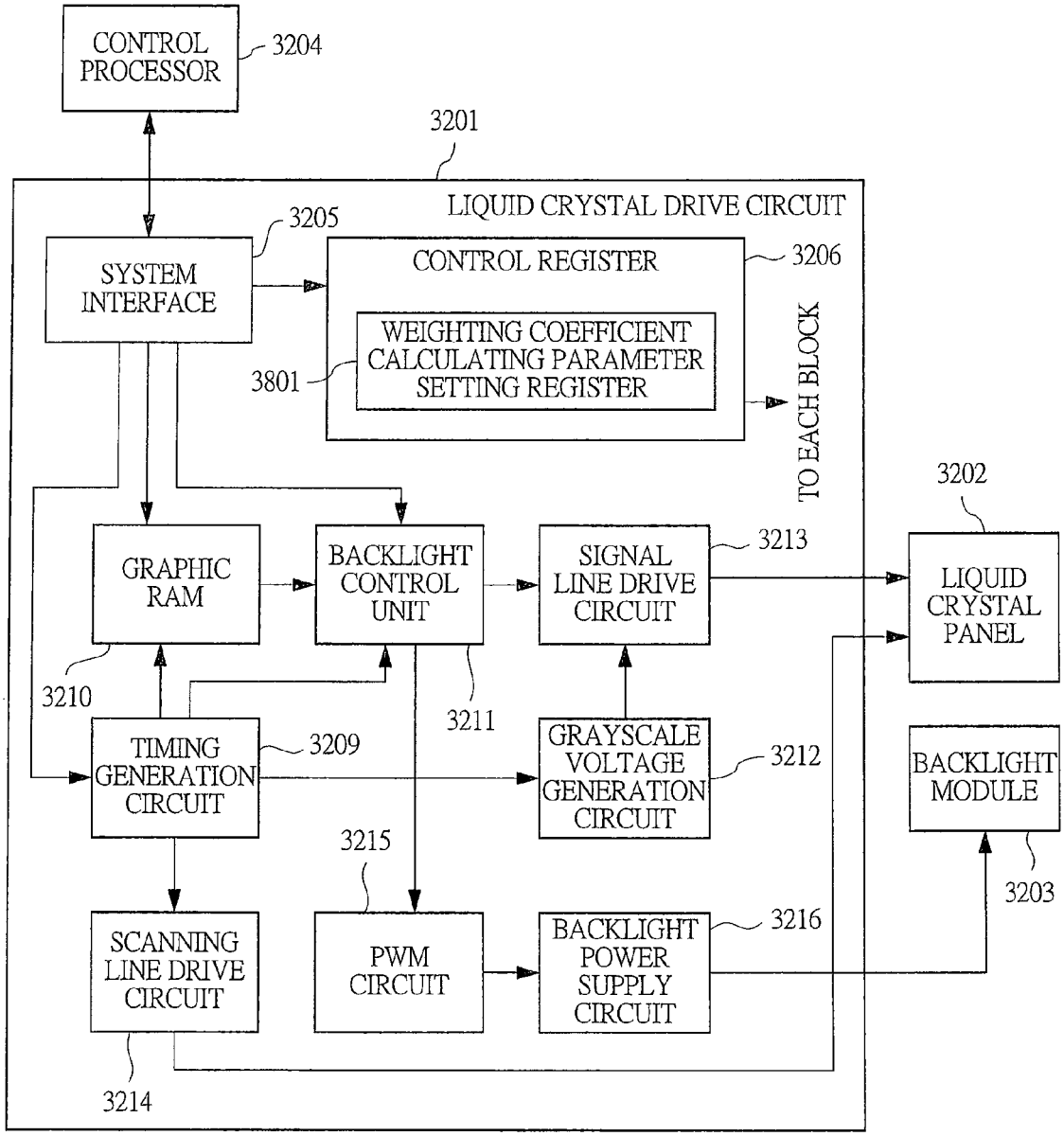
FIG. 45 is a view showing a configuration of a liquid crystal display device including a liquid crystal drive circuit according to the sixteenth embodiment of the present invention.

FIG. 45 is a view showing a configuration of a liquid crystal display device including the liquid crystal drive circuit in the fifteenth embodiment. The difference from the configuration of FIG. 39 in the fourteenth embodiment lies in that the number of registers included in the control register 3206 is increased. Since other blocks have the functions similar to those described in FIG. 39 in the fourteenth embodiment, the repetitive description thereof will be omitted.

The control register 3206 is configured to have an icon region A coordinate setting register 3501, an icon region A weighting coefficient setting register 3502, an icon region B coordinate setting register 3503, and an icon region B weighting coefficient setting register 3504.

The icon region A coordinate setting register 3501 is a register which specifies the position of a rectangular region of the icon region A501 in the display screen in FIG. 41, and the icon region A weighting coefficient setting register 3502 is a register which specifies the weighting coefficient in counting the histogram for the pixels in the icon region A3401 in FIG. 41. Similarly, the icon region B coordinate setting register 3503 is a register which specifies the position of a rectangular region of the icon region B3402 in the display screen in FIG. 41, and the icon region B weighting coefficient setting register 3504 is a register which specifies the weighting coefficient in counting the histogram for the pixels in the icon region B3402 in FIG. 41. The method of setting the coordinate and the weighting coefficient of each icon region is the same as that described in the fourteenth embodiment.

Figure 43:
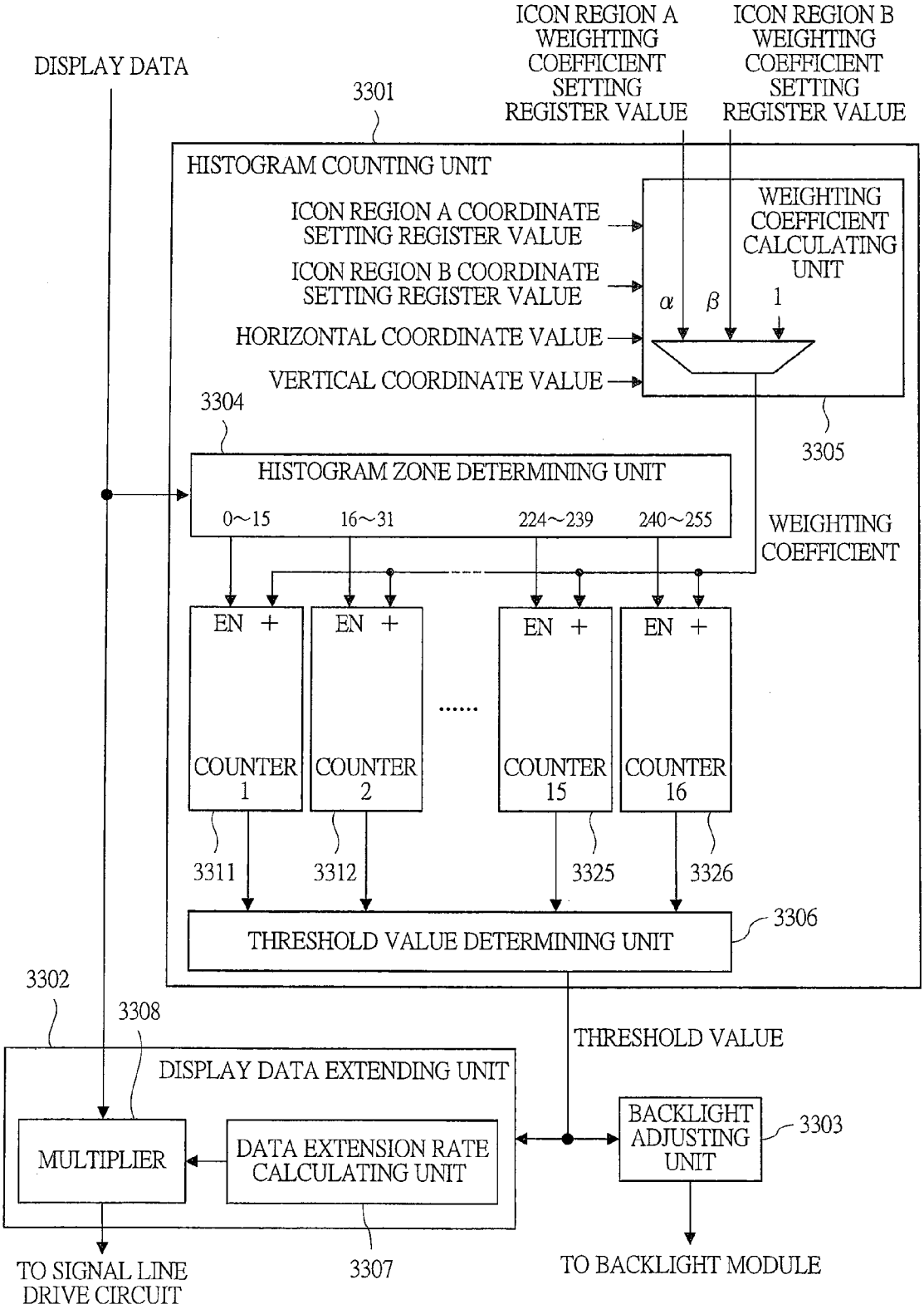
FIG. 43 is a view showing a configuration of the backlight control unit according to the fifteenth embodiment of the present invention.

FIG. 43 is a view showing a configuration of the backlight control unit 3211 in the fifteenth embodiment. The difference from the configuration of FIG. 40 in the fourteenth embodiment lies in that, since the number of registers included in the control register 206 is increased, the setting value of the register to be input to the weighting coefficient calculating unit 305 is increased. Since other blocks have the functions similar to those described in FIG. 40 in the fourteenth embodiment, the repetitive description thereof will be omitted.

The horizontal coordinate value and the vertical coordinate value of the display data are input to the weighting coefficient calculating unit 3305, and the weighting coefficient calculating unit 3305 determines whether the input display data belongs to the icon region A3401 or the icon region B3402. If the display data is in the region of the icon region A3401 specified by the value of the icon region A coordinate setting register 3501, the weighting coefficient $\alpha$ stored in the icon region A weighting coefficient setting register 3502 is output. If the display data is in the region of the icon region B3402 specified by the value of the icon region B coordinate setting register 3503, the weighting coefficient $\beta$ stored in the icon region B weighting coefficient setting register 3504 is output.

By the configuration as described above, when counting the histogram in the backlight control unit 3211, weighting can be performed using the respectively different weighting coefficients for the three regions of the icon region A3401, the icon region B3402, and the natural image region.

Although the case where the display screen is divided into two regions is shown in the fourteenth embodiment and the case where the display screen is divided into three regions is shown in the fifteenth embodiment, the display screen may be divided into four or more regions, and the number of regions is not limited thereto.

Sixteenth Embodiment

A drive circuit of the liquid crystal display device of a sixteenth embodiment of the present invention will be described with reference to FIG. 44 to FIG. 46. In the sixteenth embodiment, different from the fourteenth embodiment and the fifteenth embodiment, the weighting coefficient in counting the histogram is not set for each rectangular region, but the weighting coefficient is calculated using a function circuit having the horizontal and vertical coordinate values corresponding to the display data as input values.

Figure 44:
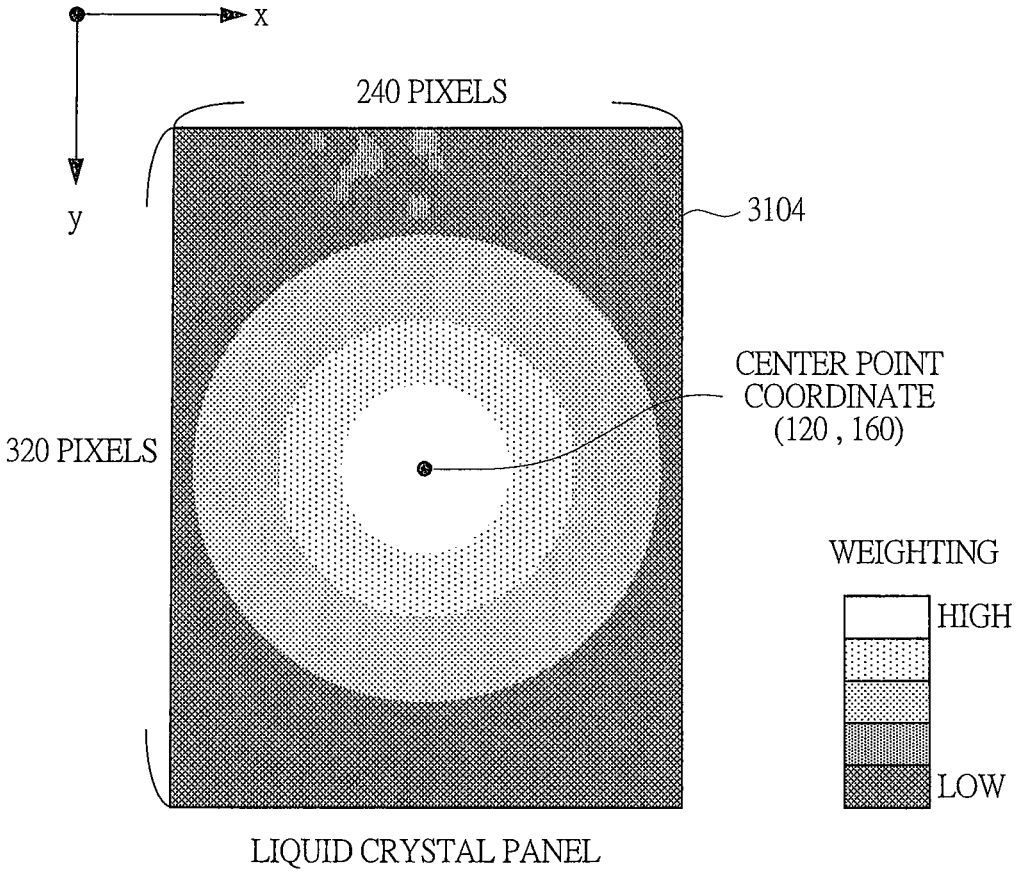
FIG. 44 is a view showing an example of distribution of weighting coefficients according to a sixteenth embodiment of the present invention.

FIG. 44 is a view showing an example of the distribution of the weighting coefficients in counting the histogram in the sixteenth embodiment, and this is an example of the distribution of the weighting coefficients set in view of the idea that the region close to the center of the display screen has high visibility and the influence on the entire display quality is high. Therefore, in the drive circuit according to the sixteenth embodiment, the weighting is controlled so that the weighting of the region close to the center of the display screen is increased and the weighting is lowered in accordance with the distance from the center in the histogram counting process. Hereinafter, the description will be made with using the display screen of QVGA size with 240 pixels in a horizontal direction and 320 pixels in a vertical direction as an example.

FIG. 45 is a view showing a configuration of a liquid crystal display device including the liquid crystal drive circuit of the sixteenth embodiment of the present invention. The difference from the configuration of FIG. 39 of the fourteenth embodiment lies in that the register included in the control register 3206 is replaced by the weighting coefficient calculating parameter setting register 3801. Since other blocks have the functions similar to those described in FIG. 39 in the fourteenth embodiment, the repetitive description thereof will be omitted. The weighting coefficient calculating parameter setting register 3801 holds the degree of slope, with which the weighting coefficient is lowered from the center towards the end portion of the display screen, as a numerical value.

Figure 46:
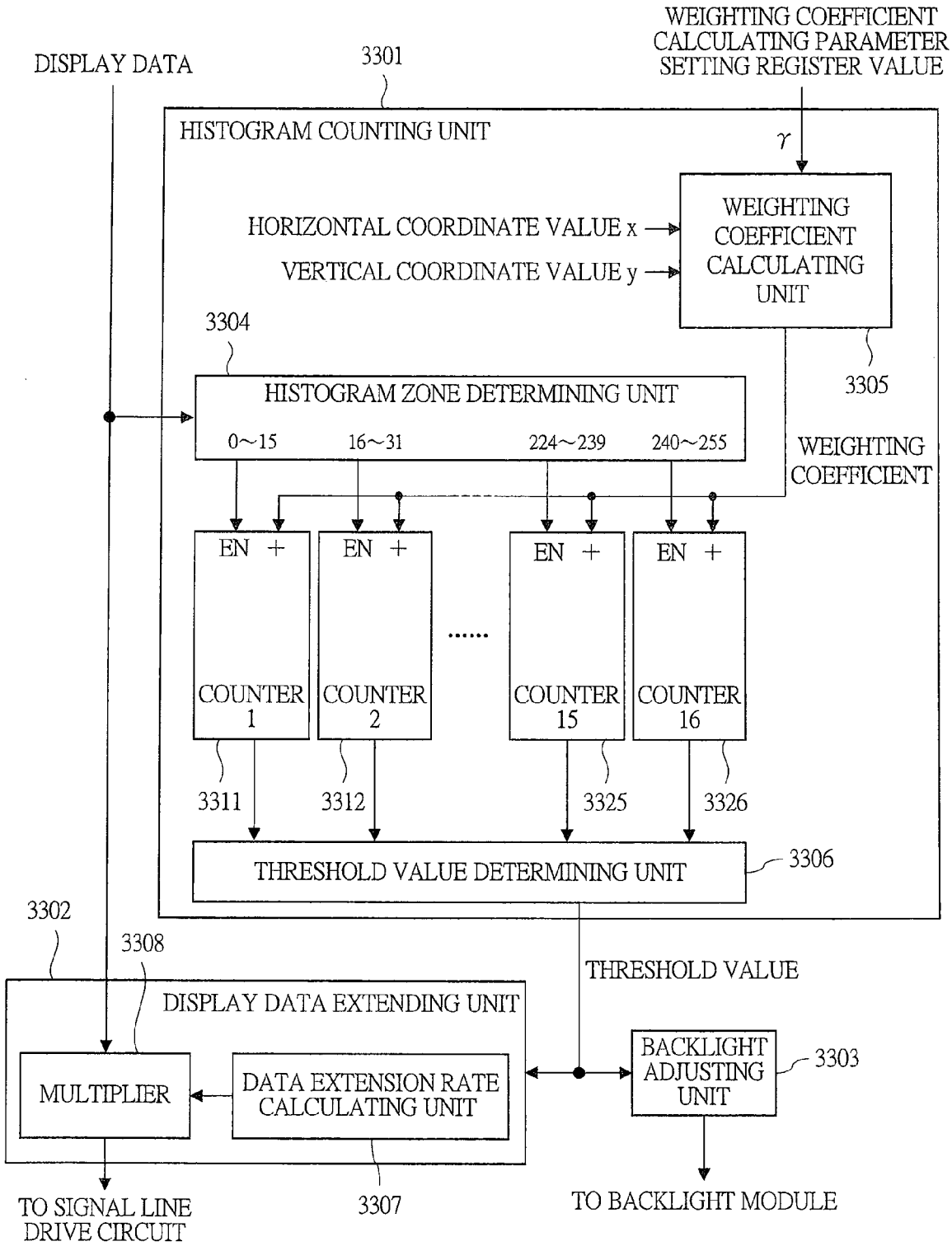
FIG. 46 is a view showing a configuration of the backlight control unit according to the sixteenth embodiment of the present invention.

FIG. 46 is a view showing a configuration of the backlight control unit 3211 according to the sixteenth embodiment. The difference from the configuration of FIG. 40 of the fourteenth embodiment lies in that, since the register included in the control register 3206 is replaced by the weighting coefficient calculating parameter setting register 3801, the setting value of the register to be input to the weighting coefficient calculating unit 305 changes. Since other blocks have the functions similar to those described in FIG. 40 in the fourteenth embodiment, the repetitive description thereof will be omitted.

The weighting coefficient calculating unit 3305 is a function circuit to which the horizontal coordinate value x and the vertical coordinate value y of the display data are inputted and which calculates the weighting coefficient based on the value γ of the weighting coefficient calculating parameter setting register 3801. In the weighting coefficient calculating unit 3305, the distribution of the weighting coefficients shown in FIG. 44 is calculated in accordance with the following equation.

$$\text{(Weighting coefficient)} = 1 - \gamma\sqrt{\frac{(x-120)^2 + (y-160)^2}{120^2 + 160^2}} \qquad \text{Equation 24}$$

In the equation 24, a Euclidean distance of the coordinate (x, y) of the display position and the coordinate (120, 160) of the center of the display screen is calculated and divided by the maximum distance to be normalized, and the resultant value is multiplied by the value γ held in the weighting coefficient calculating parameter setting register 3801, and then the resultant value is subtracted from 1. The weighting coefficient calculated by the equation 24 becomes smaller as the distance from the center point of the display screen increases, and the slope thereof can be externally adjusted by the value γ of the weighting coefficient calculating parameter setting register 3801.

Figure 47:
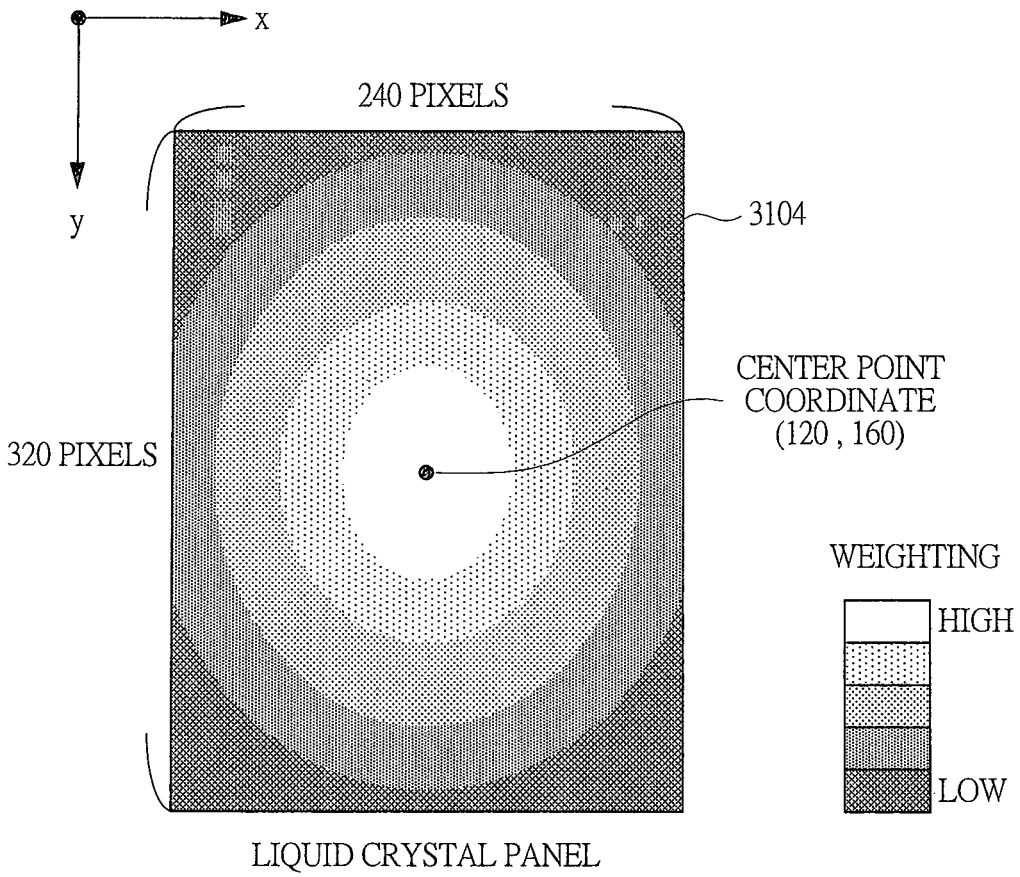
FIG. 47 is a view showing an example of distribution of weighting coefficients according to the sixteenth embodiment of the present invention.

Also, the equation 24 can be modified to the equation 25 so as to obtain the distribution of the weighting coefficients shown in FIG. 47.

$$\text{(Weighting coefficient)} = 1 - \gamma\sqrt{\frac{a^2(x-120)^2 + b^2(y-160)^2}{a^2 120^2 + b^2 160^2}} \qquad \text{Equation 25}$$

$$(a \neq 0,\ b \neq 0)$$

As described above, by adjusting the weighting coefficient to be lowered as the distant from the center point of the display screen increases, the probability that the luminance resolution disappears in the pixels at the end portion of the display screen and the image degradation occurs is increased when the histogram counting process is performed using the weighting coefficient to control the backlight emission amount. However, in the television image and the like, the focus is placed on the foreground of the central part of the screen, and the focus is not originally placed on the background of the end portion of the screen. Therefore, it does not matter in terms of display quality even if the image quality of the end portion of the screen degrades.

The sixteenth embodiment is characterized in that the weighting coefficient in counting the histogram is calculated by the function having the position coordinate of the display data as an input value. Therefore, the equation representing the function is not limited to the equation 24 and the equation 25, and any functions other than the equation 24 and the equation 25 can be used as long as the weighting coefficient is calculated by inputting the coordinate value of the display data.

By the configuration as described above, when counting the histogram of the display image in the backlight control unit 3211, the influence on the display quality of the entire display screen by the display position can be controlled in a finer unit and reflected on the control of the backlight emission amount. Therefore, the power consumption reducing effect by the backlight control can be further enhanced while maintaining the display quality.

Note that a series of processes such as counting of histogram, calculation of the threshold value, extension of the display data, control of the backlight emission amount and the like performed in the backlight control unit 3211 in the drive circuit of the fourteenth to the sixteenth embodiments can be performed through the arithmetic operation in an external processor such as the control processor 3204 of FIG. 39.

In the foregoing, the invention made by the inventors of the present invention has been concretely described based on the fourteenth to sixteenth embodiments. However, it is needless to say that the present invention is not limited to the foregoing embodiments and various modifications and alterations can be made within the scope of the present invention.

The present invention can be applied to a technique for saving power by the backlight control while maintaining the display quality in an image display device such as a liquid crystal display and a projector. Also, the usable range thereof is not limited to the liquid crystal display for a mobile telephone, and the present invention can be used for other information equipments and televisions that use a liquid crystal display.

What is claimed is:

1. A display driver converting input display image data so that a part of a distribution of cumulative values of the number of pixels of each grayscale of the input display image data for one or plural frames is extended in a grayscale direction, and displaying the converted display image data on a display device, the display driver comprising: a conversion circuit which performs the conversion in accordance with a linear function when the grayscale of the display image data is a grayscale smaller than a specific grayscale and performs the conversion in accordance with a non-linear function including a ratio determined by a first difference between a maximum grayscale and a threshold grayscale and a second difference between the specific grayscale and the threshold grayscale when the grayscale of the display image data is equal to or higher than the specific grayscale, wherein a cumulative number of pixels of each grayscale between the threshold grayscale and the maximum grayscale is a predetermined proportion of the total number of pixels of the input display image data, wherein the specific grayscale is determined by multiplying the first difference between the maximum grayscale and the threshold grayscale by a constant value, wherein the conversion circuit performs the conversion to a grayscale corresponding to the cumulative value of the number of pixels of each grayscale equal to or higher than the specific grayscale of the display image data when the grayscale of the display image data is equal to or higher than the specific grayscale, a calculation circuit for measuring the number of pixels of each grayscale of the display image data and calculating the threshold grayscale, wherein the calculation circuit divides the display image data into a plurality of regions, measures the number of pixels of each grayscale of each region, and calculates a threshold grayscale of each region at which a cumulative value from the maximum grayscale reaches a predetermined proportion of the total number of pixels of each region, and a ratio of a difference between the specific grayscale and the threshold grayscale and a difference between the specific grayscale and a maximum grayscale that can be displayed on the display device is determined in accordance with a maximum value of the plurality of threshold grayscales of each region.

2. The display driver according to claim 1, further comprising:

wherein the specific grayscale is a grayscale smaller than the threshold grayscale, and a register for setting the ratio of a difference between the specific grayscale and the threshold grayscale and a difference between the specific grayscale and a maximum grayscale that can be displayed on the display device is provided.

3. The display driver according to claim 2, wherein the display device includes a light source whose light amount is controllable and a transmissivity control element for controlling transmissivity of light, the display device performs display by controlling the transmissivity control element disposed on a front surface of the light source, the display driver includes a light amount control circuit for controlling the light amount of the light source, and the light amount control circuit controls the light amount in accordance with the threshold grayscale.

4. The display driver according to claim 1, wherein a conversion method used when the grayscale of the display image data is equal to or higher than the specific grayscale is histogram equalization.

5. The display driver according to claim 4, wherein the conversion circuit eliminates grayscales equal to or higher than a specific grayscale X1 in the conversion of the histogram equalization and converts all grayscales to the maximum grayscale.

6. The display driver according to claim 1, further comprising:

a register for switching an extension method, wherein, when the register is in a first state, the conversion circuit performs the conversion in accordance with a first linear function if the grayscale of the display image data is smaller than the specific grayscale, and performs the conversion to a grayscale corresponding to the cumulative value of the number of pixels of each grayscale equal to or higher than the specific grayscale of the display image data if the grayscale of the display image data is equal to or higher than the specific grayscale, and when the register is in a second state, the conversion circuit performs the conversion in accordance with the first linear function if the grayscale of the display image data is equal to or smaller than the specific grayscale, and performs the conversion in accordance with a different second linear function if the grayscale of the display image data is equal to or higher than the specific grayscale.

7. The display driver according to claim 1, further comprising:

a register for setting the number of divided regions.

8. The display driver according to claim 1, further comprising:

a first calculation circuit for measuring the number of pixels of each grayscale of the display image data and calculating a first threshold grayscale at which a cumulative value from a maximum grayscale reaches a predetermined proportion of the total number of pixels; and a second calculation circuit for measuring the number of pixels of each grayscale of the display image data in which difference from an adjacent pixel is equal to or larger than a predetermined value and calculating a second threshold grayscale at which a cumulative value from the maximum grayscale reaches a second predetermined proportion of the total number of pixels, wherein a ratio of a difference between the specific grayscale and the threshold grayscale and a difference between the specific grayscale and a maximum grayscale that can be displayed on the display device is determined in accordance with the second threshold grayscale.

9. The display driver according to claim 1, wherein the conversion circuit operates to eliminate grayscales equal to or higher than a different specific grayscale XI from counting when counting the cumulative value of the number of pixels of each grayscale equal to or higher than the specific grayscale of the display image data, and the conversion circuit performs the conversion to a grayscale corresponding to the resultant cumulative value.

10. The display driver according to claim 9, further comprising: a register for setting the specific grayscale X1.

11. The display driver according to claim 1, wherein, when the cumulative value is rapidly changed, the number of grayscales in which a grayscale value after conversion changes in a predetermined time period is limited, and convergence to a grayscale corresponding to the cumulative value is achieved through plural frames.

12. The display driver according to claim 11, further comprising:

a register for setting the number of grayscales in which a grayscale value after conversion changes in a predetermined time period.

13. The display driver according to claim 1, wherein a dead region for a change of the grayscale value after conversion is provided, when the cumulative value finely changes and the grayscale value after conversion changes within the dead region, the change of the grayscale value after conversion is limited and kept stable, and when the cumulative value largely changes and the grayscale value after conversion is outside the dead region, the grayscale value after conversion is changed so as to converge to a grayscale corresponding to the cumulative value.

14. The display driver according to claim 13, further comprising:

a register for setting the dead region for the change of the grayscale value after conversion.

15. A display driver converting input display image data so that a part of a distribution of cumulative values of the number of pixels of each grayscale of the input display image data for one or plural frames is extended in a grayscale direction, and displaying the converted display image data on a display device, the display driver comprising: a conversion circuit which performs the conversion in accordance with a linear function when the grayscale of the display image data is a grayscale smaller than a specific grayscale and performs the conversion in accordance with a non-linear function including a ratio determined by a first difference between a maximum grayscale and a threshold grayscale and a second difference between the specific grayscale and the threshold grayscale when the grayscale of the display image data is equal to or higher than the specific grayscale, wherein a cumulative number of pixels of each grayscale between the threshold grayscale and the maximum grayscale is a predetermined proportion of the total number of pixels of the input display image data, wherein the specific grayscale is determined by multiplying the first difference between the maximum grayscale and the threshold grayscale by a constant value, wherein the conversion circuit performs the conversion to a grayscale corresponding to the cumulative value of the number of pixels of each grayscale equal to or higher than the specific grayscale of the display image data when the grayscale of the display image data is equal to or higher than the specific grayscale, a calculation circuit for measuring the number of pixels of each grayscale of the display image data and calculating the threshold grayscale, wherein the specific grayscale is the threshold grayscale, wherein the calculation circuit divides the display image data into a plurality of regions, measures the number of pixels of each grayscale of each region, and calculates a threshold grayscale of each region at which a cumulative value from the maximum grayscale reaches a predetermined proportion of the total number of pixels of each region, the linear function is a linear function which outputs a second specific grayscale when the threshold grayscale is input, and a ratio of a difference between the threshold grayscale and the second specific grayscale and a difference between the threshold grayscale and a maximum grayscale that can be displayed on the display device is determined in accordance with a maximum value of the plurality of threshold grayscales of each region.

16. The display driver according to claim 15, further comprising:

a register for setting the ratio of a difference between the threshold grayscale and the second specific grayscale and a difference between the threshold grayscale and a maximum grayscale that can be displayed on the display device is provided.

17. The display driver according to claim 15, further comprising:

a second calculation circuit for measuring the number of pixels of each grayscale of the display image data in which difference from an adjacent pixel is equal to or larger than a predetermined value and calculating a second threshold grayscale at which the cumulative value from the maximum grayscale reaches a second predetermined proportion of the total number of pixels, wherein an output grayscale when the threshold grayscale is input to a first linear function is a specific grayscale, the specific grayscale is a grayscale equal to or lower than a maximum grayscale that can be displayed on the display device and equal to or higher than the threshold grayscale, and a ratio of a difference between the maximum grayscale and the threshold grayscale and a difference between the specific grayscale and the threshold grayscale is determined in accordance with the second threshold grayscale.

18. The display driver according to claim 15, wherein the display device includes a light source whose light amount is controllable and a transmissivity control element for controlling transmissivity of light, the display device performs display by controlling the transmissivity control element disposed on a front surface of the light source, the display driver includes a light amount control circuit for controlling the light amount of the light source, an output grayscale when the threshold grayscale is input to a first linear function is a specific grayscale, the specific grayscale is a grayscale equal to or lower than a maximum grayscale that can be displayed on the display device and equal to or higher than the threshold grayscale, and the light amount control circuit controls the light amount in accordance with a ratio of a difference between the maximum grayscale and the threshold grayscale and a difference between the specific grayscale and the threshold grayscale.

19. A display device converting input display image data so that a part of distribution of cumulative values of the number of pixels of each grayscale of the input display image data for one or plural frames is extended in a grayscale direction, and displaying the converted display image data, the display device comprising: a conversion circuit which performs the conversion in accordance with a linear function when the grayscale of the display image data is a grayscale smaller than a specific grayscale and performs the conversion in accordance with a non-linear function including a ratio determined by a first difference between a maximum grayscale and a threshold grayscale and a second difference between the specific grayscale and the threshold grayscale when the grayscale of the display image data is equal to or higher than the specific grayscale, wherein a cumulative number of pixels of each grayscale between the threshold grayscale and the maximum grayscale is a predetermined proportion of the total number of pixels of the input display image data, wherein the specific grayscale is determined by multiplying the first difference between the maximum grayscale and the threshold grayscale by a constant value, wherein the conversion circuit performs the conversion in accordance with a linear function when the grayscale of the display image data is smaller than a specific grayscale, and calculates a cumulative value of the number of pixels of each grayscale equal to or higher than the specific grayscale of the display image data and performs the conversion to a grayscale corresponding to the cumulative value when the grayscale of the display image data is equal to or higher than the specific grayscale, the display device further comprising:

a calculation circuit for measuring the number of pixels of each grayscale of the display image data and calculating the threshold, wherein the calculation circuit divides the display image data into a plurality of regions, measures the number of pixels of each grayscale of each region, and calculates a threshold grayscale of each region at which a cumulative value from the maximum grayscale reaches a predetermined proportion of the total number of pixels of each region, and a ratio of a difference between the specific grayscale and the threshold grayscale and a difference between the specific grayscale and a maximum grayscale that can be displayed on the display device is determined in accordance with a maximum value of the plurality of threshold grayscales of each region.

20. The display device according to claim 19, further comprising a light source whose light amount is controllable, wherein the display device performs display by controlling a transmissivity control element for controlling transmissivity of light disposed on a front surface of the light source, the display device includes: a threshold grayscale calculation circuit for measuring the number of pixels of each grayscale of the display image data and calculating the threshold grayscale; and a light amount control circuit for controlling the light amount of the light source, and the light amount control circuit controls the light amount in accordance with the threshold grayscale.

21. The display device according to claim 19, wherein a conversion method used when the grayscale of the display image data is equal to or higher than the specific grayscale is histogram equalization.

22. The display device according to claim 21, wherein the conversion circuit eliminates grayscales equal to or higher than a specific grayscale X1 in the conversion of the histogram equalization and converts all grayscales to the maximum grayscale.

23. The display device according to claim 19, further comprising:

a register for switching an extension method, wherein, when the register is in a first state, the conversion circuit performs the conversion in accordance with a first linear function if the grayscale of the display image data is smaller than the specific grayscale, and performs the conversion to a grayscale corresponding to the number of pixels of each grayscale equal to or higher than the specific grayscale of the display image data if the grayscale of the display image data is equal to or higher than the specific grayscale, and when the register is in a second state, the conversion circuit performs the conversion in accordance with the first linear function if the grayscale of the display image data is equal to or smaller than the specific grayscale, and performs the conversion in accordance with a different second linear function if the grayscale of the display image data is equal to or higher than the specific grayscale.

24. The display device according to claim 19, further comprising:

a first calculation circuit for measuring the number of pixels of each grayscale of the display image data and calculating a first threshold grayscale at which a cumulative value from a maximum grayscale reaches a predetermined proportion of the total number of pixels; and a second calculation circuit for measuring the number of pixels of each grayscale of the display image data in which difference from an adjacent pixel is equal to or larger than a predetermined value and calculating a second threshold grayscale at which a cumulative value from the maximum grayscale reaches a second predetermined proportion of the total number of pixels, wherein a ratio of a difference between the specific grayscale and the threshold grayscale and a difference between the specific grayscale and a maximum grayscale that can be displayed on the display device is determined in accordance with the second threshold grayscale.

25. The display device according to claim 19, wherein the conversion circuit operates to eliminate grayscales equal to or higher than a different specific grayscale XI from counting when counting the cumulative value of the number of pixels of each grayscale equal to or higher than the specific grayscale of the display image data, and the conversion circuit performs the conversion to a grayscale corresponding to the resultant cumulative value.

26. The display device according to claim 25, further comprising: a register for setting the specific grayscale X1.

27. A display device converting input display image data so that a part of distribution of cumulative values of the number of pixels of each grayscale of the input display image data for one or plural frames is extended in a grayscale direction, and displaying the converted display image data, the display device comprising: a conversion circuit which performs the conversion in accordance with a linear function when the grayscale of the display image data is a grayscale smaller than a specific grayscale and performs the conversion in accordance with a non-linear function including a ratio determined by a first difference between a maximum grayscale and a threshold grayscale and a second difference between the specific grayscale and the threshold grayscale when the grayscale of the display image data is equal to or higher than the specific grayscale, wherein a cumulative number of pixels of each grayscale between the threshold grayscale and the maximum grayscale is a predetermined proportion of the total number of pixels of the input display image data, wherein the specific grayscale is determined by multiplying the first difference between the maximum grayscale and the threshold grayscale by a constant value, wherein the conversion circuit performs the conversion in accordance with a linear function when the grayscale of the display image data is smaller than a specific grayscale, and calculates a cumulative value of the number of pixels of each grayscale equal to or higher than the specific grayscale of the display image data and performs the conversion to a grayscale corresponding to the cumulative value when the grayscale of the display image data is equal to or higher than the specific grayscale, the display device further comprising:

a calculation circuit for measuring the number of pixels of each grayscale of the display image data and calculating the threshold grayscale, wherein the specific grayscale is the threshold grayscale, a calculation circuit for dividing the display image data into a plurality of regions, measuring the number of pixels of each grayscale of each region, and calculating a threshold grayscale of each region at which a cumulative value from the maximum grayscale reaches a predetermined proportion of the total number of pixels of each region, wherein the linear function is a linear function which outputs a second specific grayscale when the threshold grayscale is input, and a ratio of a difference between the threshold grayscale and the second specific grayscale and a difference between the threshold grayscale and a maximum grayscale that can be displayed on the display device is determined in accordance with a maximum value of the plurality of threshold grayscales of each region.

28. The display device according to claim 27, further comprising:

a light source whose light amount is controllable, wherein the display device performs display by controlling a transmissivity control element for controlling transmissivity of light disposed on a front surface of the light source, the display device includes a light amount control circuit for controlling the light amount of the light source, an output grayscale when a threshold grayscale is input to the first linear function is a specific grayscale, the specific grayscale is a grayscale equal to or lower than a maximum grayscale that can be displayed on the display device and equal to or higher than the threshold grayscale, and the light amount control circuit controls the light amount in accordance with a ratio of a difference between the maximum grayscale and the threshold grayscale and a difference between the specific grayscale and the threshold grayscale.

* * * * *